US005866313A

United States Patent [19]

Hirano

[11] Patent Number: 5,866,313

[45] Date of Patent: Feb. 2, 1999

[54] SILVER HALIDE PHOTOGRAPHIC LIGHT-SENSITIVE MATERIAL

[75] Inventor: Katsumi Hirano, Minami-ashigara, Japan

[73] Assignee: Fuji Photo Film Co., Ltd., Kanagawa, Japan

[21] Appl. No.: 758,395

[22] Filed: Nov. 29, 1996

[30] Foreign Application Priority Data

Nov. 30, 1995 [JP] Japan ..... 7-334197
Oct. 11, 1996 [JP] Japan ..... 8-287288

[51] Int. Cl.[6] ..... G03C 1/08; G03C 7/26; G03C 7/32

[52] U.S. Cl. ..... 430/551; 430/264; 430/598; 430/607; 430/611; 430/613; 430/614; 430/615; 430/448

[58] Field of Search ..... 430/264, 598, 430/551, 607, 611, 613, 614, 615, 567, 448

[56] References Cited

U.S. PATENT DOCUMENTS

| | | | |
|---|---|---|---|
| 5,204,214 | 4/1993 | Okamura et al. | 430/598 |
| 5,244,773 | 9/1993 | Muramatsu et al. | 430/598 |
| 5,284,739 | 2/1994 | Clarke et al. | 430/504 |
| 5,374,498 | 12/1994 | Fujita et al. | 430/264 |
| 5,447,835 | 9/1995 | Sakai et al. | 430/264 |

*Primary Examiner*—Geraldine Letscher
*Attorney, Agent, or Firm*—Birch, Stewart, Kolasch & Birch, LLP

[57] ABSTRACT

A silver halide photographic light-sensitive material having at least one light-sensitive silver halide emulsion layer, on a support, and comprising a reducing agent for color formation of carbamoyl-substituted hydrazine, a dye-forming coupler and at least one photographic stabilizer selected from five groups of compounds.

23 Claims, No Drawings

SILVER HALIDE PHOTOGRAPHIC LIGHT-SENSITIVE MATERIAL

BACKGROUND OF THE INVENTION

1. Field of the Invention

The present invention relates to a silver halide photographic light-sensitive material containing a light-sensitive silver halide emulsion, a dye-forming coupler, and a reducing agent for color formation and, more particularly, to a silver halide photographic light-sensitive material by which image formation is possible by performing essentially only alkali bath processing.

The present invention also relates to a silver halide color photographic light-sensitive material which has a high sensitivity and a high storage stability, which can be rapidly processed, and by which the environmental load and the waste can be reduced.

2. Description of the Related Art

Generally, image formation of a silver halide color photographic light-sensitive material is performed through a color development step and a silver removing step. In the color development step, exposed silver halide grains are developed (reduced) by an aromatic primary amine developing agent, and a color image is obtained by the reaction between the oxidation product of the developing agent and a coupler.

In color paper processing, for example, development is performed in an alkali bath containing 4-amino-N-ethyl-N-(β-methanesulfonamidoethyl)-aniline sulfate as the aromatic primary amine developing agent.

On the other hand, black-and-white photographic light-sensitive material using a silver image is developed in an alkali bath containing hydroquinone as the developing agent and ascorbic acid.

When these common color developing agents are used in the form of alkali solutions, they are air-oxidized and significantly deteriorated. Therefore, large amounts of preservatives and replenishers are used to maintain the solution compositions and the photographic properties.

Recently, in this field of art it is being desired to reduce the environmental load and the waste and to reuse the waste. Accordingly, attempts are being made to greatly reduce the processing chemicals and the replenishers of developers.

In maintaining the photographic properties in both continuous processing and intermittent processing, however, although the amount of replenishers are reduced, the processing chemicals in the replenishers are thickened. Presently, therefore, the processing chemicals are not reduced. Also, reducing the replenishers poses another problem in that stains and variations in the photographic properties are significantly increased by the accumulated components.

As an effective means for reducing the processing chemicals and the replenishers, it is possible to incorporate a color developing agent or its precursor into a photographic light-sensitive material. This means is described in, e.g., U.S. Pat. Nos. 2,507,114, 3,764,328, and 4,060,418, and Jpn. Pat. Appln. KOKAI Publication (hereinafter referred to as JP-A) 56-6235 and 58-192031. Unfortunately, these aromatic primary amines and their precursors are unstable and therefore have the drawback that stains are produced when unprocessed light-sensitive materials are stored for long periods of time or color-developed.

In addition to the color development methods described above, there are methods described in, e.g., European Patent (hereinafter referred to as EP) 0545491A1 and EP 0565165A1 in which a sulfonylhydrazine compound is incorporated into a light-sensitive layer. However, no satisfactory color density can be obtained when color development is performed even with the use of this sulfonylhydrazine compound. Also, when a two-equivalent coupler is used, this sulfonylhydrazine compound generates almost no color. When compared to four-equivalent couplers, two-equivalent couplers have the advantages that stains resulting from a coupler can be reduced, the activity of a coupler can be easily adjusted, and various functions can be imparted to a split-off group. Accordingly, the development of a technique which makes the best use of these advantages has been desired.

As a means for solving the above problem, a method is developed by which a carbamoylhydrazine compound which generates colors together with a two-equivalent coupler is incorporated into a light-sensitive layer as a reducing agent for color formation.

Unfortunately, to obtain color images by essentially processing a light-sensitive material with an alkali solution, the reducing agent for color formation described above is contained in the light-sensitive material. Especially when an auxiliary developing agent is additionally contained, the influence of these components significantly decreases the sensitivity of a light-sensitive silver halide emulsion and degrades the storage stability of the light-sensitive material. Therefore, some improvements have been desired and the development of proper stabilizers and silver halide emulsions have been eagerly waited for.

SUMMARY OF THE INVENTION

Light-sensitive materials containing conventional color developing agents have a low sensitivity, an unsatisfactory storage stability, and photographic properties which easily vary due to processing variations.

It is, therefore, an object of the present invention to provide a silver halide photographic light-sensitive material which can be essentially processed in an alkali bath, which reduces replenishers and processing chemicals, and which has a high sensitivity and a high storage stability.

DETAILED DESCRIPTION OF THE PREFERRED EMBODIMENTS

The present inventors have made extensive studies on these problems and accomplished the above object by the following means.

(1) A silver halide photographic light-sensitive material having a photographic constituting element layer structure on a support, said layer structure comprising at least one layer of light-sensitive silver halide emulsion, wherein said layer structure contains a dye-forming coupler, a reducing agent for color formation represented by general formula (I) or (II) below, and at least one photographic stabilizer selected from groups A to E below:

General formula (I)

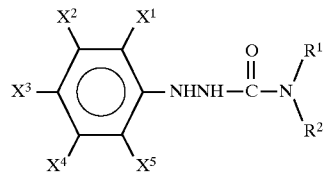

-continued

General formula (II)

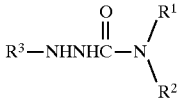

wherein each of $R^1$ and $R^2$ independently represents a hydrogen atom or a substituent group, each of $X^1$, $X^2$, $X^3$, $X^4$, and $X^5$ independently represents a hydrogen atom or a substituent group, a sum of Hammett substituent constants $\sigma_p$ of $X^1$, $X^3$, and $X^5$ and Hammett substituent constants $\sigma_m$ of $X^2$ and $X^4$ being 0.80 to 3.80, and $R^3$ represents a heterocyclic group; photographic stabilizers Group A. mercapto heterocyclic nitrogen compounds each having a mercapto group bonded to a carbon atom which is bonded to an adjacent nitrogen atom in a heterocyclic system, Group B. quaternary aromatic chalcogen azolium salts wherein the chalcogen is sulfur, selenium, or tellurium, Group C. triazoles or tetrazoles each having ionic hydrogen bonded to a nitrogen atom in a heterocyclic system, Group D. dichalcogenide compounds each having an —X—X-bond (wherein each X represents divalent sulfur, selenium, or tellurium) between carbon atoms, and Group E. organic compounds each having thiosulfonic acid or a salt thereof having a structure —$SO_2SM$ (wherein M represents a proton or a cation).

(2) The light-sensitive material described in (1), further comprising a mordant.

(3) The light-sensitive material described in (1) or (2), further comprising an auxiliary developing agent and/or its precursor.

(4) The light-sensitive material described in (1) or (2), wherein the photographic stabilizer is a mercapto heterocyclic nitrogen compound containing a mercapto group bonded to a carbon atom which is bonded to an adjacent nitrogen atom in a heterocyclic system.

(5) The light-sensitive material described in (1) or (2), wherein the photographic stabilizer is quaternary aromatic chalcogen azolium salt in which chalcogen is sulfur, selenium, or tellurium.

(6) The material described in (1) or (2), wherein the photographic stabilizer is a dichalcogenide compound containing an —X—X-bond (wherein each X represents divalent sulfur, selenium, or tellurium) between carbon atoms.

(7) The material described in (1) or (2), wherein the photographic stabilizer is an organic compound containing thiosulfonic acid or a salt thereof having a structure —$SO_2SM$ (wherein M represents a proton or a cation).

(8) The material described in (1) or (2), wherein tabular grains having an aspect ratio of 2 or more occupies 50% or more of the total projected area of all grains in the silver halide emulsion, and a silver chloride content of the silver halide in the emulsion is 50 mol % or more.

Specific constitutions of the present invention will be described below.

The reducing agent for color formation used in the present invention will be described in detail below.

The reducing agent for color formation used in the present invention and represented by general formula (I) or (II) is a compound which is oxidized in an alkali solution when directly reacting with an exposed silver halide or oxidized in an alkali solution when causing a redox reaction with an auxiliary developing agent oxidized by the exposed silver halide. The oxidation product of the compound reacts with a dye-forming coupler to form a dye.

Details of the structure of a reducing agent for color formation represented by general formula (I) or (II) will be described below.

Of compounds represented by general formulas (I) and (II), compounds represented by general formulas (III) and (IV) are more preferable.

General formula (I)

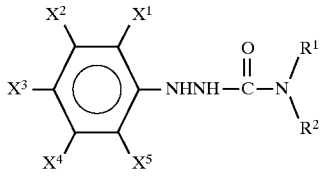

General formula (II)

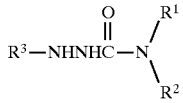

General formula (III)

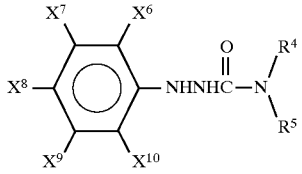

General formula (IV)

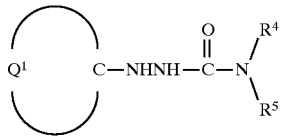

Compounds represented by general formulas (I) to (IV) will be described in detail below.

Each of $X^1$, $X^2$, $X^3$, $X^4$, and $X^5$ independently represents a hydrogen atom or a substituent group.

Examples of $X^1$, $X^2$, $X^3$, $X^4$, and $X^5$ are a 1- to 50-carbon straight-chain, branched, or cyclic alkyl group (e.g., trifluoromethyl, methyl, ethyl, propyl, heptafluoropropyl, isopropyl, butyl, t-butyl, t-pentyl, cyclopentyl, cyclohexyl, octyl, 2-ethylhexyl, and dodecyl), a 2- to 50-carbon straight-chain, branched, or cyclic alkenyl group (e.g., vinyl, 1-methylvinyl, and cyclohexene-1-yl), a 2- to 50-carbon alkinyl group (e.g., ethynyl and 1-propynyl), a 6- to 50-carbon aryl group (e.g., phenyl, naphthyl, and anthryl), a 1- to 50-carbon acyloxy group (e.g., acetoxy, tetradecanoyloxy, and benzoyloxy), a 1- to 50-carbon carbamoyloxy group (e.g., N,N-dimethylcarbamoyloxy), a 1- to 50-carbon carbonamide group (e.g., formamide, N-methylacetamide, acetamide, N-methylformamide, and benzamide), a 1- to 50-carbon sulfonamide group (e.g., e.g., methanesulfonamide, dodecanesulfonamide, benzenesulfonamide, and p-toluenesulfonamide), a 1- to 50-carbon carbamoyl group (e.g., N-methylcarbamoyl, N,N-diethylcarbamoyl, and N-mesylcarbamoyl), a 0- to 50-carbon sulfamoyl group (e.g., N-butylsulfamoyl,N,N-diethylsulfamoyl, and N-methyl-N-(4-methoxyphenyl) sulfamoyl), a 1- to 50-carbon alkoxy group (e.g., methoxy, propoxy, isopropoxy, octyloxy, t-octyloxy, dodecyloxy, and 2-(2,4-di-t-pentylphenoxy)ethoxy), a 6- to 50-carbon aryloxy group (e.g., phenoxy, 4-methoxyphenoxy, and naphthoxy), a 7- to 50-carbon aryloxycarbonyl group (e.g., phenoxycarbonyl and naphthoxycarbonyl), a 2- to 50-carbon alkoxycarbonyl group (e.g., methoxycarbonyl and t-butoxycarbonyl), a 1- to 50-carbon N-acylsulfamoyl group (e.g., N-tetradecanoylsulfamoyl and N-benzoylsulfamoyl), a 1- to 50-carbon alkylsulfonyl group (e.g., methanesulfonyl, octylsulfonyl, 2-methoxyethylsulfonyl, and 2-hexyldecylsulfonyl), a 6- to 50-carbon arylsulfonyl group (e.g., benzenesulfonyl, p-toluenesulfonyl, and 4-phenylsulfonyl), a 2- to 50-carbon alkoxycarbonylamino group (e.g., ethoxycarbonylamino), a 7- to 50-carbon aryloxycarbonylamino group (e.g., phenoxycarbonylamino and naphthoxycarbonylamino), a 0- to 50-carbon amino group (e.g., amino, methylamino, diethylamino, diisopropylamino, aniline, and morpholino), a cyano group, a nitro group, a carboxyl group, a hydroxy group, a sulfo group, a mercapto group, a 1- to 50-carbon alkylsulfinyl group (e.g., methanesulfinyl and octanesulfinyl), a 6- to 50-carbon arylsulfinyl group (e.g., benzenesulfinyl, 4-chlorophenylsulfinyl, and p-toluenesulfinyl), a 1- to 50-carbon alkylthio group (e.g., methylthio, octylthio, and cyclohexylthio), a 6- to 50-carbon arylthio group (e.g., phenylthio and naphthylthio), a 1- to 50-carbon ureido group (e.g., 3-methylureido, 3,3-dimethylureido, and 1,3-diphenylureido), a 2- to 50-carbon heterocyclic group (a 3- to 12-membered monocyclic or condensed ring containing at least one nitrogen, oxygen, or sulfur atom as a hetero atom; e.g., 2-furyl, 2-pyranyl, 2-pyridyl, 2-thienyl, 2-imidazolyl, morpholino, 2-quinolyl, 2-benzimidazolyl, 2-benzothiazolyl, and 2-benzoxazolyl), a 1- to 50-carbon acyl group (e.g., acetyl, benzoyl, and trifluoroacetyl), a 0- to 50-carbon sulfamoylamino group (e.g., N-butylsulfamoylamino and N-phenylsulfamoylamino), a 3- to 50-carbon silyl group (e.g., trimethylsilyl, dimethyl-t-butylsilyl, and triphenylsilyl), and a halogen atom (e.g., a fluorine atom, a chlorine atom, and a bromine atom). The above functional groups can further have substituent groups, and examples of the substituent groups are the functional groups enumerated above. Also, adjacent two of $X^1$, $X^2$, $X^3$, $X^4$, and $X^5$ can bond together to form a condensed ring.

Preferable examples of $X^1$ to $X^5$ are groups (or atoms) of cyano, alkylsulfonyl, arylsulfonyl, alkylsulfinyl, arylsulfinyl, sulfamoyl, carbamoyl, alkoxycarbonyl, aryloxycarbonyl, acyl, trifluoromethyl, a halogen atom, acyloxy, and acylthio. Specific examples of these groups are the same as those enumerated above as examples of $X^1$ to $X^5$. Two adjacent groups of $X^1$ to $X^5$ can also form a condensed ring (e.g., a naphthalene ring or a quinoline ring). A sulfamoyl group and a carbamoyl group can also be substituted by 1 or 2 alkyl or aryl. In the functional groups (from alkylsulfonyl group, which is followed by arylsulfonyl group to an acylthio group) enumerated above as examples of $X^1$ to $X^5$ and containing an alkyl group or an aryl group, this alkyl group or aryl group can have a common substituent group. Possible examples of the substituent group are groups (or atoms) of hydroxy, alkoxy, aryloxy, halogen, alkoxycarbonyl, aryloxycarbonyl, carbamoyl, sulfamoyl, alkylthio, and arylthio. A plurality of these groups (atoms) can be contained, and these groups (atoms) can be the same or different.

Of the functional groups enumerated as preferable examples of $X^1$ to $X^5$, the number of carbon atoms of each functional group containing an alkyl group is preferably 1 to 50, more preferably 1 to 42, and most preferably 1 to 34. The number of carbon atoms of each functional group containing an aryl group is preferably 6 to 50, more preferably 6 to 42, and most preferably 6 to 34. An aromatic group containing a hetero atom is useful as well as an aryl group. The number of carbon atoms of this aromatic group is the same as the functional group containing an alkyl group. That is, the number of carbon atoms is preferably 1 to 50, more preferably 1 to 42, and most preferably 1 to 34. Specific examples of a heterocyclic ring from which the aromatic group containing a hetero atom is derived are pyridine, furan, thiophene, pyrazole, imidazole, and so on.

In general formulas (I) and (II), the total sum of the sum of Hammett substituent constants $\sigma_p$ of $X^1$, $X^3$, and $X^5$ and the sum of Hammett substituent constants $\sigma_m$ of $X^2$ and $X^4$ is 0.80 to 3.80, preferably 1.2 to 3.0.

In general formula (III), each of $X^6$, $X^7$, $X^8$, $X^9$, and $X^{10}$ independently represents a hydrogen atom, a cyano group, an alkylsulfonyl group, an arylsulfonyl group, an alkylsulfinyl group, an arylsulfonyl group, a sulfamoyl group, a carbamoyl group, an alkoxycarbonyl group, an aryloxycarbonyl group, an acyl group, a trifluoromethyl group, a halogen atom, an acyloxy group, an acylthio group, or a heterocyclic group. These groups can further have substituent groups, and $X^6$ to $X^{10}$ adjacent to each other can bond together to form a condensed ring. Specific examples are the same as those enumerated above for $X^1$, $X^2$, $X^3$, $X^4$, and $X^5$. In general formula (III), the total sum of the sum of Hammett substituent constants $\sigma_p$ of $X^6$, $X^8$, and $X^{10}$ and the sum of Hammett substituent constants $\sigma_m$ of $X^7$ and $X^9$ is 0.80 to 3.80, preferably 1.2 to 3.0.

If the total sum of the $\sigma_p$ values and the $\sigma_m$ values is smaller than 0.80, no satisfactory color generating properties can be obtained. On the other hand, if the total sum exceeds 3.80, it becomes difficult to synthesize and obtain a compound itself.

Note that the Hammett substituent constants $\sigma_p$ and $\sigma_m$ are explained in detail in, e.g., Naoki Inamoto, "Hammett's Rule -Structure and Reactivity-" (Maruzen), "New Experimental Chemistry Course 14-Synthesis and Reaction of Organic Compounds V", page 2605, (Japan Chemical Society ed., Maruzen), Tadao Nakaya, "Explanation of Theoretical Organic Chemistry", page 217 (Tokyo Kagaku Dojin), and Chemical Review (Vol. 91) pages 165 to 195 (1991).

Each of $R^1$ and $R^2$ in general formulas (I) and (II) and $R^4$ and $R^5$ in general formulas (III) and (IV) independently represents a hydrogen atom or a substituent group. Although practical examples of the substituent group are the same as those enumerated above for $X^1$, $X^2$, $X^3$, $X^4$, and $X^5$, the substituent group is preferably a hydrogen atom, a 1- to 50-carbon substituted or unsubstituted alkyl group, a 6- to 50-carbon substituted or unsubstituted aryl group, or a 1- to 50-carbon substituted or unsubstituted heterocyclic group. More preferably, at least one of $R^1$ and $R^2$ and at least one of $R^4$ and $R^5$ are hydrogen atoms.

One preferable example of a heterocyclic ring represented by $R^3$ is a 5- to 8-membered monocyclic or condensed heterocyclic ring which contains nitrogen and can also contain an O or S atom. Specific examples are presented below. In these examples, the number given in the parentheses after each heterocyclic group represents the bonding position of the group. If a plurality of numbers are given in the parentheses, one of these numbers indicates the bonding position. Examples are pyridine (2, 3, 4), pyrimidine (2, 4), pyridazine (2), pyrazine (2), 1,2,4-triazine (3, 5, 6), 1,3,5-triazine (2), pyrazole (2, 3), imidazole (2, 4, 5), thiazole (2, 4, 5), isothiazole (3, 5), oxazole (2, 4, 5), isoxazole (3, 5), 1,2,4-thiadiazole (2, 5), quinazoline (2, 4), quinoxaline (2, 3), phthalazine (1, 4), quinoline (2, 4), isoquinoline (1, 3, 4), benzothiazole (2), benzoxazole (2), benzimidazole (2), pteridine (2, 4, 6, 7), and purine (2, 6, 8). The number of nitrogen atoms contained in these monocyclic or condensed rings is preferably 1 to 4. The number of carbon atoms of a heterocyclic ring represented by $R^3$ is 1 to 50, preferably 1 to 42, and most preferably 1 to 34.

In general formula (IV), $Q^1$ represents non-metallic atoms necessary to form a nitrogen-containing 5- to 8-membered heterocyclic ring together with C. Preferable examples of the heterocyclic ring which $Q^1$ forms together with C are the same as those enumerated above for $R^3$.
Practical examples of the novel reducing agent for color formation used in the present invention are presented below. However, the scope of the present invention is not limited to these examples.
I-1
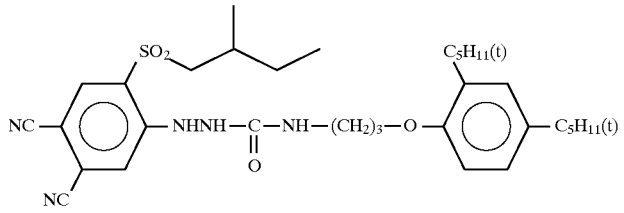
I-2
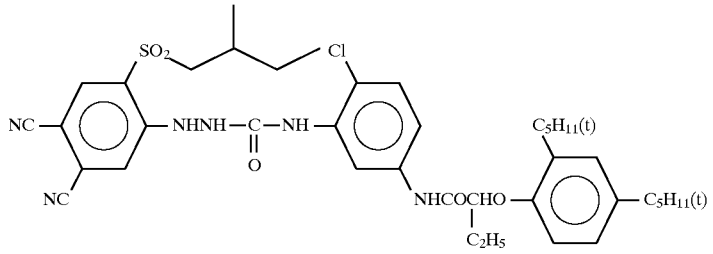
I-3
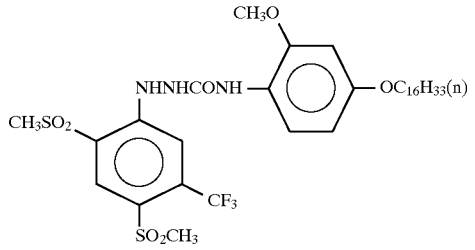
I-4
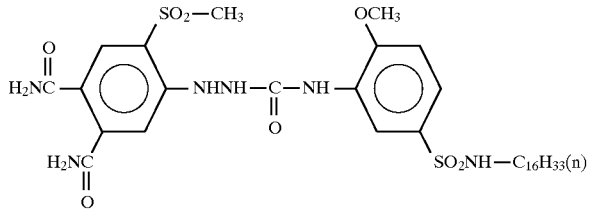
I-5
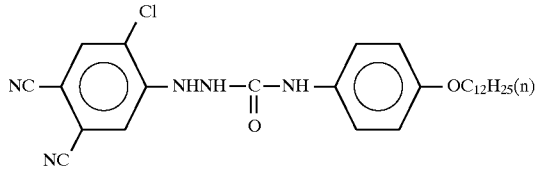
I-6
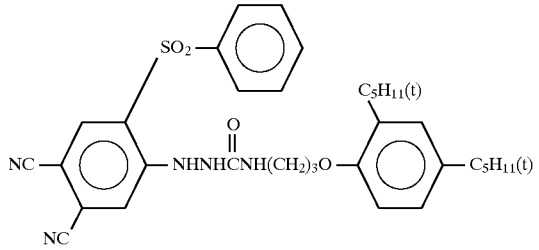

-continued
I-7
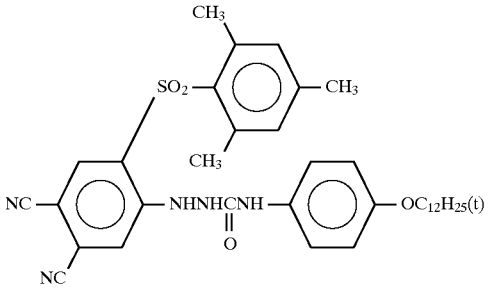
I-8
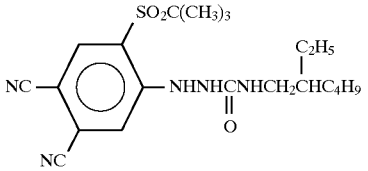
I-9
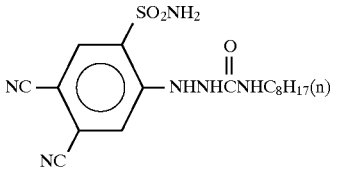
I-10
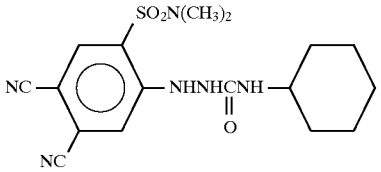
I-11
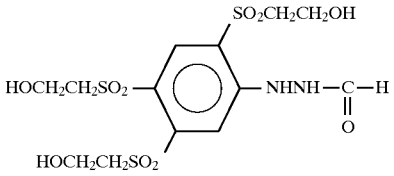
I-12
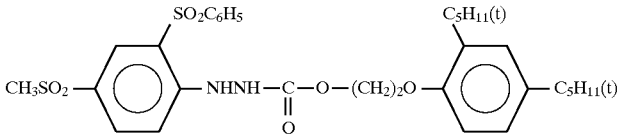
I-13
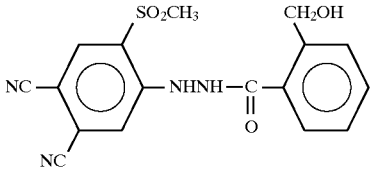
I-14
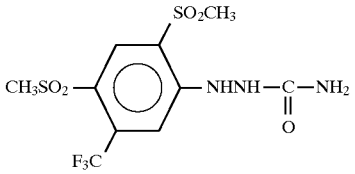

-continued
I-15
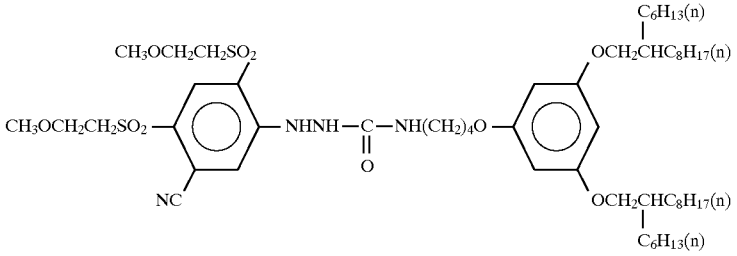
I-16
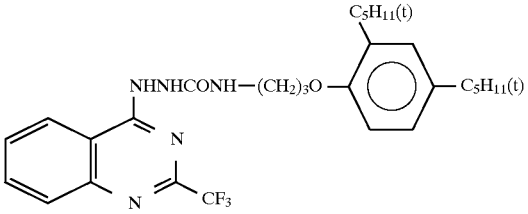
I-17
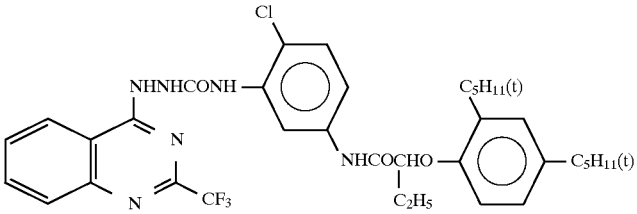
I-18
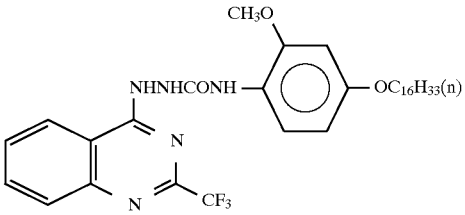
I-19
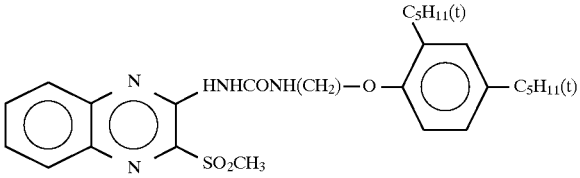
I-20
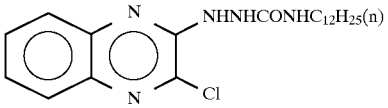
I-21
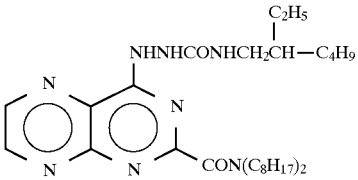
I-22
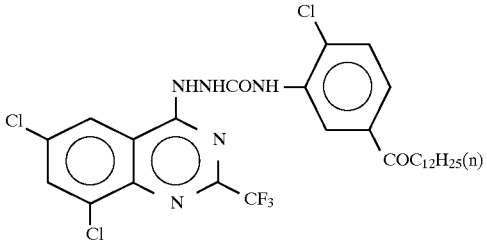

-continued
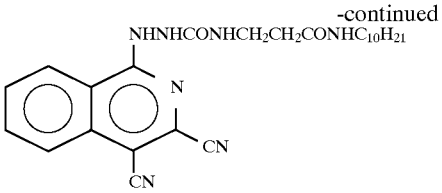
I-23
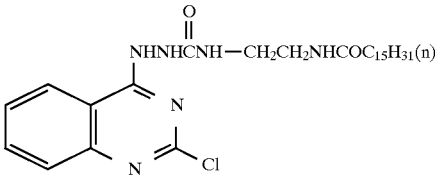
I-24
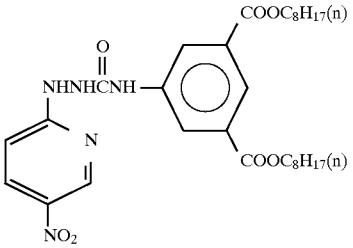
I-25
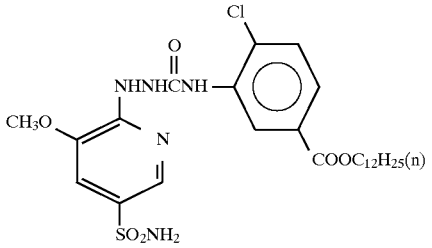
I-26
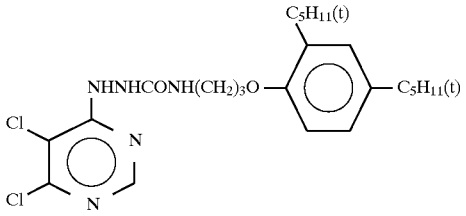
I-27
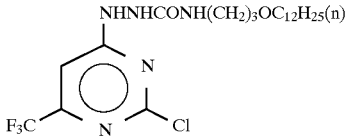
I-28
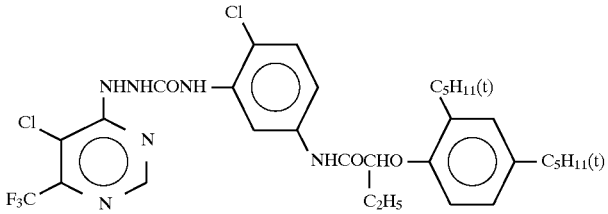
I-29
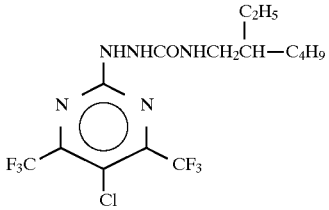
I-30

-continued
I-31
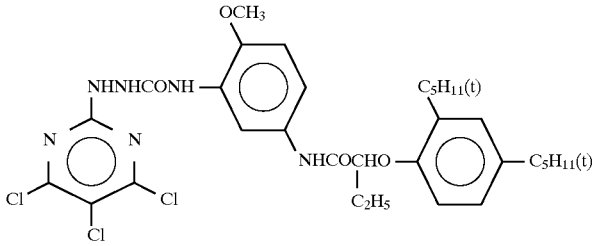
I-32
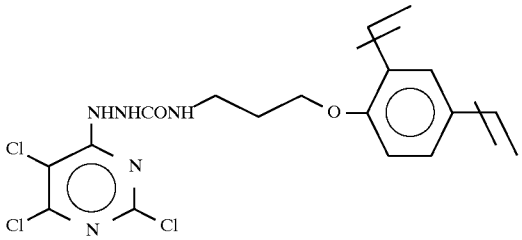
I-33
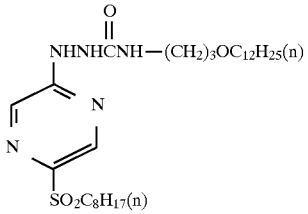
I-34
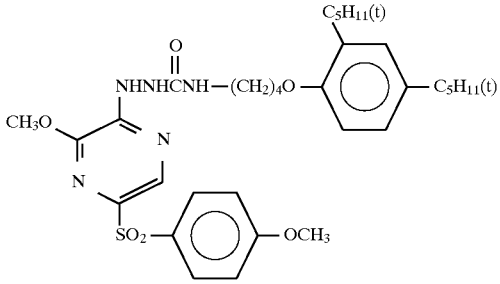
I-35
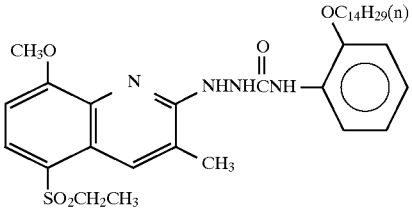
I-36
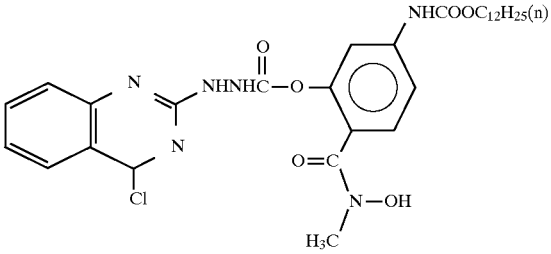

-continued
I-37
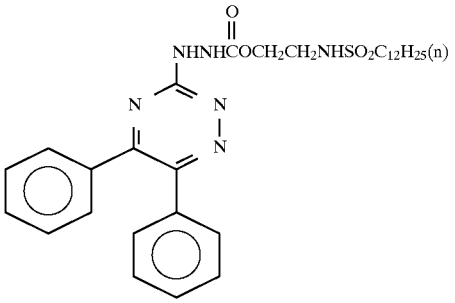
I-38
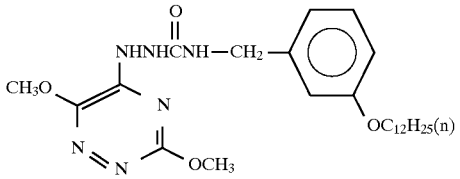
I-39
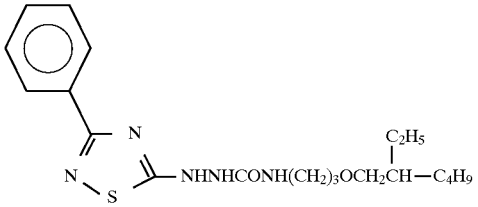
I-40
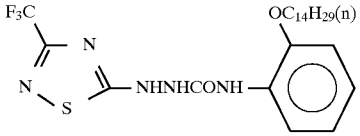
I-41
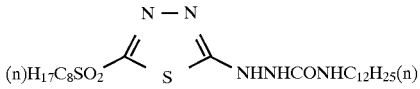
I-42
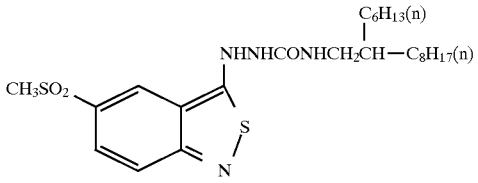
I-43
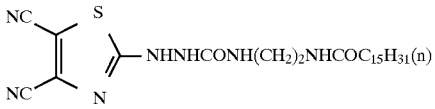
I-44
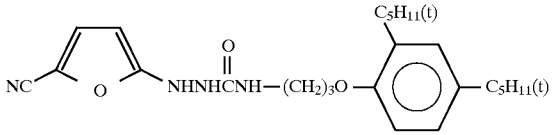
I-45
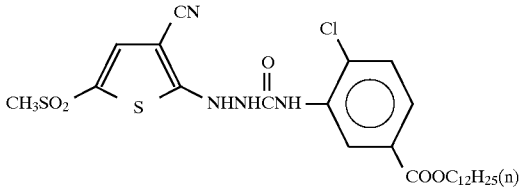

-continued
I-46
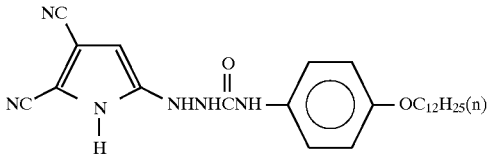
I-47
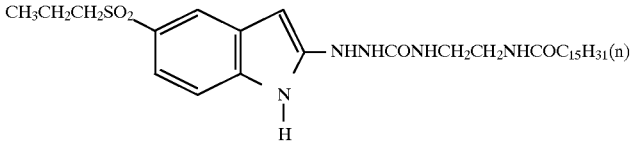
I-48
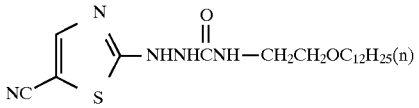
I-49
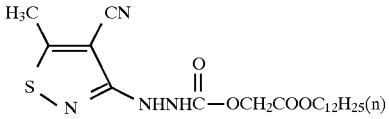
I-50
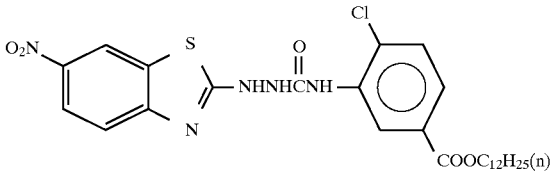
I-51
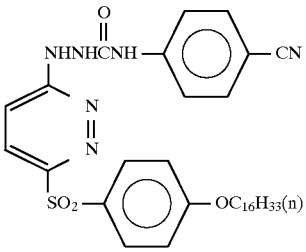
I-52
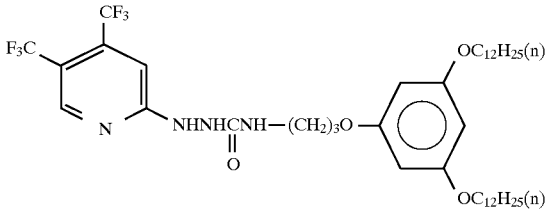
I-53
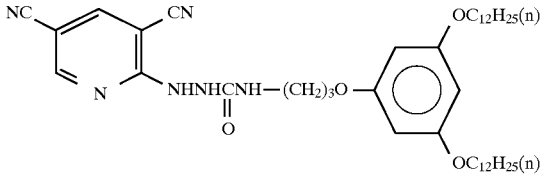
I-54
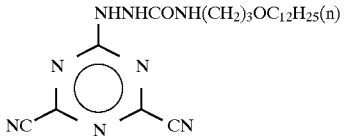

-continued

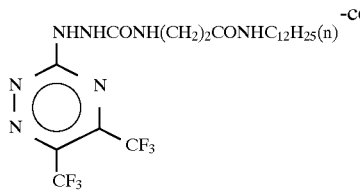

I-55

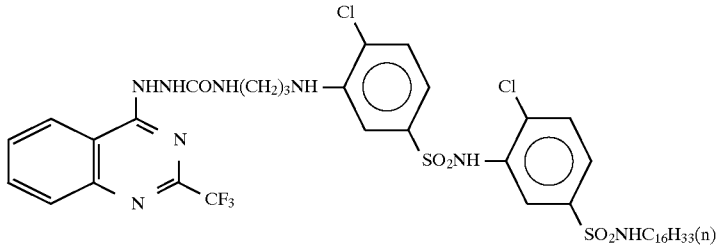

I-56

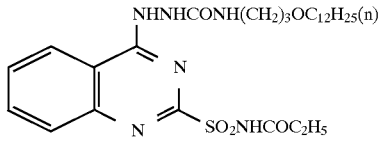

I-57

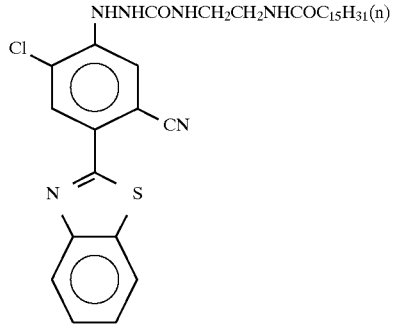

I-58

Details of the photographic stabilizers A to E in the present invention will be described below.

The photographic stabilizers included in A to E themselves are already known as stabilizers. However, no constitution is known in which these photographic stabilizers are used together with the reducing agent for color formation used in the light-sensitive materials of the present invention. The present inventors have found the fact that the light-sensitive materials of the present invention using these photographic stabilizers can achieve an extraordinarily remarkable effect of capable of preventing a decrease in the sensitivity without sacrificing a high sensitivity of a light-sensitive silver halide.

Although the interaction between a silver halide emulsion and the reducing agent for color formation used together with the emulsion has not been made clear, it is considered that there is the influence of the reducing properties of the reducing agent for color formation. It turns out that it is possible to increase the sensitivity by preventing an increase in so-called fog which occurs simultaneously with a decrease in the sensitivity, and to significantly improve the storage stability of a light-sensitive material.

Within the range over which the effect of the present invention is achieved, some or all of the photographic stabilizers can be made exit in the light-sensitive material of the present invention during its development.

Photographic stabilizers of group A used to practice the present invention are mercapto heterocyclic nitrogen compounds each having a mercapto group bonded to a carbon atom which is bonded to an adjacent nitrogen atom in a heterocyclic system. A typical group A photographic stabilizer is heterocyclic mercaptan such as mercaptotetrazoles, and an example is 5-mercaptotetrazole. A more specific example is aryl-5-mercaptotetrazole such as phenyl-5-mercaptotetrazole. Usable appropriate group A photographic stabilizers are described in the following documents and U.S. Patents. The U.S. Patents are incorporated by reference into the specification. That is, these photographic stabilizers are mercaptotetrazoles, mercaptotriazoles, and mercaptodiazoles described in U.S. Pat. No. 2,403,927 by Kendall, U.S. Pat. No. 3,266,897 by Kennard et al., Research Disclosure Vol. 116, December 1973, Item 11684, U.S. Pat. No. 3,397,987 by Luckey et al., and U.S. Pat. No. 3,708,303 by Salesin, and purines described in U.S. Pat. No. 2,319,090 by Sheppard et al.

The heterocyclic system of the group A photographic stabilizers contains at least one heterocyclic ring which includes at least one hetero atom selected from the group consisting of nitrogen, oxygen, sulfur, selenium, and tellurium. A heterocyclic ring in the cyclic system can be fused or condensed to one or more rings containing no hetero atom. Proper examples of the heterocyclic system are monoazoles (e.g., oxazoles, benzoxazoles, selenazoles, and benzothiazoles), diazoles (e.g., imidazoles, benzimidazoles, oxadiazoles, and thiadiazoles), triazoles (e.g., 1,2,4-triazoles, particularly those containing an amino substituent group in addition to a mercapto group), pyrimidines, 1,2,4-triazines, s-triazines, and azaindenes (e.g., tetrazaindenes). It should be understood that the term "mercapto" includes an undissociated thioenol form or a tautomerism thiocarbonyl form in addition to an ionized form or a salt form. If a mercapto group takes a salt form, this mercapto group associates with a cation of an alkali metal such as sodium or potassium or of ammonium, or with a cation derivative such as triethylamine, triethanolamine, or morpholine.

Any of the mercapto heterocyclic nitrogen compounds described in this specification acts as a photographic stabilizer in practicing the present invention. However, particularly good results can be obtained when mercaptoazoles, particularly 5-mercaptotetrazoles are used. 5-mercaptotetrazoles usable in the present invention preferably have the following structure.

A-I

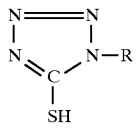

(wherein R is a 1- to 20-carbon aliphatic or aromatic group). This aliphatic group represents all aliphatic groups except for an aromatic group and represents a straight-chain, branched, or cyclic, saturated or unsaturated aliphatic group. A cyclic aromatic group includes a heterocyclic group. An alkyl or aryl group represented by R can be either a substituted or unsubstituted group. Proper examples of the substituent group are alkoxy, phenoxy, halogen, cyano, nitro, amino, substituted amino, sulfo, sulfamyl, substituted sulfamyl, sulfonylphenyl, sulfonylalkyl, fluorosulfonyl, sulfonamidophenyl, sulfonamidoalkyl, carboxy, carboxylate, ureidocarbamyl, carbamylphenyl, carbamylalkyl, carbonylalkyl, and carbonylphenyl each having 20 or less carbon atoms. R is preferably a 1- to 12-carbon aliphatic or aromatic group, and more preferably a 1- to 12-carbon aromatic group.

Of the thiadiazole- or oxadiazole-based group A photographic stabilizers usable in practicing the present invention, those having the following structure are preferable.

A-II

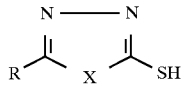

(wherein X is S, NH, or O, and R is, in addition to the same group as defined in (A–I) described above, mercapto, alkylthio, amino, or substituted amino. R is more preferably mercapto, alkylthio, or amino.)

Of the benzoxazole group A photographic stabilizers usable in practicing the present invention, those having the following structure are preferable.

A-III

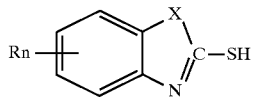

(wherein X is O, S, or Se, R is alkyl having four or less carbon atoms, e.g., methyl, ethyl, propyl, or butyl; alkoxy having four or less carbon atoms, e.g., methoxy, ethoxy, or butoxy; a halogen atom such as chlorine or bromine, cyano, amide, sulfamide, or carboxy, and n is an integer from 0 to 4. X is preferably O or S, and more preferably O.)

Specific compounds included in the present invention are enumerated below.

A-1

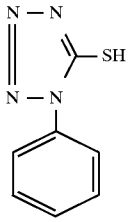

A-2

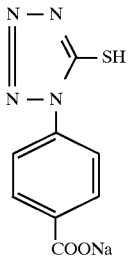

A-3

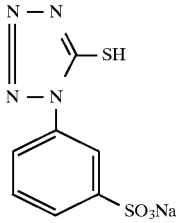

A-4

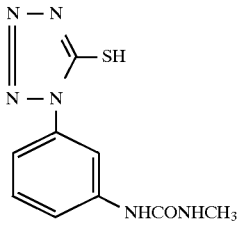

A-5

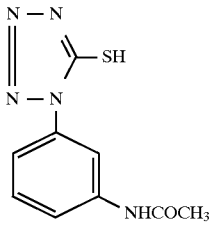

A-6

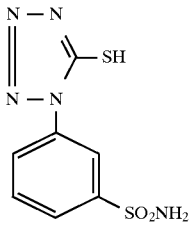

A-7

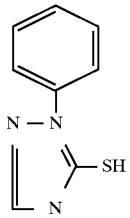

-continued

A-8

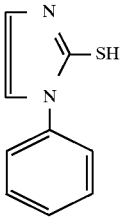

A-9

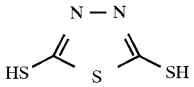

A-10

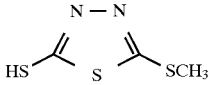

A-11

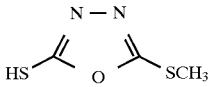

A-12

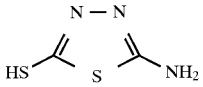

A-13

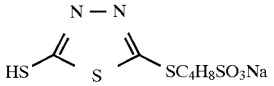

A-14

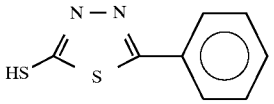

A-15

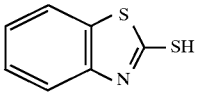

A-16

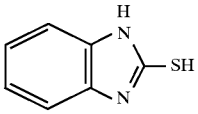

A-17

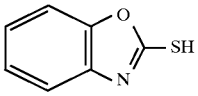

A-18

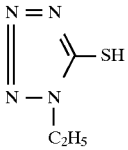

A-19

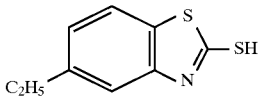

A-20

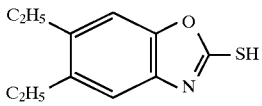

A-21

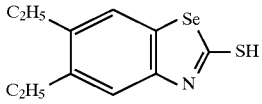

Phtographic stabilizers of group B are quaternary aromatic chalcogen azolium salts wherein the chalcogen is sulfur, selenium, or tellurium. Typical group B photographic stabilizers are azolium salts such as benzothiazolium salt, benzoselenazolium salt, and benzotellurazolium salt. Charge balancing counterions of these salts include various negatively charged ions. Examples are chloride, bromide, iodide, perchlorate, benzenesulfonate, propylsulfonate, toluenesulfonate, tetrafluoroborate, hexafluorophosphate, and methylsulfate. Usable proper group B photographic stabilizers are described in the following U.S. Patents. The items disclosed in these patents constitute the contents of this specification by reference. That is, examples are quaternary ammonium salts described in U.S. Pat. No. 2,694,716 by Allen et al., U.S. Pat. No. 2,131,038 by Brooker et al., U.S. Pat. No. 3,342,596 by Graham et al., U.S. Pat. No. 3,954,478 by Arai et al., and U.S. Pat. No. 4,661,438 by Przyklek-Elling.

Of the group B photographic stabilizers usable in practicing the present invention, those having the following structure are preferable.

(B)

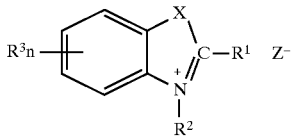

(wherein X is S, Se, or Te, $R^1$ is hydrogen or methyl when X is S, and $R^1$ is methyl when X is Se or Te, $R^2$ is 1- to 4-carbon alkyl or alkenyl such as methyl, ethyl, propyl, or propenyl; or 1- to 4-carbon substituted alkyl such as sulfopropyl or sulfamylmethyl, $R^3$ is 1- to 4-carbon alkyl such as methyl, propyl, or butyl; 1- to 4-carbon alkoxy such as ethoxy or propoxy; halogen (e.g., fluorine, chlorine, bromine, and iodine), cyano, amide, sulfamide, or carboxy; and n is an integer from 0 to 2. $R^3$'s can be the same or different when n is 2. Z is a counterion such as halogen (e.g., fluorine, chlorine, bromine, or iodine), benzenesulfonate, or tetrafluoroborate.)

Specific compounds of group B used in the present invention are enumerated below.

B-1

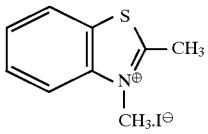

B-2

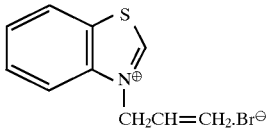

B-3

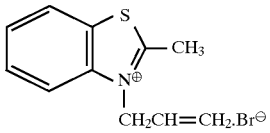

B-4

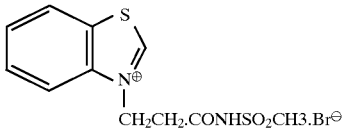

-continued

B-5

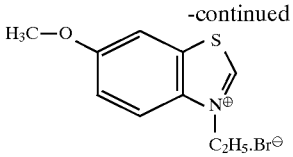

B-6

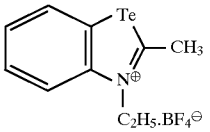

B-7

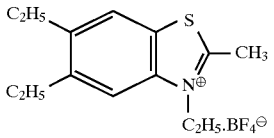

B-8

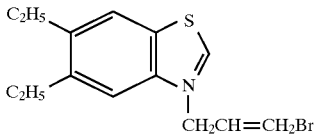

Photographic stabilizers of group C are triazoles or tetrazoles each having ionic (or dissociative) hydrogen bonded to a nitrogen atom in a heterocyclic system. This hydrogen atom can be ionized under the normal conditions of manufacture, storage, or processing of a high-chloride (100) tabular grain emulsion used in the present invention. A triazole or tetrazole ring can form a heterocyclic system by fusing to one or more aromatic rings (including heterocyclic rings) having 5 to 7 ring atoms. Examples of the heterocyclic system are benzotriazoles, naphthotriazoles, tetrazaindenes, and triazotetrazoles. A triazole or tetrazole ring can contain a substituent group containing 1- to 4-carbon alkyl such as methyl, ethyl, or propyl, or 6- to 10-carbon aryl such as phenyl or naphthyl. Other examples of the suitable substituent group in the heterocyclic system are hydroxy; halogen such as chlorine, bromine, and iodine; cyano; alkyl such as methy, ethyl, propyl, and trifluoromethyl; aryl such as phenyl, cyanophenyl, naphthyl, and pyridyl; aralkyl such as benzyl and phenethyl; alkoxy such as methoxy and ethoxy; aryloxy such as phenoxy; alkylthio such as methylthio and carboxymethylthio; acyl such as formyl, formamidino, acetyl, benzoyl, and benzenesulfonyl; and carboalkoxy such as carboethoxy, carbomethoxy, and carboxy.

Some useful group C photographic stabilizers usable in practicing the present invention can be represented by the following formula:

(C-I)

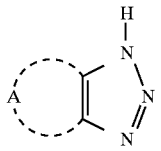

(C-II)

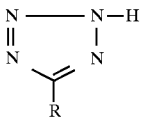

-continued (C-III)

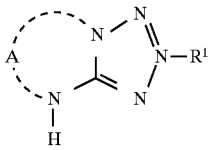

(C-IV)

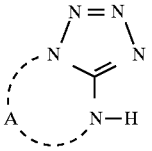

(wherein R is 1- to 4-carbon alkyl such as methyl, ethyl, propyl, or butyl; or 6- to 10-carbon aryl such as cyanophenyl or naphthyl; $R^1$ is, in addition to the same group as R, hydrogen; 1- to 8-carbon alkoxy such as methoxy, ethoxy, butoxy, or octyloxy; 1- to 8-carbon alkylthio such as methylthio, propylthio, pentylthio, or octylthio; or 6- to 10-carbon aryloxy or arylthio; and A is a non-metallic atom reguired to form a 5- to 7-membered aromatic ring, wherein the ring may be substituted by e.g., hydroxy; halogen such as chlorine, bromine, and iodine; cyano; alkyl such as methyl, ethyl, and propyl, trifluoromethyl; aryl such as phenyl, cyanophenyl, naphthyl, and pyridyl, and aralkyl such as benzyl and phenethyl; alkoxy such as methoxy and ethoxy; aryloxy such as phenoxy; alkylthio such as methylthio and carboxymethylthio, and acyl such as formyl, acetyl, and benzoyl; alkylsulfonyl or arylsulfonyl such as methanesulfonyl or benzenesulfonyl; carboxylalkoxy such as carboethoxy and carbomethoxy; or those which can be substituted by carboxy).

Practical compounds of group C included in the present invention are enumerated below.

C-1

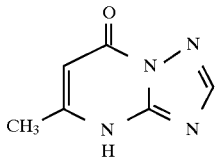

C-2

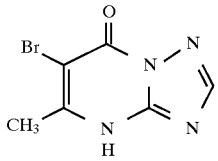

C-3

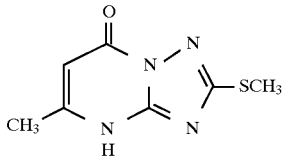

C-4

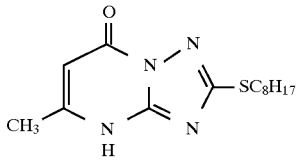

-continued

C-5

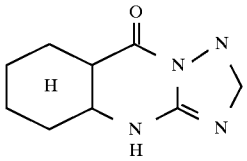

C-6

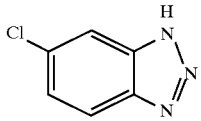

C-7

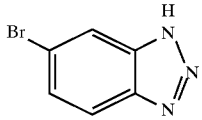

C-8

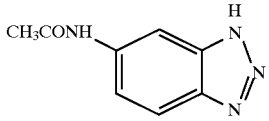

C-9

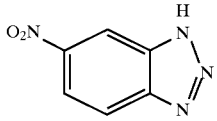

C-10

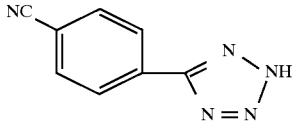

C-11

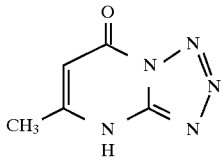

Photographic stabilizers of group D are dichalcogenide compounds each containing an —X—X-bond (wherein each X is divalent sulfur, selenium, or tellurium) between carbon atoms. Typical group D photographic stabilizers are organic disulfides, diselenides, and ditellurides in which chalcogen junctions to an aliphatic group or an aromatic group or is a portion of a cyclic system. Usable suitable group D photographic stabilizers are described in the following documents and U.S. Patents. The items disclosed in these documents and patents constitute the contents of this specification by reference. That is, examples are diselenides described in British Patent 1,336,570 by Brown et al. and British Patent 1,282,303 by Pollet et al., aromatic tellurochalcogenides described in U.S. Pat. No. 4,607,000 by Gunther et al. and U.S. Pat. No. 4,607,001 by Lok et al., cyclic oxaspiroditellurides described in U.S. Pat. No. 4,861,703 by Lok et al., 5-thiooctynoic acid described in U.S. Pat. No. 2,948,614, and acylamidophenylsulfides described in U.S. Pat. No. 3,397,986. Some useful group D photographic stabilizers usable in practicing the present invention can be represented by the following formula.

$$R—X—X—R^1 \quad (D)$$

(wherein X is divalent S, Se, or Te, R and $R^1$ can be the same or different and each represents 1- to 4-carbon alkyl, typically 1- to 4-carbon alkyl such as methyl, ethyl, propyl, or butyl; typically, 6- to 10-carbon aryl such as phenyl or naphthyl or a nitrogen-containing heterocyclic ring, and R and $R^1$ can bond to form a 5- to 7-membered ring together with two X's and a carbon atom). R and $R^1$ can also be substituted by halogen such as chlorine, carboxylalkyl such as acetamide or carboxybutyl, or alkoxy, typically 1- to 4-carbon alkoxy such as methoxy, propoxy, or butoxy.

Specific compounds of group D included in the present invention are enumerated below.

D-1

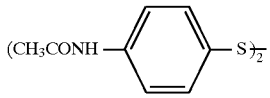

D-2

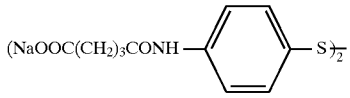

D-3

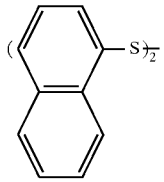

D-4

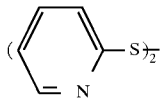

D-5

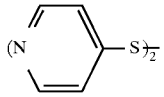

D-6

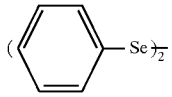

D-7

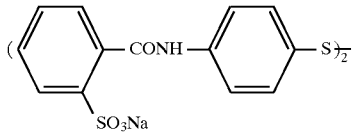

D-8

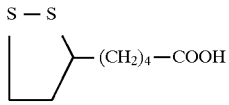

D-9

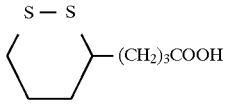

D-10

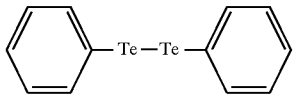

Photographic stabilizers of group E are organic compounds containing a thiosulfonic acid or a salt thereof having a structure represented by —$SO_2SM$ (wherein M is a proton or a cation). The cation represented by M is preferably a cation of an alkali metal such as potassium). Typical group E photographic stabilizers are alkylthiosulfonates and arylthiosulfonates. Usable suitable group E photographic stabilizers can be represented by general formulas (E-1), (E-2), and (E-3) below.

$$Z—SO_2\,S—M \quad \text{General formula (E-1)}$$

General formula (E-2)

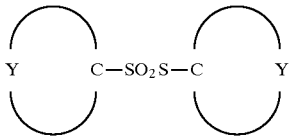

General formula (E-3)

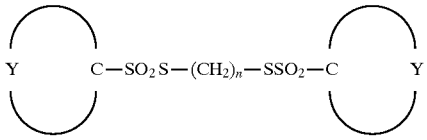

In general formulas (E-1), (E-2), and (E-3), each of Z and Y represents an alkyl group, an aryl group, or a heterocyclic group, and these groups can be substituted.

Examples of the substituent group are a lower alkyl group such as a methyl group and an ethyl group, an aryl group such as a phenyl group, a 1- to 8-carbon alkoxyl group, a halogen atom such as chlorine, a nitro group, an amino group, and a carboxyl group.

The number of carbon atoms of an alkyl group represented by Z is 1 to 18, and the number of carbon atoms of an aryl group represented by Z and Y is 6 to 18.

Examples of a heterocyclic ring represented by Z and Y are thiazole, benzthiazole, imidazole, benzimidazole, and oxazole rings.

A metal cation represented by M is preferably an alkali metal cation such as sodium ion or potassium ion. An organic cation represented by M is preferably ammonium ion or guanidinium ion.

n represents an integer from 2 to 10.

Specific examples of a compound represented by general formula (E-1), (E-2), or (E-3) are as follows.

a

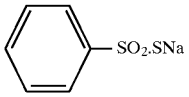

b

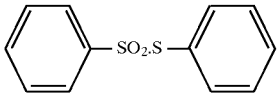

c

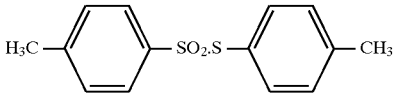

d

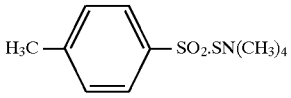

e $H_3C.SO_2.SNa$ f

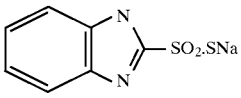

g

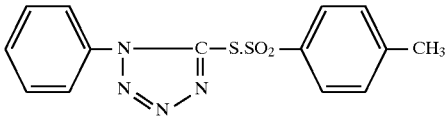

-continued h

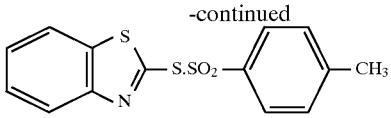

i

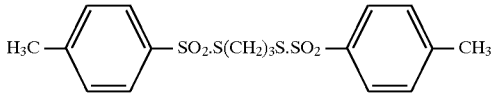

j

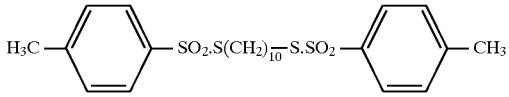

L-cystine-disulfoxide k

Some useful group E photographic stabilizers usable in practicing the present invention can be represented by the following formula:

(E)

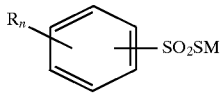

(wherein R is 1- to 10-carbon alkyl such as methyl, ethyl, or propyl; aryl such as phenyl; 1- to 10-carbon alkoxy such as methoxy, ethoxy, propoxy, or pentoxy; halogen such as chlorine; nitro; amino; or carboxy, M is a proton or an alkali metal cation, typically a cation of an alkali metal such as sodium or potassium or an organic cation, typically ammonium or guanidinium, and n is an integer from 0 to 4. If n is 2 or more, a plurality of R's can be the same or different).

Practical compounds of group E included in the present invention are enumerated below.

E-1

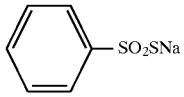

E-2

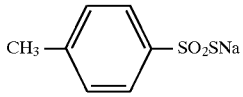

E-3

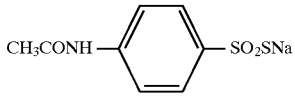

$C_2H_5SO_2SNa$ E-4

$C_8H_{17}SO_2SNa$ E-5

E-6

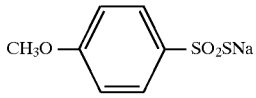

E-7

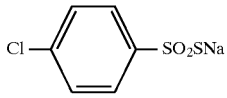

E-8

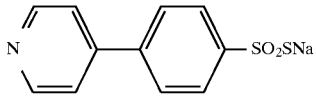

The photographic stabilizers of groups A to E can be combined in each individual group or across the groups. Of these photographic stabilizers A to E, A and E are preferable, and E is more preferable.

Photographic stabilizers used to practice the present invention can be conveniently incorporated into a high-chloride (100) tabular grain emulsion or a photographic constituting element layer structure containing such emulsion immediately before the emulsion is coated in the element. However, these photographic stabilizers can also be added to an emulsion during the manufacture of the emulsion, e.g., during chemical sensitization or spectral sensitization. Generally, it is most convenient to introduce these photographic stabilizers after chemical ripening and before coating of an emulsion. The photographic stabilizers can be directly added to an emulsion or added to a position in a photographic constituting element layer structure at which an emulsion to be stabilized can soak. For example, the photographic stabilizers can be incorporated into a hydrophilic colloid layer such as an overcoat, an interlayer, or an undercoat layer immediately before coating. The photographic stabilizers can be used at a density of a photographic stabilizer effective to protect an emulsion from a development fog and a change in the sensitivity. Usually, a maximum density of a photographic stabilizer in practical uses can be experimentally calculated by changing the density by a method well known to those skilled in the art. This investigation is typically performed to check an effective density for a specific condition. The effective density to be used of course changes over a broad range in accordance with an emulsion to be selected, the intended use of the emulsion, the storage conditions, and a photographic stabilizer to be selected. It turns out that in a radiation-sensitive silver halide emulsion, a density of approximately 0.005 mmol per mol of silver is effective in a specific condition. More typically, a minimum effective amount of a photographic stabilizer is 0.03 mmol per mol of silver, generally 0.3 mmol per mol of silver. The effective density of many of the photographic stabilizers used in the present invention is about 0.06 to 0.8 mmol per mol of silver, and is often about 0.2 to 0.5 mmol per mol of silver. As described in the examples to be described later, however, these photographic stabilizers can also be used at densities well out of these ranges.

A negative emulsion coating which can contain the photographic stabilizers of groups A to E can be protected from being unstable by further adding other photographic stabilizers, antifoggants, kink inhibitors, latent image stabilizers, and similar additives to emulsion layers and the adjacent layers before coating. Most of these antifoggants thus effectively used in emulsions can be used in developing agents and can be classified into a few general titles such as described in C. E. K. Mees, "The Theory of The Photographic Process", the 2nd ed., Macmillan, 1954, pp. 677–680.

Examples of dye-forming couplers preferably used in the present invention are compounds having structures presented in formulas (1) to (12) below. Of these compounds, two-equivalent couplers are preferable. These compounds are generally termed active methylene, pyrazolone, pyrazoloazole, phenol, naphthol, and pyrrolotriazole and are well known to those skilled in the art.

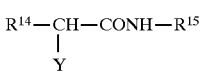
(1)

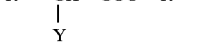
(2)

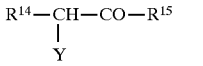
(3)

-continued

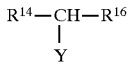
(4)

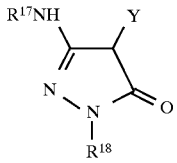
(5)

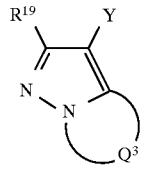
(6)

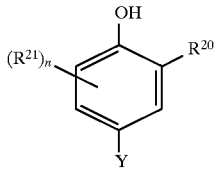
(7)

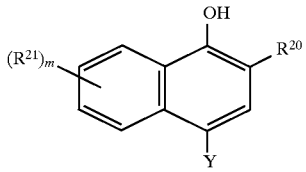
(8)

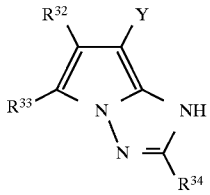
(9)

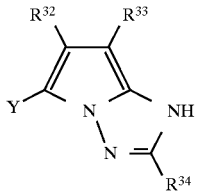
(10)

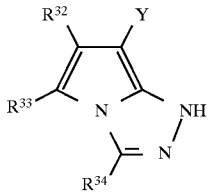
(11)

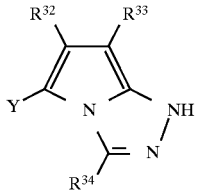
(12)

Formulas (1) to (4) represent couplers called active methylene-based couplers. In formulas (1) to (4), $R^{14}$ is an acyl group, a cyano group, a nitro group, an aryl group (preferably 6- to 50-carbon aryl), a heterocyclic residual group (preferably a 1- to 50-carbon heterocyclic residual group), an alkoxycarbonyl group (preferably 2- to 50-carbon alkoxycarbonyl), an aryloxycarbonyl group (preferably 7- to 50-carbon aryloxycarbonyl), a carbamoyl group (preferably 1- to 50-carbon carbamoyl), a sulfamoyl group (preferably 0- to 50-carbon sulfamoyl), an alkylsulfonyl group (preferably 1- to 50-carbon alkylsulfonyl), or an arylsulfonyl group (preferably 6- to 50-arylsulfonyl), each of which can have a substituent group.

In formulas (1) to (3), $R^{15}$ is an alkyl group, an aryl group (preferably 6- to 50-carbon aryl), or a heterocyclic residual group (preferably a 1- to 50-carbon heterocyclic residual group), each of which can have a substituent group. In formula (4), $R^{16}$ is an aryl group (preferably 6- to 50-carbon aryl) or a heterocyclic residual group (preferably a 1- to 50-carbon heterocyclic residual group), each of which can have a substituent group. Examples of the substituent groups which $R^{14}$, $R^{15}$, and $R^{16}$ can have are the same as those enumerated as the examples of $X^1$ to $X^5$ in formula (I) described above.

In formulas (1) to (4), Y is a hydrogen atom or a group which can split off by causing a coupling reaction with the oxidation product of a reducing agent for color formation. Examples of Y are a heterocyclic group (a saturated or unsaturated 5- to 7- membered monocyclic or condensed ring containing at least one nitrogen, oxygen, or sulfur atom as a hetero atom; e.g., succinimide, maleinimide, phthalimide, diglycolimide, pyrrole, pyrazole, imidazole, 1,2,4-triazole, tetrazole, indole, benzopyrazole, benzimidazole, benztriazole, imidazoline-2,4-dione, oxazolidine-2,4-dione, thiazolidine-2,4-dione, imidazolidine-2-one, oxazoline-2-one, thiazoline-2-one, benzimidazoline-2-one, benzoxazoline-2-one, benzothiazoline-2-one, 2-pyrroline-5-one, 2-imidazoline-5-one, indoline-2,3-dione, 2,6-dioxypurine, parabanic acid, 1,2,4-triazolidine-3,5-dione, 2-pyridone, 4-pyridone, 2-pyrimidone, 6-pyridazone, 2-pyrazone, 2-amino-1,3,4-thiazolidine, and 2-imino-1,3,4-thiazolidine-4-one), a halogen atom (e.g., a chlorine atom and a bromine atom), an aryloxy group (e.g., phenoxy and 1-naphthoxy), a heterocyclic oxy group (e.g., pyridyloxy and pyrazolyloxy), an acyloxy group (e.g., acetoxy and benzoyloxy), an alkoxy group (e.g., methoxy and dodecyloxy), a carbamoyloxy group (e.g., N,N-diethylcarbamoyloxy and morpholinocarbonyloxy), an aryloxycarbonyloxy group (e.g., phenoxycarbonyloxy), an alkoxycarbonyloxy group (e.g., methoxycarbonyloxy and ethoxycarbonyloxy), an arylthio group (e.g., phenylthio and naphthylthio), a heterocyclic thio group (e.g., tetrazolylthio, 1,3,4-thiadiazolylthio, 1,3,4-oxadiazolylthio, and benzimidazolylthio), an alkylthio group (e.g., methylthio, octylthio, and hexadecylthio), an alkylsulfonyloxy group (e.g., methanesulfonyloxy), an arylsulfonyloxy group (e.g., benzenesulfonyloxy and toluenesulfonyloxy), a carbonamide group (e.g., acetamide and trifluoroacetamide), a sulfonamide group (e.g., methanesulfonamide and benzenesulfonamide), an alkylsulfonyl group (e.g., methanesulfonyl), an arylsulfonyl group (e.g., benzenesulfonyl), an alkylsulfinyl group (e.g., methanesulfinyl), an arylsulfinyl group (e.g., benzenesulfinyl), an arylazo group (e.g., phenylazo and naphthylazo), and a carbamoylamino group (e.g., N-methylcarbamoylamino).

Y can also be substituted by a substituent group, and examples of the substituent group for substituting Y are the same as those enumerated as $X^1$ to $X^5$ in formula (I).

Y is preferably a halogen atom, an aryloxy group, a heterocyclic oxy group, an acyloxy group, an aryloxycarbonyloxy group, an alkoxycarbonyloxy group, or a carbamoyloxy group.

In formulas (1) to (4), $R^{14}$ and $R^{15}$ or $R^{14}$ and $R^{16}$ can bond together to form a ring.

Formula (5) represents a coupler called a 5-pyrazolone-based coupler. In formula (5), $R^{17}$ represents an alkyl group, an aryl group, an acyl group, or a carbamoyl group. $R^{18}$ represents a phenyl group or a phenyl group which is substituted by one or more halogen atoms, alkyl groups, cyano groups, alkoxy groups, alkoxycarbonyl groups, or acylamino groups.

Of 5-pyrazolone-based couplers represented by formula (5), couplers in which $R^{17}$ is an aryl group or an acyl group and $R^{18}$ is a phenyl group substituted by one or more halogen atoms are preferable.

Details of these preferable groups will be described below. $R^{17}$ is an aryl group or an acetyl group such as a phenyl group, a 2-chlorophenyl group, a 2-methoxyphenyl group, a 2-chloro-5-tetradecaneamidophenyl group, a 2-chloro-5-(octadecenyl-1-succinimido)phenyl group, a 2-chloro-5-octadecylsulfonamidophenyl group, or a 2-chloro-5-[2-(4-hydroxy-3-t-butylphenoxy)tetradecaneamido]phenyl group, or an acyl group such as a 2-(2,4-di-t-pentylphenoxy)butanoyl group, a benzoyl group, or a 3-(2,4-di-t-amylphenoxyacetamido)benzoyl group. These groups can further have substituent groups such as organic substituent groups which couple via a carbon atom, an oxygen atom, a nitrogen atom, or a sulfur atom, or halogen atoms. Y has the same meaning as Y in formulas (1) to (4) described above.

$R^{18}$ is preferably a substituted phenyl group such as a 2,4,6-trichlorophenyl group, a 2,5-dichlorophenyl group, or a 2-chlorophenyl group.

Formula (6) represents a coupler called a pyrazoloazole-based coupler. In formula (6), $R^{19}$ represents a hydrogen atom or a substituent group. $Q^3$ represents non-metallic atoms required to form a 5-membered azole ring containing two to four nitrogen atoms. This azole ring can have a substituent group (including a condensed ring).

Of pyrazoloazole-based couplers represented by formula (6), imidazo[1,2-b]pyrazoles described in U.S. Pat. No. 4,500,630, pyrazolo[1,5-b]-1,2,4-triazoles described in U.S. Pat. No. 4,500,654, and pyrazolo[5,1-c]-1,2,4-triazoles described in U.S. Pat. No. 3,725,067 are preferable in respect of the spectral absorption characteristics of a color dye.

Details of the substituent groups of azole rings represented by the substituent groups $R^{19}$ and $Q^3$ are described in, e.g., U.S. Pat. No. 4,540,654, column 2, line 41 to column 8, line 27. Preferable examples are a pyrazoloazole coupler described in JP-A 61-65245 in which a branched alkyl group directly bonds to the 2-, 3-, or 6-position of a pyrazolotriazole group, a pyrazoloazole coupler described in JP-A 61-65245 in which a sulfonamide group is contained in a molecule, a pyrazoloazole coupler described in JP-A 61-147254 which has an alkoxyphenylsulfonamide ballast group, a pyrazolotriazole coupler described in JP-A 62-209457 or 63-307453 which has an alkoxy group or an aryloxy group in the 6-position, and a pyrazolotriazole coupler described in JP-A 2-201443 which has a carbonamide group in a molecule. Y represents the same meaning as Y in formulas (1) to (4) described above.

Formulas (7) and (8) are couplers called a phenol-based coupler and a naphthol-based coupler, respectively. In formulas (7) and (8), $R^{20}$ represents a hydrogen atom or a group selected from $—CONR^{22}R^{23}$, $—SO_2NR^{22}R^{23}$, $—NHCOR^{22}$, $—NHCONR^{22}R^{23}$, and $—NHSO_2NR^{22}R^{23}$. Each of $R^{22}$ and $R^{23}$ represents a hydrogen atom or a substituent group. In formulas (7) and (8), $R^{21}$ represents a substituent group, n represents an integer selected from 0 to 2, and m represents an integer selected from 0 to 4. If n and m are 2 or more, $R^{21}$'s can be the same or different. Examples of substituent groups represented by $R^{21}$ to $R^{23}$ are the same as those enumerated as the examples of $X^1$ to $X^5$ in formula (I) described above. Y represents the same meaning as Y in formulas (1) to (4) described above.

Preferable examples of a phenol-based coupler represented by formula (7) are 2-acylamino-5-alkylphenol-based couplers described in U.S. Pat. Nos. 2,369,929, 2,801,171, 2,772,162, 2,895,826, and 3,772,002, 2,5-diacylaminophenol-based couplers described in U.S. Pat. Nos. 2,772,162, 3,758,308, 4,126,396, 4,334,011, and 4,327,173, West German Patent Publication No. 3,329,729, and JP-A 59-166956, and 2-phenylureido-5-acylaminophenol-based couplers described in U.S. Pat. Nos. 3,446,622, 4,333,999, 4,451,559, and 4,427,767. Y is the same as described in formulas (1) to (4) described above.

Preferable examples of a naphthol coupler represented by formula (8) are 2-carbamoyl-1-naphthol-based couplers described in U.S. Pat. Nos. 2,474,293, 4,052,212, 4,146,396, 4,282,233, and 4,296,200, and 2-carbamoyl-5-amido-1-naphthol-based couplers described in U.S. Pat. No. 4,690,889. Y is the same as described in formulas (1) to (4) described above.

Formulas (9) to (12) represent couplers called pyrrolotriazole. Each of $R^{32}$, $R^{33}$, and $R^{34}$ represents a hydrogen atom or a substituent group. Y has the same meaning as described in formulas (1) to (4) described above. Examples of substituent groups represented by $R^{32}$, $R^{33}$, and $R^{34}$ are those enumerated as the examples of $X^1$ to $X^5$ in formula (I) described above. Preferable examples of pyrrolotriazole-based couplers represented by formulas (9) to (12) are couplers described in EP 488,248A1, EP 491,197A1, and EP 545,300 in which at least one of $R^{32}$ and $R^{33}$ is an electron attracting group. Y is the same as described in formulas (1) to (4) described above.

In addition to these couplers, it is possible to use couplers having structures such as condensed-ring phenol, imidazole, pyrrole, 3-hydroxypyridine, active methylene, active methine, a 5,5-condensed heterocyclic ring, and a 5,6-condensed heterocyclic ring.

As the condensed-ring phenol-based coupler, couplers described in U.S. Pat. Nos. 4,327,173, 4,564,586, and 4,904,575 can be used.

As the imidazole-based coupler, couplers described in U.S. Pat. Nos. 4,818,672 and 5,051,347 can be used.

As the 3-hydroxypyridine-based coupler, couplers described in JP-A 1-315736 can be used.

As the active methylene- and active methine-based couplers, couplers described in U.S. Pat. Nos. 5,104,783 and 5,162,196 can be used.

As the 5,5-condensed heterocyclic coupler, it is possible to use pyrrolopyrazole-based couplers described in U.S. Pat. No. 5,164,289 and pyrroloimidazole-based couplers described in JP-A 4-174429.

As the 5,6-condensed heterocyclic coupler, it is possible to use pyrazolopyrimidine-based couplers described in U.S. Pat. No. 4,950,585, pyrrolotriazine-based couplers described in JP-A 4-204730, and couplers described in EP 556,700.

In addition to the above couplers, in the present invention it is possible to use couplers described in West German Patents 3,819,051A and 3,823,049, U.S. Pat. Nos. 4,840,883, 5,024,930, 5,051,347, and 4,481,268, EP 304,856A2, EP 329,036, EP 354,549A2, EP 374,781A2, EP 379,110A2, EP 386,930A1, and JP-A 63-141055, 64-32260, 64-32261, 2-297547, 2-44340, 2-110555, 3-7938, 3-160440, 3-172839, 4-172447, 4-179949, 4-182645, 4-184437, 4-188138, 4-188139, 4-194847, 4-204532, 4-204731, and 4-204732.

Specific examples of the couplers usable in the present invention are presented below. However, the present invention is, of course, not limited to these examples.

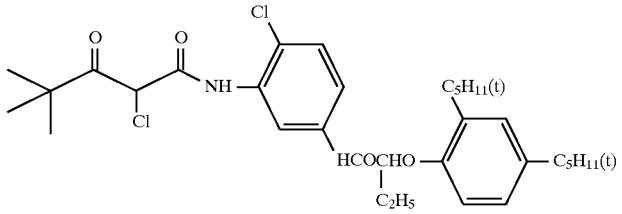

(C-1)

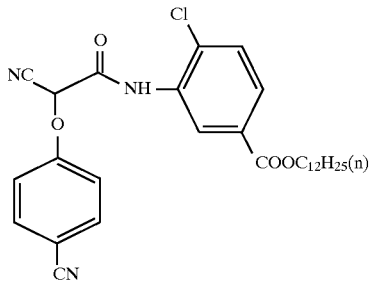

(C-2)

-continued
(C-3)
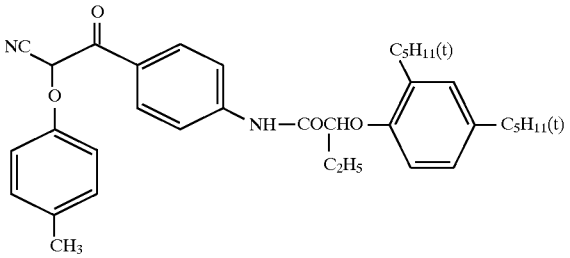
(C-4)
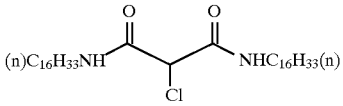
(C-5)
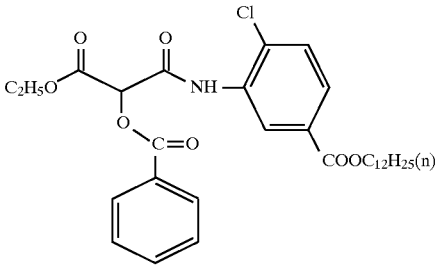
(C-6)
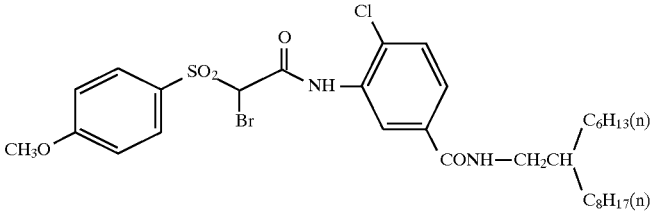
(C-7)
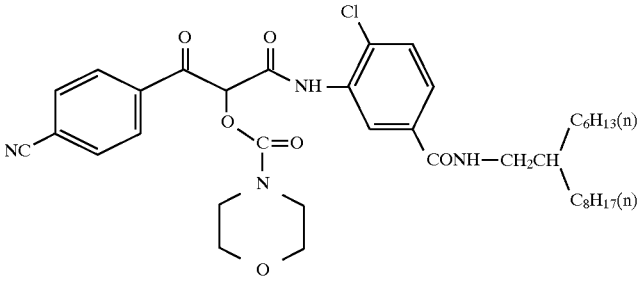
(C-8)
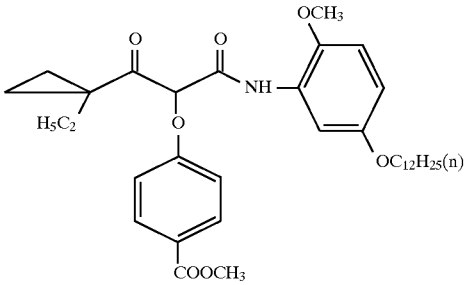
(C-9)
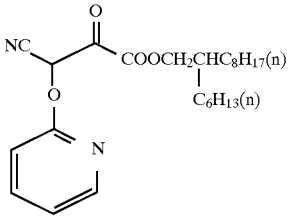

-continued
(C-10)
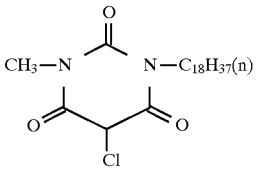
(C-11)
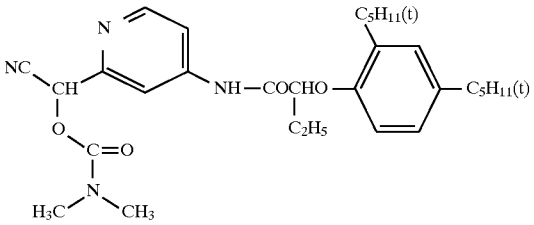
(C-12)
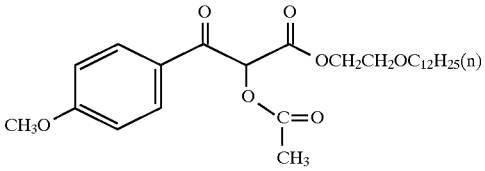
(C-13)
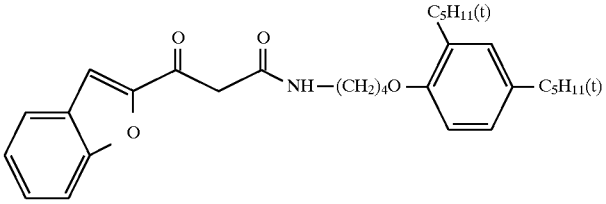
(C-14)
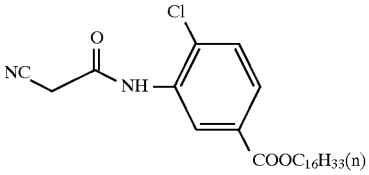
(C-15)
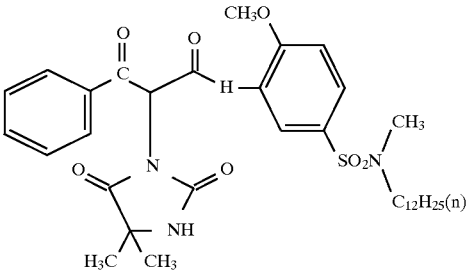
(C-16)
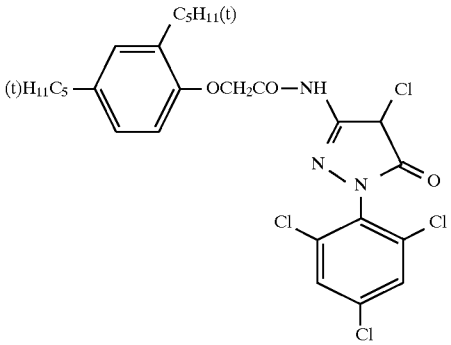

-continued
(C-17)
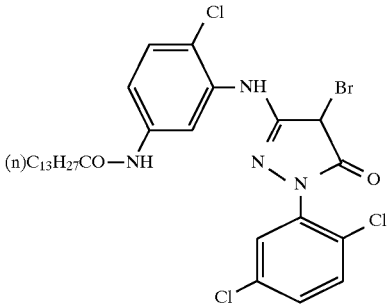
(C-18)
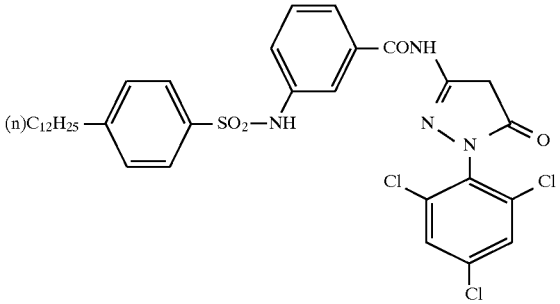
(C-19)
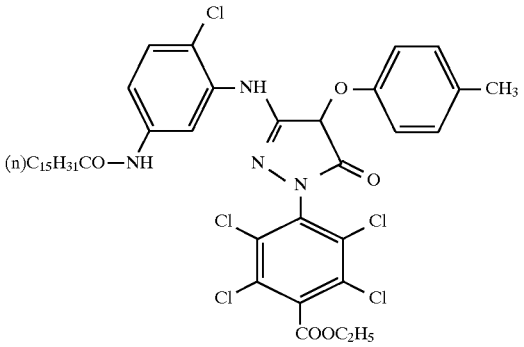
(C-20)
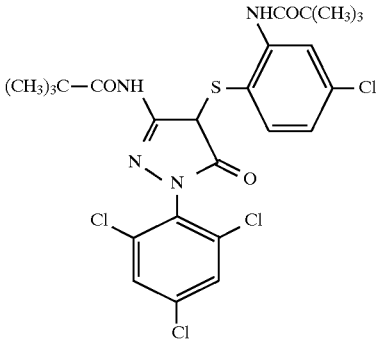
(C-21)
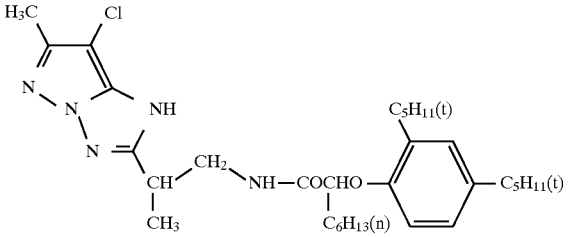

-continued
(C-22)
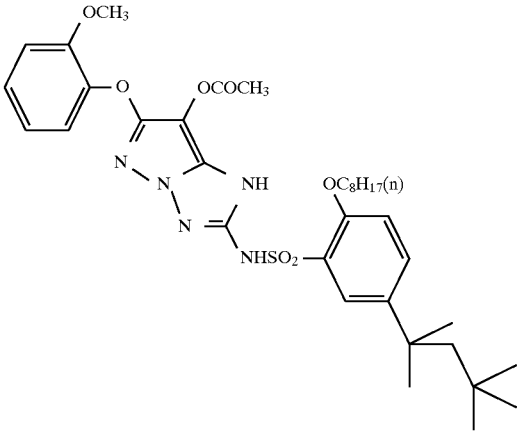
(C-23)
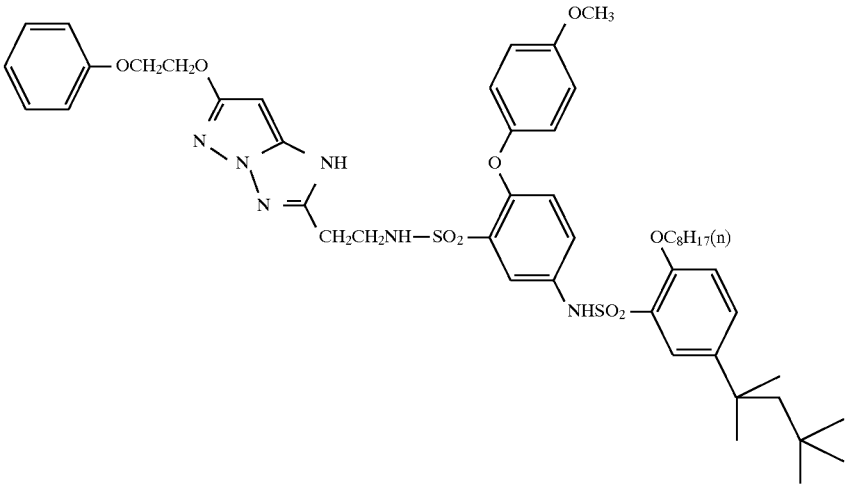
(C-24)
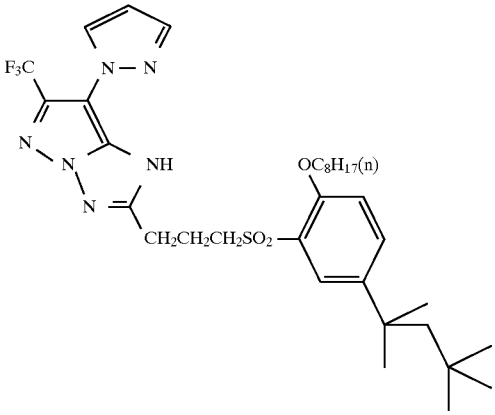

-continued
(C-25)
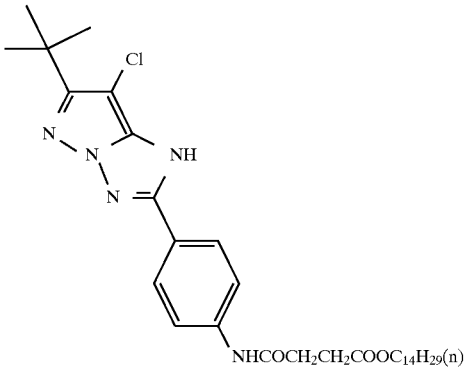
(C-26)
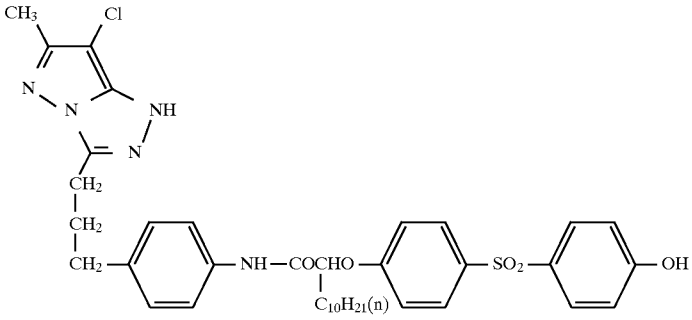
(C-27)
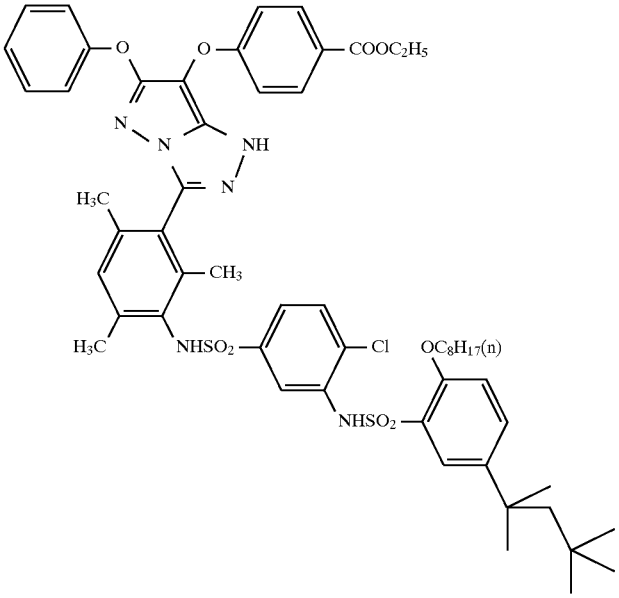
(C-28)
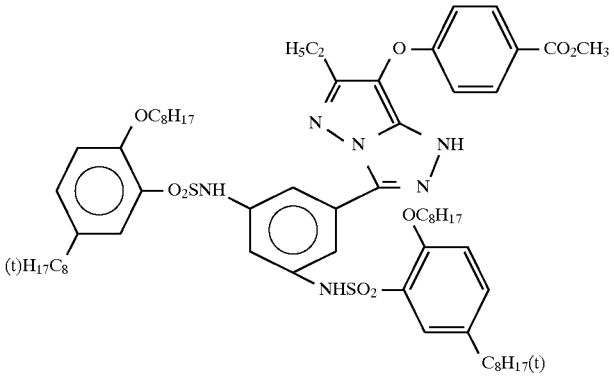

-continued
(C-29)
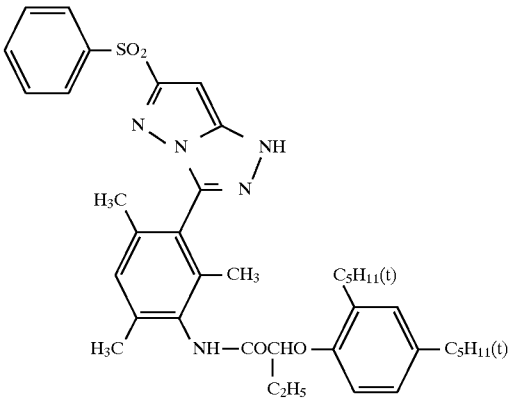
(C-30)
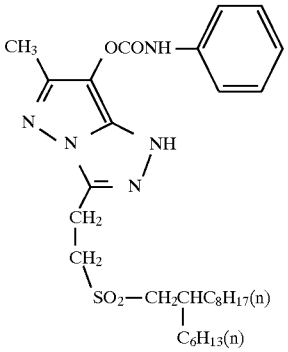
(C-31)
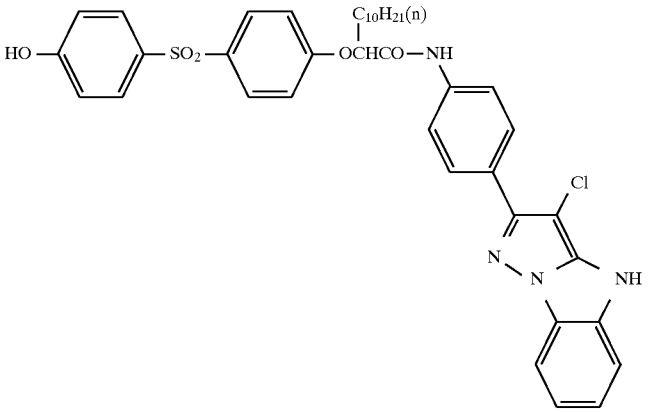
(C-32)
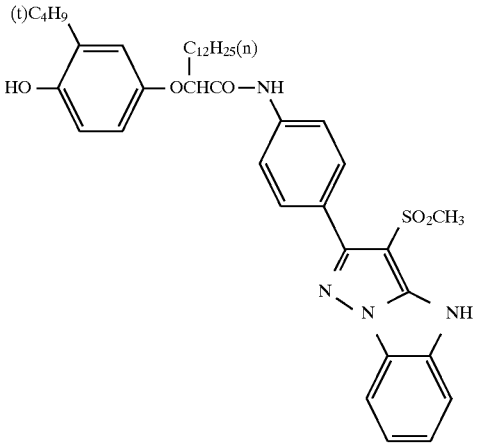

-continued
(C-33)
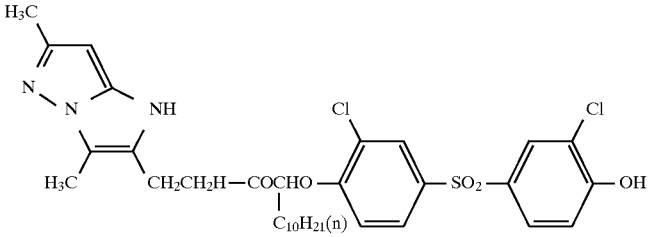
(C-34)
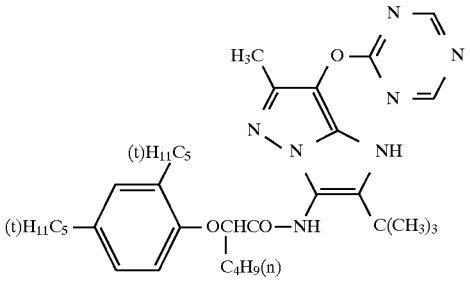
(C-35)
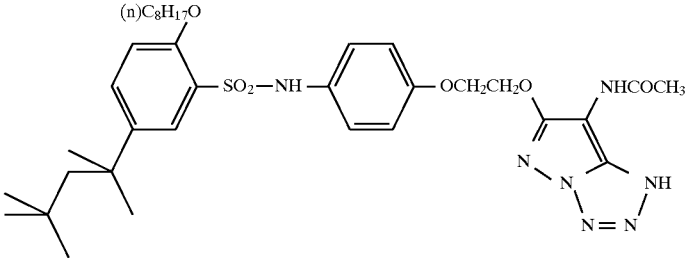
(C-36)
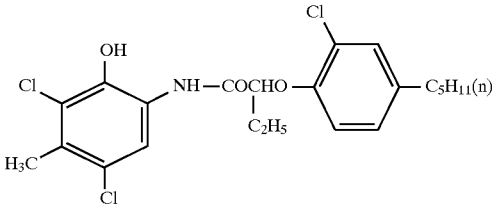
(C-37)
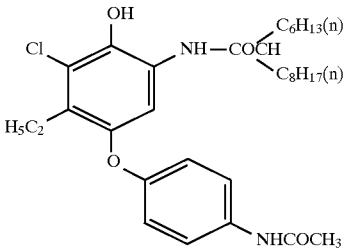
(C-38)
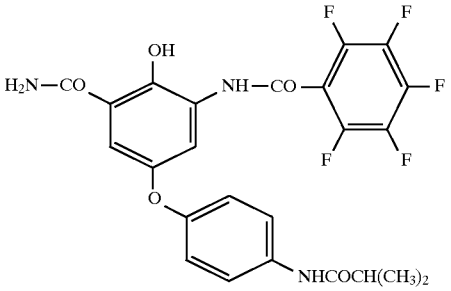

-continued
(C-39)
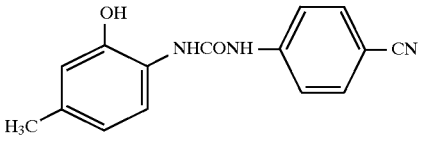
(C-40)
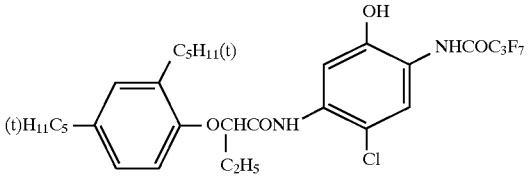
(C-41)
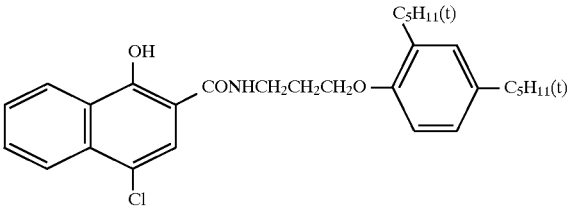
(C-42)
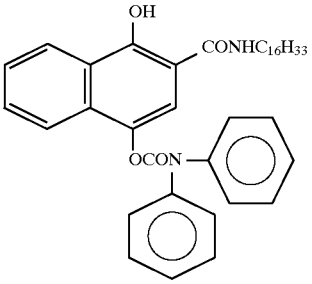
(C-43)
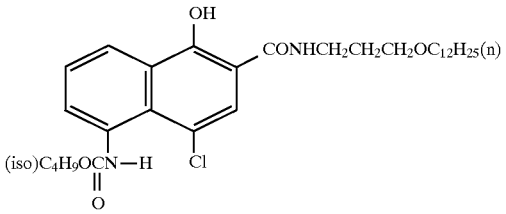
(C-44)
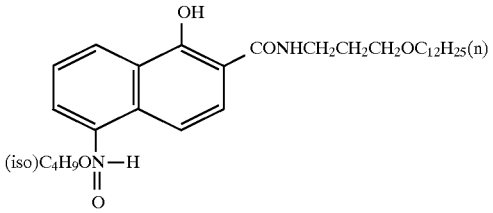
(C-45)
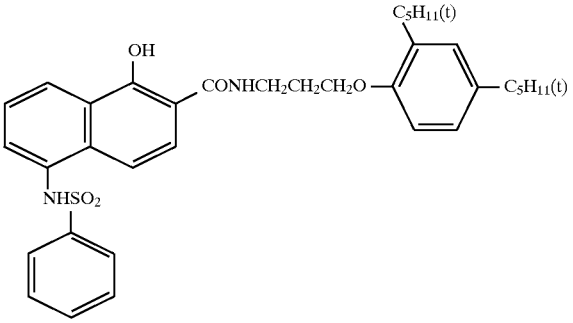

-continued
(C-46)
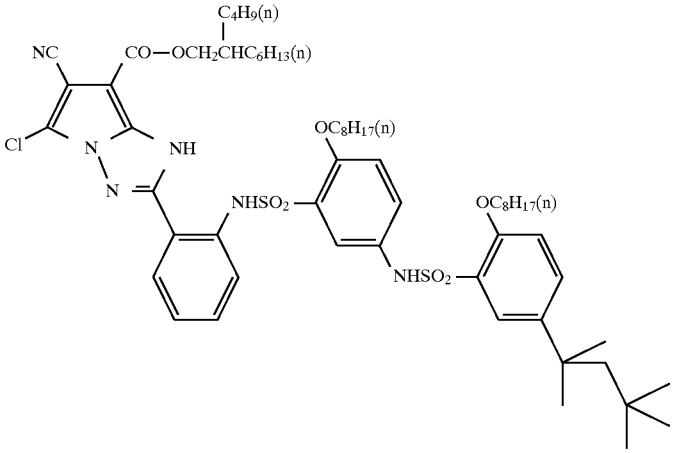
(C-47)
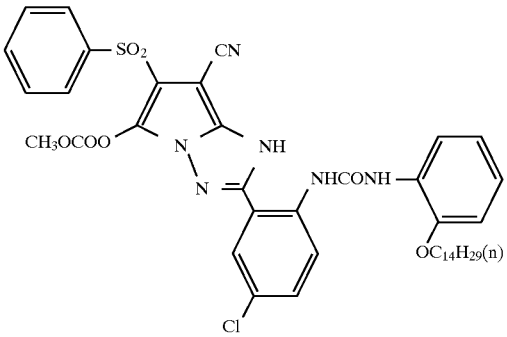
(C-48)
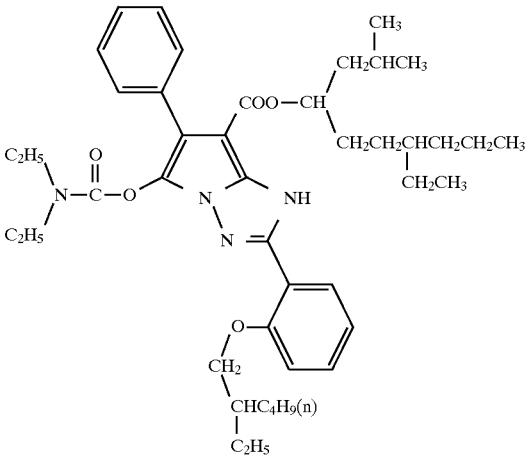
(C-49)
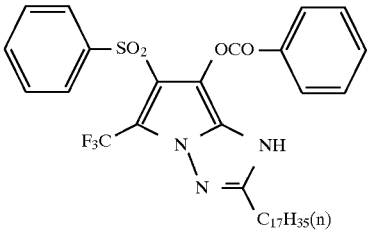

-continued
(C-50)
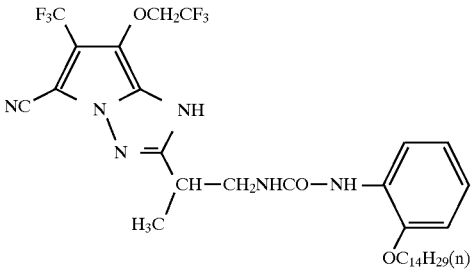
(C-51)
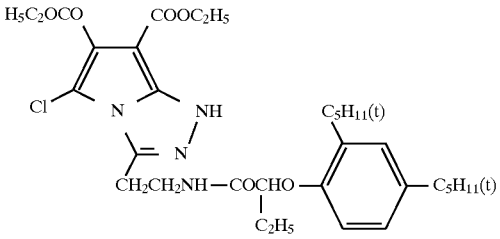
(C-52)
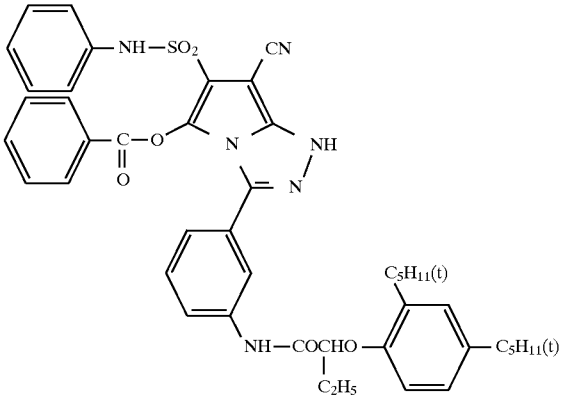
(C-53)
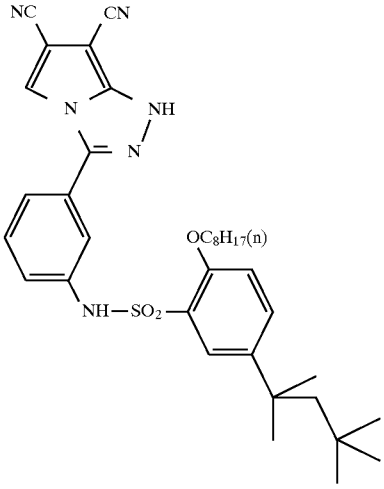

-continued
(C-54)
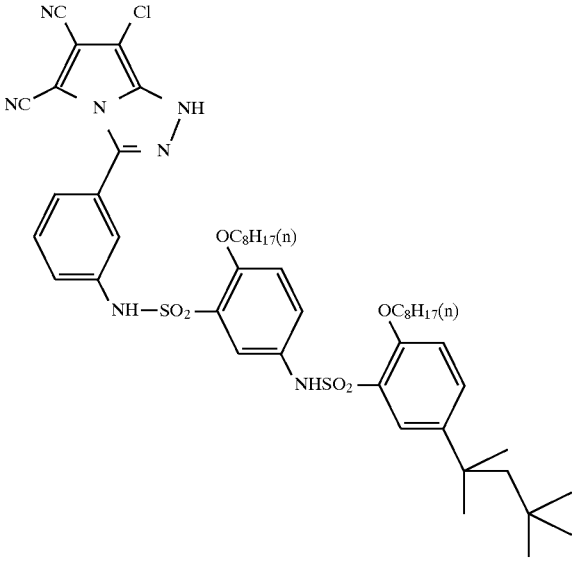
(C-55)
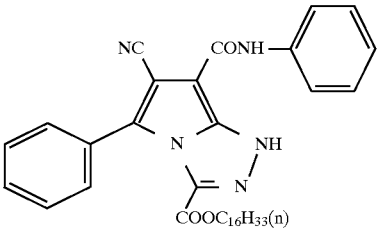
(C-56)
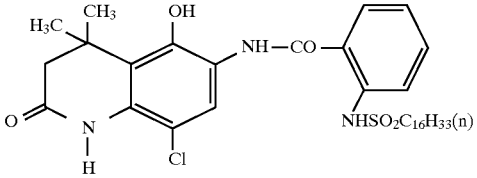
(C-57)
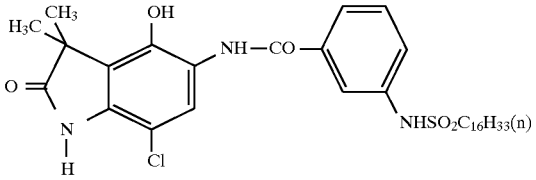
(C-58)
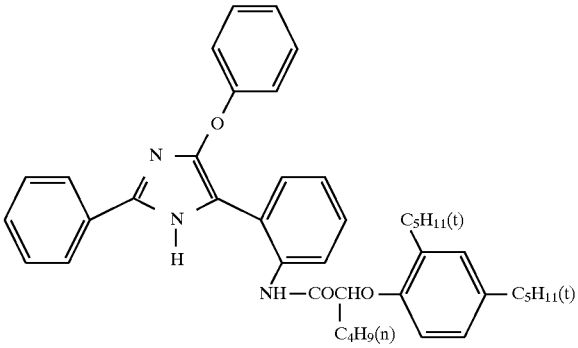

-continued
(C-59)
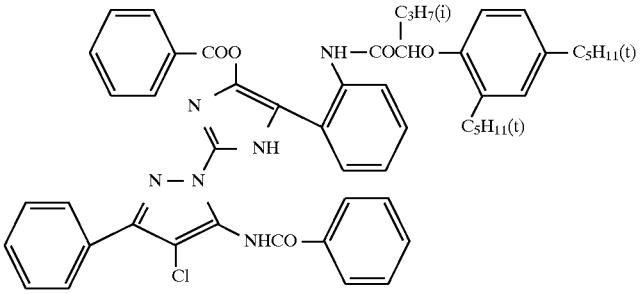
(C-60)
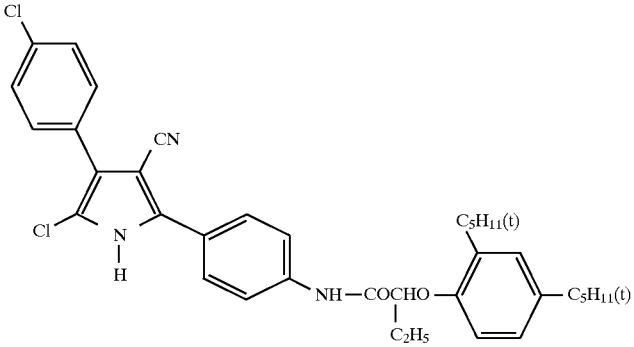
(C-61)
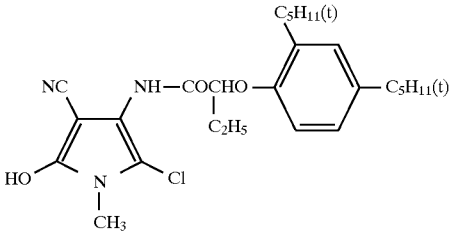
(C-62)
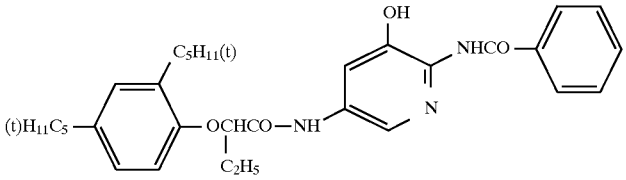
(C-63)
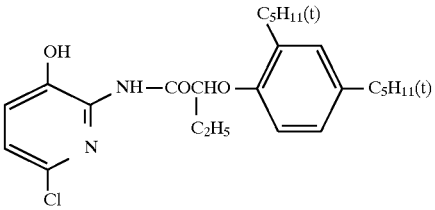
(C-64)
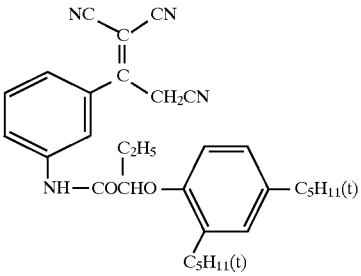

-continued
(C-65)
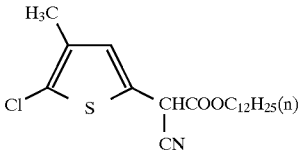
(C-66)
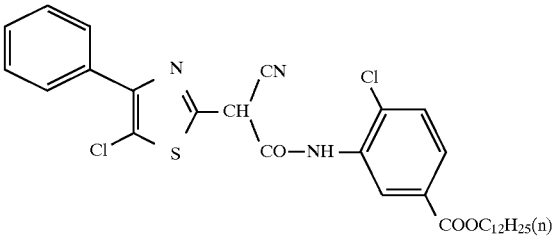
(C-67)
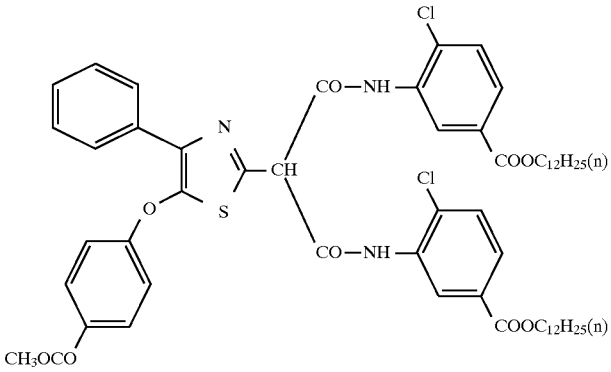
(C-68)
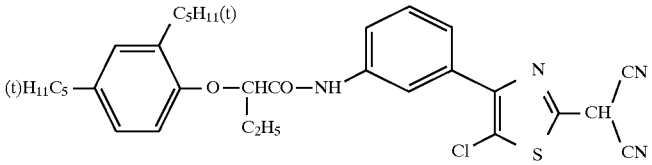
(C-69)
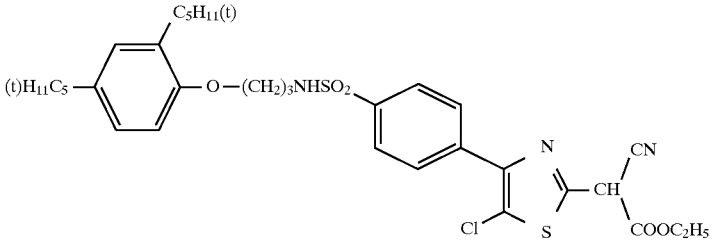
(C-70)
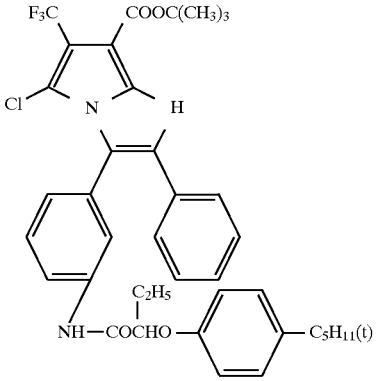

-continued
(C-71)
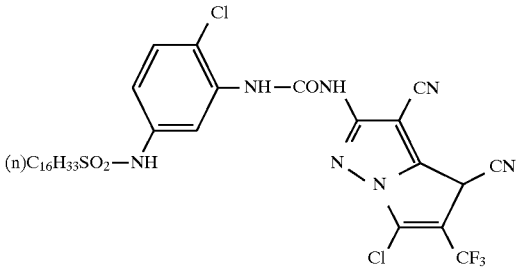
(C-72)
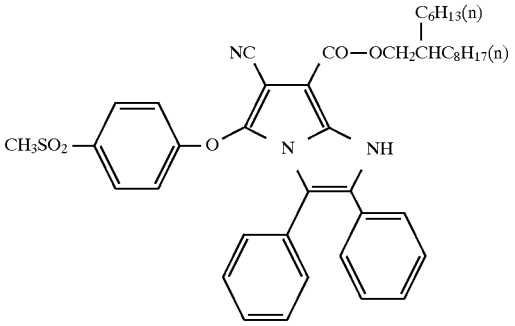
(C-73)
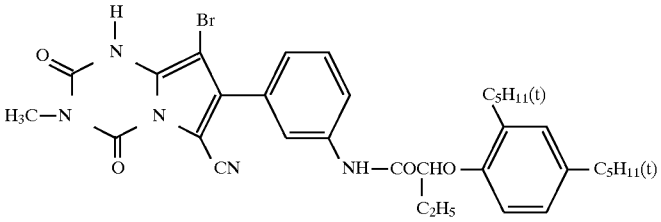
(C-74)
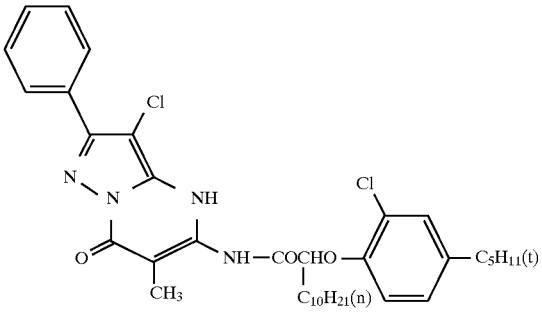
(C-75)
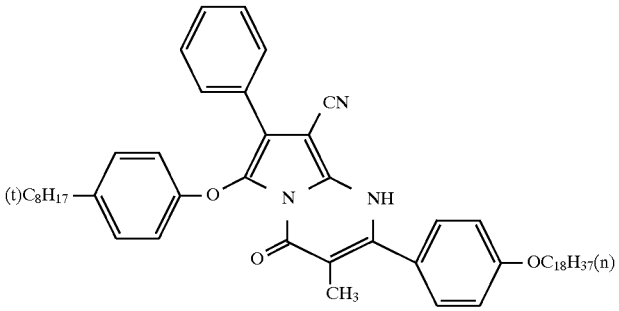
(C-76)
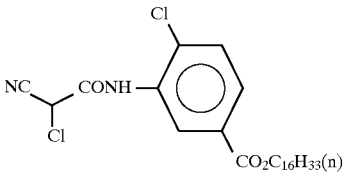

-continued (C-77)

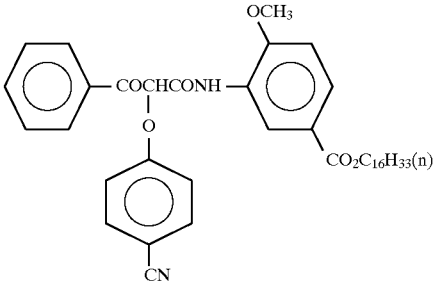

(C-78)

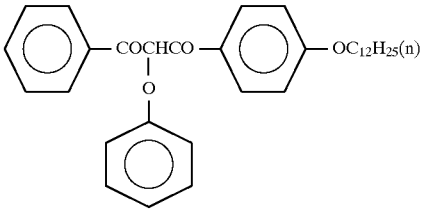

(C-79)

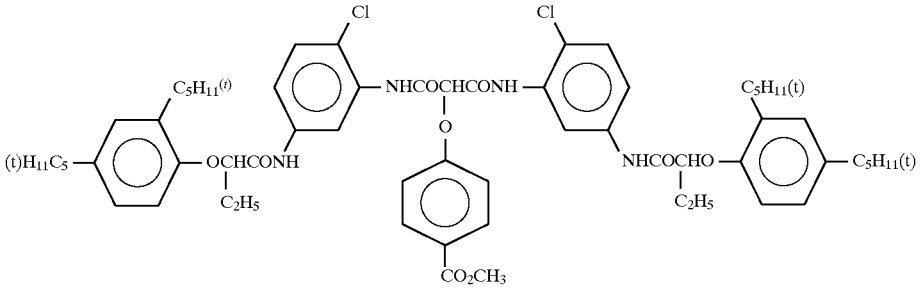

(C-80)

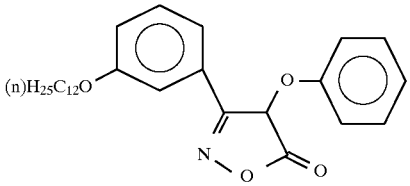

To obtain a sufficient color density, the use amount of the reducing agent for color formation used in the present invention per dye-forming layer in which the reducing agent for color formation is added is preferably 0.01 to 10 mmol/$m^2$, more preferably 0.05 to 5 mmol/$m^2$, and most preferably 0.1 to 1 mmol/$m^2$.

The use amount of couplers in a color-generating layer in which the reducing agent for color formation of the present invention is used is, in mols, preferably 0.05 to 20 times, more preferably 0.1 to 10 times, and most preferably 0.2 to 5 times the amount of the reducing agent for color formation.

A color light-sensitive material of the present invention is basically composed of a support and a photographic constituting element layer structure coated on the support. The layer structure comprises at least one hydrophilic colloid layer. A light-sensitive silver halide, a dye-forming coupler, and a reducing agent for color formation are added to the layer structure.

The layer structure can be composed of a light-sensitive layer and a light-insensitive layer. As examples of the light-insensitive layer, an antihalation layer, an interlayer, a yellow filter layer, a protective layer, and an overcoat layer can be mentioned.

In the present invention, the most general mode is to add the dye-forming coupler and the reducing agent for color formation used in the present invention to the same layer. However, the dye-forming coupler and the reducing agent for color formation can also be added to different layers provided that they can react with each other. It is preferable that these components be added to a silver halide emulsion layer or its adjacent layer in a light-sensitive material. It is particularly preferable that both of these components be added to a silver halide emulsion layer.

The reducing agent for color formation and the coupler of the present invention can be introduced into a light-sensitive material by various known dispersion methods. A preferable method is an oil-in-water dispersion method in which these components are dissolved in a high-boiling-point organic solvent (used together with a low-boiling-point organic solvent if necessary), the solution is emulsion-dispersed in an aqueous gelatin solution, and the dispersion is added to a silver halide emulsion. High-boiling-point organic solvents usable in the present invention are water-immiscible compounds having a melting point of 100° C. or less and a boiling point of 140° C. or more. Any good solvent for the reducing agent for color formation and the coupler can be used. The melting point of the high-boiling-point organic solvents is preferably 80° C. or less. The boiling point of the high-boiling-point organic solvents is preferably 160° C. or more, and more preferably 170° C. or more. Details of these high-boiling-point organic solvents are described in JP-A 62-215272, page 137, lower right column to page 144, upper right column. When the high-boiling-point organic solvent is used in the present invention, the high-boiling-point organic solvent can be used in any amount. However, the ratio (weight ratio) of the high-boiling-point organic solvent to the reducing agent for color formation is preferably 20 or less, more preferably 0.02 to 5, and most preferably 0.2 to 4.

A known polymer dispersion method can also be used in the present invention. The steps and effects of a latex dispersion method as one polymer dispersion method and practical examples of an impregnating latex are described in, e.g., U.S. Pat. No. 4,199,363, West German Patent Applications (OLS) 2,541,274 and 2,541,230, Jpn. Pat. Appln. KOKOKU Publication (hereinafter referred to as JP-B) 53-41091, and EP 029104. Dispersion methods using organic solvent-soluble polymers are described in PCT International Publication WO88/00723.

The average grain size of fine lipophilic grains containing the reducing agent for color formation used in the present invention can be any grain size. From the viewpoint of color generating properties, however, the average grain size is preferably 0.05 to 0.3 $\mu$m, and more preferably 0.05 to 0.2 $\mu$m.

Generally, the average grain size of fine lipophilic grains can be decreased by properly selecting a surfactant, increasing the use amount of the surfactant, increasing the viscosity of a hydrophilic colloid solution, decreasing the viscosity of a lipophilic organic layer by using a low-boiling-point organic solvent, increasing the shearing force of agitating blades of an emulsifying apparatus by increasing the rotating speed, or prolonging the emulsification time.

The grain size of fine lipophilic grains can be measured by an apparatus such as Nanosizer manufactured by Coulter Co., Ltd. of Britain.

A dye obtained from a hydrazine compound such as carbamoylhydrazide and a dye-forming coupler is a dissociative dye which dissociates to generate a color. Therefore, it is preferable to make the dye dissociative by dipping a light-sensitive material into an alkali solution after color development and subsequent processing steps.

In the present invention, it is preferable to add a mordant to a sensitive material. When the present invention is applied to this mode, it is no longer necessary to generate colors by dipping a light-sensitive material into alkali, and this significantly improves the image stability after the processing. In the present invention, a mordant can be used in any layer. However, if a mordant is added to a layer containing the reducing agent for color formation used in the present invention, the stability of the reducing agent for color formation is degraded. Therefore, a mordant is preferably added to a layer not containing the reducing agent for color formation used in the present invention. Furthermore, a dye formed by the reducing agent for color formation and the coupler diffuses into a gelatin film which swells during processing and dyes a mordant. Accordingly, to obtain a high sharpness the diffusion distance is preferably as short as possible. Therefore, a mordant is preferably added to a layer adjacent to a layer containing the reducing agent for color formation.

Also, since a dye formed by the reducing agent for color formation used in the present invention and the coupler used in the present invention is a water-soluble dye, it is possible that the dye dissolves into a processing solution. To prevent this, therefore, a layer to which a mordant is added is preferably on the side of a layer containing the reducing agent for color formation opposit to a support. That is, the layer containing the reducing agent for color formation is preferably interposed between the layer to which a mordant is added and the support. However, if a barrier layer as described in JP-A 7-168335 is to be formed on the side of a layer containing a mordant opposit to a support, it is preferable that the layer to which the mordant is added be on the same side of the support to a layer containing the reducing agent for color formation. That is, if the barrier layer is to be formed above the layer containing the mordant, the layer containing the reducing agent for color formation can preferably be interposed between the layer containing the mordant and the barrier layer.

The mordant used in the present invention can also be added to a plurality of layers. Especially when the reducing agent for color formation is contained in a plurality of layers, it is also preferable to add the mordant to the respective adjacent layers of these layers.

When the mordant is contained in a light-sensitive material, the structure of the reducing agent for color formation used in the present invention is preferably so chosen that a dye formed by the reducing agent for color formation and the coupler has the following characteristics. That is, the dye formed preferably has one or more dissociative groups with a pKa (acid dissociation constant) of 12 or less, more preferably has one or more dissociative groups with a pKa of 8 or less, and most preferably has a dissociative group with a pKa of 6 or less. The molecular weight of the diffusive dye formed is preferably 200 to 2000. Furthermore, the ratio, i.e., the molecular weight of the dye formed/the number of dissociative groups with a pKa of 12 or less, is preferably 100 to 2000, and more preferably 100 to 1000. As the values of pKa, values measured by using dimethylformamide: water=1:1 as a solvent are used.

The dye-forming coupler is so selected that a dye formed when the dye-forming coupler couples with the reducing agent for color formation used in the present invention dissolves in an amount of preferably $1\times10^{-6}$ mol/l or more, more preferably $1\times10^{-5}$ mol/l or more, and most preferably $1\times10^{-4}$ mol/l or more in an alkali solution of pH 11 at 25° C. Also, the dye-forming coupler is so selected that the diffusion constant of a dye formed when the dye-forming coupler couples with the reducing agent for color formation used in the present invention is preferably $1\times10^{-8}$ $m^2/s$ or more, more preferably $1\times10^{-7}$ $m^2/s$ or more, and most preferably $1\times10^{-6}$ $m^2/s$ or more when the dye is dissolved at a concentration of $10^{-4}$ mol/l in an alkali solution of pH 11 at 25° C.

Although the mordant usable in the present invention can arbitrary be selected from commonly used mordants, polymer mordants are particularly preferable among other mordants. Polymer mordants are, for example, polymers containing a tertiary amino group, polymers having a nitrogen-containing heterocyclic portion, and polymers containing a quaternary cation group of the polymers.

Specific examples of a homopolymer and a copolymer containing a vinyl monomer unit having a tertiary imidazole group are described in U.S. Pat. Nos. 4,282,305, 4,115,124, and 3,148,061, and JP-A 60-118834, 60-122941, 62-244043, and 62-244036.

Preferable specific examples of a homopolymer and a copolymer containing a vinyl monomer unit having quaternary imidazolium salt are described in British Patents. 2,056,101, 2,093,041, and 1,594,961, U.S. Pat. Nos. 4,124, 386, 4,115,124, and 4,450,224, and JP-A 48-28325.

Preferable specific examples of a homopolymer and a copolymer containing a vinyl monomer unit having quaternary ammonium salt are described in U.S. Pat. Nos. 3,709, 690, 3,898,088, and 3,958,995, and JP-A 60-57836, 60-60643, 60-122940, 60-122942, and 60-235134.

Other examples are vinylpyridine polymers and vinylpyridinium cation polymers described in U.S. Pat. Nos. 2,548,564, 2,484,430, 3,148,161, and 3,756,814; polymer mordants capable of crosslinking to, e.g., gelatin disclosed in U.S. Pat. Nos. 3,625,694, 3,859,096, and 4,128,538, and British Patent 1,277,453; aqueous sol mordants disclosed in U.S. Pat. Nos. 3,958,995, 2,721,852, and 2,798,063, and JP-A 54-115228, 54-145529, and 54-26027; water-insoluble mordants disclosed in U.S. Pat. No. 3,898,088; reactive mordants capable of covalent-bonding to a dye disclosed in U.S. Pat. No. 4,168,976 (JP-A 54-137333); and mordants disclosed in U.S. Pat. Nos. 3,709,690, 3,788,855, 3,642,482, 3,488,706, 3,557,066, and 3,271,147, and JP-A 50-71332, 53-30328, 52-155528, 53-125, and 53-1024.

Mordants described in U.S. Pat. Nos. 2,675,316 and 2,882,156 can also be used.

The molecular weight of the polymer mordant used in the present invention is preferably 1,000 to 1,000,000, and particularly preferably 10,000 to 200,000.

The polymer mordant described above is generally used after being mixed in a hydrophilic colloid.

As the hydrophilic colloid, one or both of a hydrophilic colloid and a high-hygroscopic polymer can be used, and gelatin is most representative. The mixing ratio of the polymer mordant to the hydrophilic colloid and the coating amount of the polymer mordant can be easily determined by those skilled in the art in accordance with the amount of a dye to be mordanted, the type and composition of the polymer mordant, and the image formation process to be used. However, the mordant/hydrophilic colloid ratio is appropriately 20/80 to 80/20 (weight ratio), and the coating amount of the mordant is appropriately 0.2 to 15 g/m$^2$, and preferably 0.5 to 8 g/m$^2$.

Specific examples of the mordants used in the present invention are presented below, but the invention is, of course, not limited to these examples. In the following examples, the number attached to a repeating unit is in mol %.

P-1

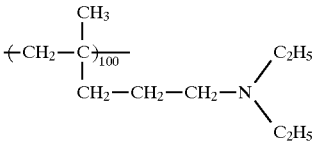

P-2

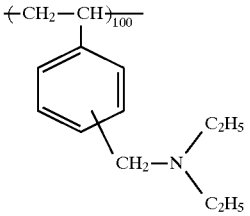

P-3

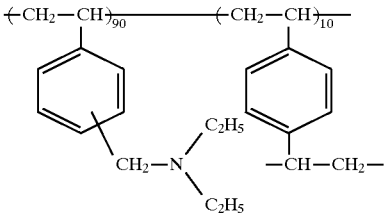

-continued

P-4

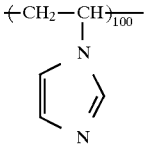

P-5

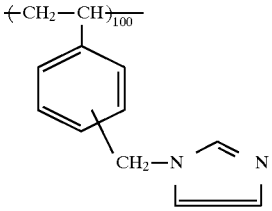

P-6

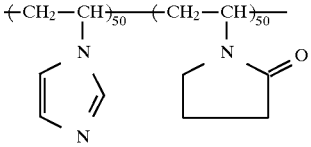

P-7

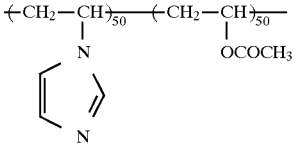

P-8

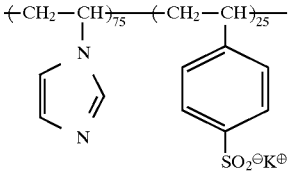

P-9

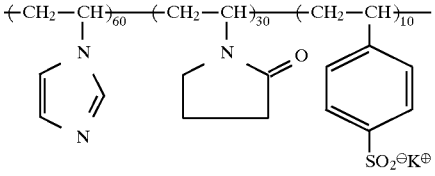

P-10

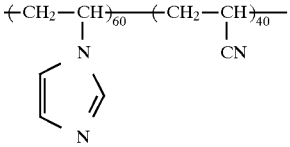

P-11

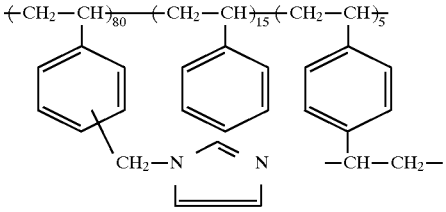

P-12

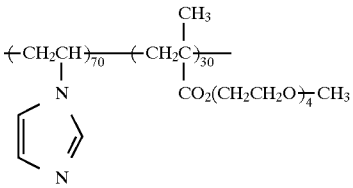

-continued
P-13
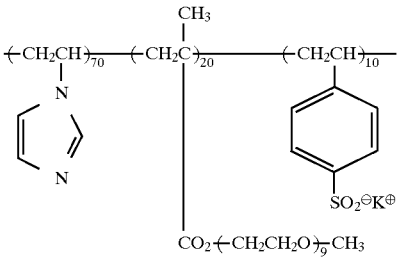
P-14
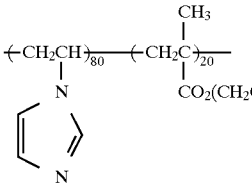
P-15
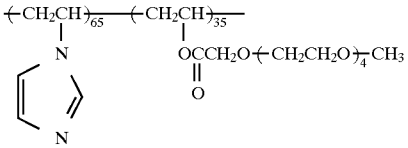
P-16
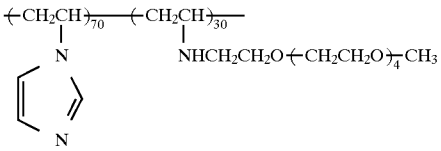
P-17
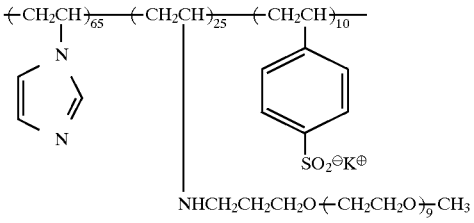
P-18
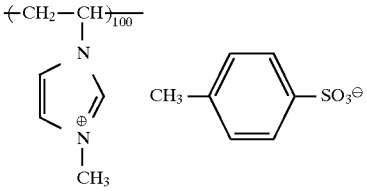
P-19
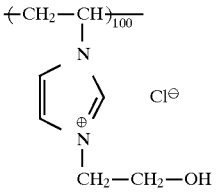
P-20
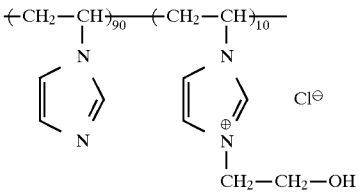
-continued
P-21
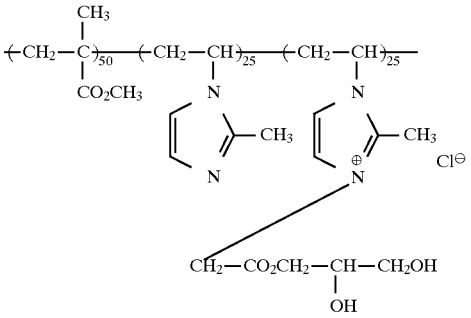
P-22
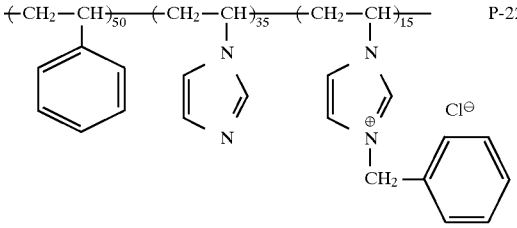
P-23
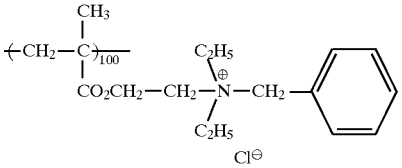
P-24
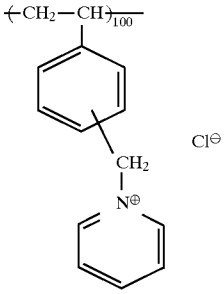
P-25
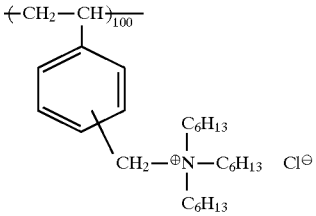
P-26
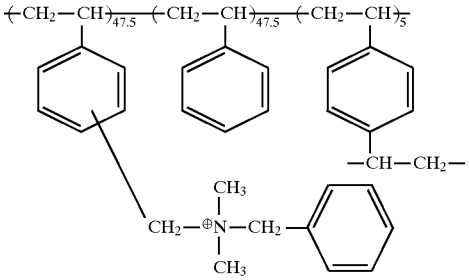

-continued

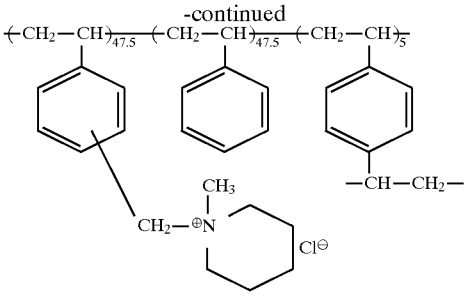

P-27

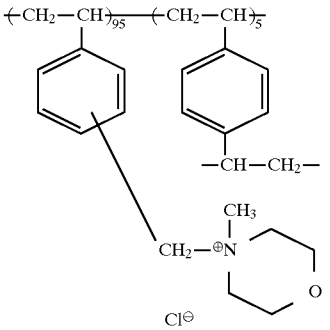

P-28

In the present invention, it is preferable to use an auxiliary developing agent and its precursor in a light-sensitive material. These compounds will be described below.

An auxiliary developing agent used in the present invention is a compound having a function of accelerating electron transfer from the reducing agent for color formation to a silver halide in the process of development of silver halide grains. An auxiliary developing agent is preferably a compound which can develop exposed silver halide grains, and the oxidation product of which can oxidize the reducing agent for color formation (this will be called cross oxidation hereinafter).

Auxiliary developing agents used in the present invention are preferably pyrazolidones, dihydroxybenzenes, reductones, or aminophenols, and most preferably pyrazolidones. The diffusivity of these compounds in a hydrophilic colloid layer is preferably as low as possible. For example, the solubility (25° C.) to water is preferably 0.1% or less, more preferably 0.05% or less, and most preferably 0.01% or less.

A precursor of the auxiliary developing agent used in the present invention is a compound which stably exists in a sensitive material but, once processed with a processing solution, rapidly releases the auxiliary developing agent above mentioned. When this compound is used, the diffusivity in a hydrophilic colloid layer is preferably as low as possible. For example, the solubility (25° C.) to water is preferably 0.1% or less, more preferably 0.05% or less, and most preferably 0.01% or less. Although the solubility of the auxiliary developing agent released from the precursor is not particularly limited, the solubility of the auxiliary developing agent itself is preferably as low as possible.

The auxiliary developing agent precursor used in the present invention is preferably represented by formula (A) below.

$$A—(L)_n—PUG \qquad \text{Formula (A)}$$

In formula (A), A represents a block group which non-imagewise cleaves the bond to $(L)_n$—PUG, L represents a coupling group which cleaves the bond between L and PUG after the bond between L and A is cleaved, n represents an integer from 0 to 3, and PUG represents an antifoggant or a photographically useful group. In the present invention, PUG is represented by the auxiliary developing agent.

As the auxiliary developing agent, electron releasing compounds, other than compounds of p-phenylenediamines, which follow the Kendall-Perutz rule are used, and pyrazolidones described above are preferably used.

As a block group represented by A, the following known groups can be applied. That is, examples are block groups such as an acyl group and a sulfonyl group described in U.S. Pat. No. 3,311,476, a block group using a reverse Michael reaction described in JP-A 59-105642, a block group using quinonemethide or a compound similar to quinonemethide by intramolecular electron transfer described in JP-A 2-280140, a block group using an intramolecular nucleophilic substitution reaction described in JP-A 63-318555 (EP 0295729), a block group using an addition reaction of a nucleophilic agent to a conjugated unsaturated bond described in JP-A 4-186344, a block group using a β-split-off reaction described in JP-A 62-163051, a block group using a nucleophilic substitution reaction of diarylmethanes described in JP-A 61-188540, a block group using a Lossen rearrangement reaction described in JP-A 62-187850, a block group using a reaction between an N-acyl body of thiazolidine-2-thione and amine described in JP-A 62-147457, and a block group which has two electrophilic groups and reacts with a binucleophilic agent described in International Publication WO93/03419.

A group represented by L in a compound represented by formula (A) can be any group as long as the group is a coupling group which can cleave $(L)_n$—PUG after splitting off from a group represented by A during development. Examples are a group described in U.S. Pat. Nos. 4,146,396, 4,652,516, or 4,698,297 which uses cleavage of a hemiacetal group, a timing group described in U.S. Pat. Nos. 4,248,962, 4,847,185, or 4,857,440 which causes an intramolecular nucleophilic substitution reaction, a timing group described in U.S. Pat. Nos. 4,409,323 or 4,421,845 which causes a cleavage reaction by using an electron transfer reaction, a group described in U.S. Pat. No. 4,546,073 which causes a cleavage reaction by using a hydrolytic reaction of iminoketal, a group described in West German Patent Publication 2,626,317 which causes a cleavage reaction is by using a hydrolytic reaction of ester, and a group described in EP 0572084 which causes a cleavage reaction by using a reaction with sulfurous acid ion. L bonds to A in a hetero atom, preferably an oxygen atom, a sulfur atom, or a nitrogen atom.

Practical examples of the auxiliary developing agent and its precursor are presented below. However, compounds used in the present invention are not limited to these examples.

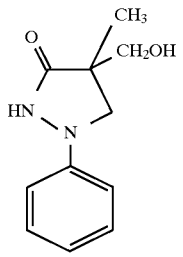

(ETA-1)

-continued
(ETA-2)
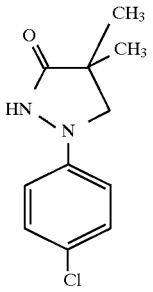
(ETA-3)
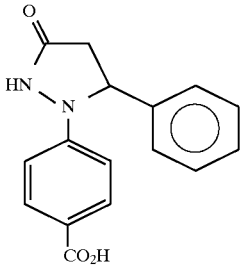
(ETA-4)
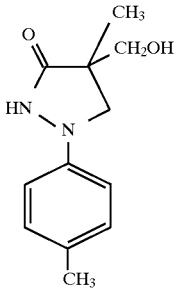
(ETA-5)
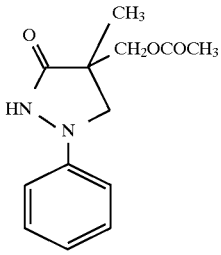
(ETA-6)
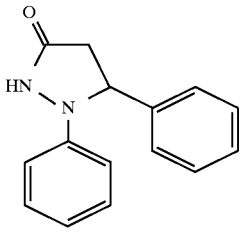
(ETA-7)
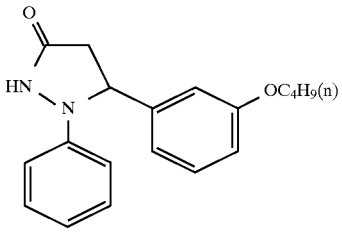
-continued
(ETA-8)
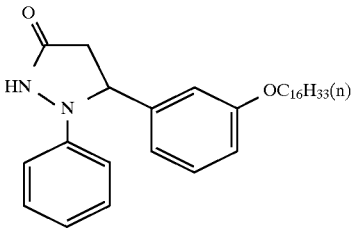
(ETA-9)
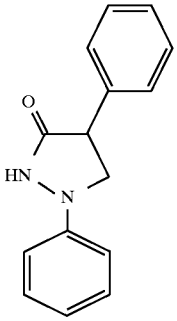
(ETA-10)
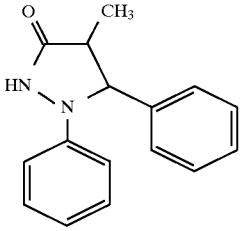
(ETA-11)
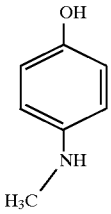
(ETA-12)
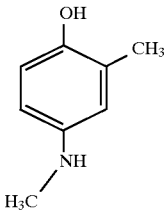
(ETA-13)
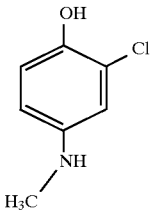

-continued (ETA-14)

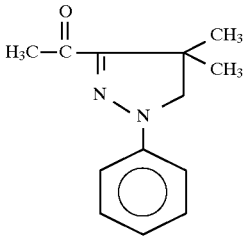

(ETA-15)

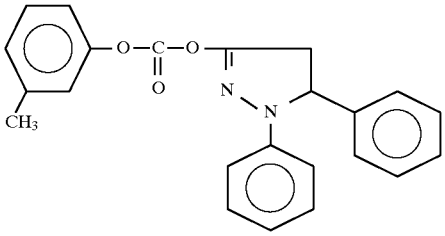

(ETA-16)

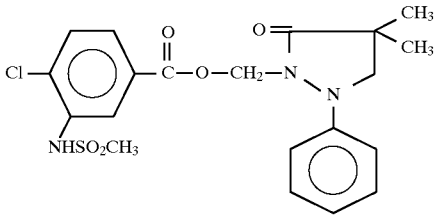

(ETA-17)

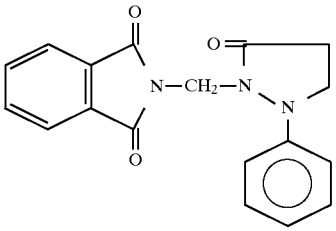

(ETA-18)

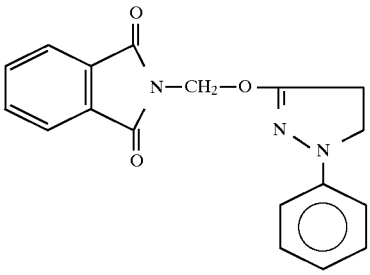

(ETA-19)

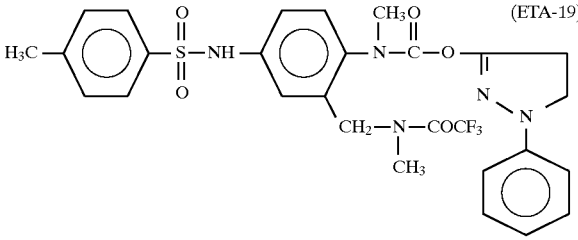

-continued (ETA-20)

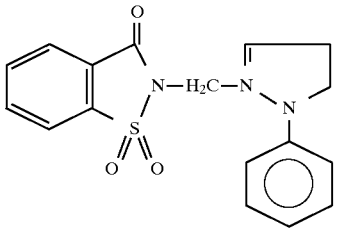

These compounds can be added to any of a light-sensitive layer, an interlayer, an undercoat layer, and a protective layer. When a light-sensitive material contains the auxiliary developing agent, however, these compounds are preferably added to light-insensitive layers.

As a method of adding these compounds to a light-sensitive material, it is possible to use a method in which these compounds are dissolved in a water-miscible organic solvent such as methanol and the solution is directly added to a hydrophilic colloid layer, a method in which these compounds are added in the form of an aqueous solution or a colloid dispersion in the presence of a surfactant, a method in which these compounds are dissolved in a solvent which is substantially immiscible with water, or in oil, then, the solution is dispersed in water or a hydrophilic colloid, and the dispersion is added, and a method in which these compounds are added in the form of a solid fine particle dispersant. That is, the conventionally known methods can be used singly or together.

The addition amount to a light-sensitive material is 1 to 200 mol %, preferably 5 to 100 mol %, and more preferably 10 to 50 mol % with respect to the reducing agent for color formation.

Silver halide composition of grains for use in the present invention comprise silver bromide, silver chloride, silver iodide, silver chlorobromide, silver chloroiodide, silver iodobromide, or silver chloroiodobromide. Another silver salt, such as silver rhodanate, silver sulfide, silver selenide, silver carbonate, silver phosphate, or organic acid silver, can be contained among grains for use in the present invention, as another grain that is independent from the silver halide grain or as a portion of the silver halide grain. If rapid development and desilvering (bleaching, fixing, and bleach-fix) steps are desired, silver halide grains containing a large quantity of silver chloride are desirable. To appropriately discourage development, silver halide grains are preferably made contain silver iodide. A preferable silver iodide content changes in accordance with the purpose of a light-sensitive material. For example, the content is preferably 0.1 to 15 mol % in X-ray sensitive materials and preferably 0.1 to 5 mol % in graphic art and micro sensitive materials. In photographic light-sensitive materials represented by color negative films, the silver iodide content of a silver halide is preferably 1 to 30 mol %, more preferably 5 to 20 mol %, and most preferably 8 to 15 mol %. The silver chloride content is preferably as high as possible in the present invention in which rapidness is also required of photographic equipment.

The silver halide emulsion of the present invention preferably has a distribution or a structure associated with a halogen composition in its grains. A typical example of such a grain is a core-shell or double structure grain having different halogen compositions in its interior and surface layer as disclosed in, e.g., JP-B 43-13162 and JP-A 61-215540, 60-222845, 60-143331, and 61-75337. The structure need not be a simple double structure but can be a triple structure or a multiple structure larger than the triple structure as disclosed in JP-A 60-222844. It is also possible to lay a thin silver halide layer having a different composition from that of the surface of a core-shell double-structure grain.

The structure to be formed inside a grain need not be the surrounding structure as described above but can be a so-called junctioned structure. Examples of the junctioned structure are disclosed in JP-A 59-133540 and 58-108526, EP 199,290A2, JP-B 58-24772, and JP-A 59-16254. A crystal to be junctioned can be formed on the edge, the corner, or the face of a host crystal so as to have a different composition from that of the host crystal. Such a junctioned crystal can be formed regardless of whether a host crystal is uniform in halogen composition or has a core-shell structure.

In the case of the junctioned structure, it is naturally possible to use a combination of silver halides. However, it is also possible to form the junctioned structure by combining a silver halide and a silver salt compound not having a rock salt structure, such as silver rhodanate or silver carbonate. In addition, a non-silver salt compound, such as lead oxide, can also be used provided that the formation of the Functioned structure is possible.

In a silver iodobromide grain having any of the above structures, it is preferable that the silver iodide content in the core portion be higher than that in the shell portion. In contrast, it is sometimes preferable that the silver iodide content in the core portion be lower and that in the shell portion be higher. Similarly, in the junctioned-structure grain, the silver iodide content can be higher in the host crystal and lower in the Functioned crystal and vice versa. The boundary portion between different halogen compositions in a grain having any of the above structures can be either definite or indefinite. It is also preferable to positively form a continuous composition change.

In a silver halide grain in which two or more silver halides are present as a mixed crystal or with a structure, it is important to control the distribution of halogen compositions between grains. A method of measuring the distribution of halogen compositions between grains is described in JP-A 60-254032. A uniform halogen distribution between grains is a desirable characteristic. In particular, a highly uniform emulsion having a variation coefficient of 20% or less is preferable. An emulsion having a correlation between a grain size and a halogen composition is also preferable. An example of the correlation is that larger grains have higher iodide contents and smaller grains have lower iodide contents. An opposite correlation or a correlation with respect to another halogen composition can also be selected in accordance with the intended use. For this purpose, it is preferable to mix two or more emulsions having different compositions.

It is important to control the halogen composition near the surface of a grain. Increasing the silver iodide content or the silver chloride content near the surface can be selected in accordance with the intended use because this changes the dye adsorbing property or the developing rate. In order to change the halogen composition near the surface, it is possible to select either the structure in which a grain is entirely surrounded by a silver halide or the structure in which a silver halide is adhered to only a portion of a grain. For example, a halogen composition of only one of a (100) face and a (111) face of a tetradecahedral grain can be changed, or a halogen composition of one of a major face or a side face of a tabular grain can be changed.

Silver halide grains for use in the present invention can be selected in accordance with the intended use. Examples are a regular crystal not containing a twin plane and crystals explained in Japan Photographic Society ed., The Basis of Photographic Engineering, Silver Salt Photography (CORONA PUBLISHING CO., LTD.), page 163, such as a single twinned crystal containing one twin plane, a parallel multiple twinned crystal containing two or more parallel twin planes, and a nonparallel multiple twinned crystal containing two or more nonparallel twin planes. A method of mixing grains having different shapes is disclosed in U.S. Pat. No. 4,865,964 and can be selected as needed. In the case of a regular crystal, it is possible to use a cubic grain constituted by (100) faces, an octahedral grain constituted by (111) faces, or a dodecahedral grain constituted by (110) faces disclosed in JP-B 55-42737 or JP-A 60-222842. It is also possible to use, in accordance with the intended use of an emulsion, an (h11) face grain represented by a (211) face grain, an (hh1) face grain represented by a (331) face grain, an (hk0) face grain represented by a (210) face grain, or an (hk1) face grain represented by a (321) face grain, as reported in Journal of Imaging Science, Vol. 30, page 247 (1986) although the preparation method requires some improvements. A grain having two or more different faces, such as a tetradecahedral grain having both (100) and (111) faces, a grain having (100) and (110) faces, or a grain having (111) and (110) faces can also be used in accordance with the intended use of an emulsion.

A value obtained by dividing the equivalent-circle diameter of the projected area of a grain by the thickness of that grain is called an aspect ratio that defines the shape of a tabular grain. Tabular grains having aspect ratios higher than 1 can be used in the present invention. Tabular grains can be prepared by methods described in, e.g., Cleve, Photography Theory and Practice (1930), page 131; Gutoff, Photographic Science and Engineering, Vol. 14, pages 248 to 257 (1970); and U.S. Pat. Nos. 4,434,226, 4,414,310, 4,433,048, and 4,439,520, and British Patent 2,112,157. The use of tabular grains brings about advantages such as an increase in the covering power and an increase in the spectral sensitization efficiency owing to sensitizing dyes. These advantages are described in detail in U.S. Pat. No. 4,434,226 cited above. An average aspect ratio of 80% or more of a total projected area of grains is preferably 1 to less than 100, more preferably 2 to less than 20, and most preferably 3 to less than 10. The shape of a tabular grain can be selected from, e.g., a triangle, a hexagon, and a circle. One preferable form is a regular hexagon having six substantially equal sides as described in U.S. Pat. No. 4,797,354.

The most preferable form and composition of a silver halide emulsion are silver chlorobromide in which the silver chloride content is 50 to 100 mol %, preferably 70 to 100 mol %, and more preferably 85 to 100 mol % in respect of the rapidness of processing, and the sum of projected areas of tabular grains having an aspect ratio of 2 or more accounts for 50 to 100%, preferably 80 to 100% of the projected area of all grains in respect of the sensitivity. From the viewpoint of the stability of the form of silver halide grains having a high silver chloride content, a rectangular (100) silver chlorobromide tabular emulsion having (100) crystal faces as parallel major faces is most preferred.

An equivalent-circle diameter of a projected area is often used as the grain size of tabular grains. To improve the image quality, grains with an average diameter of 0.6 $\mu$m or smaller such as described in U.S. Pat. No. 4,748,106 are preferable. Also, an emulsion having a narrow grain size distribution as described in U.S. Pat. No. 4,775,617 is preferable. Limiting the grain thickness as the shape of tabular grains to 0.05 to 0.5 μm, more preferably 0.07 to 0.3 μm is preferable to improve the sharpness. An emulsion having a high thickness uniformity, i.e., a variation coefficient of a grain thickness of 30% or less, is also preferable. Furthermore, grains described in JP-A 63-163451 in which the grain thickness and the distance between twin planes are defined are preferable.

Dislocation lines of a tabular grain can be observed by using a transmission electron microscope. It is preferable to select a grain containing no dislocations, a grain containing several dislocations, or a grain containing a large number of dislocations in accordance with the intended use. It is also possible to select dislocations introduced linearly with respect to a specific direction of the crystal orientation of a grain or dislocations curved with respect to that direction. Alternatively, it is possible to selectively introduce dislocations throughout an entire grain or only to a particular portion of a grain, e.g., the fringe portion of a grain. Introduction of dislocation lines is preferable not only for tabular grains but for a regular crystal grain or an irregular grain represented by a potato-like grain. Also in this case, it is preferable to limit the positions of dislocation lines to specific portions such as the corners or the edges of a grain.

A silver halide emulsion used in the present invention can be subjected to processing for rounding grains as disclosed in EP 96,727B1 or EP 64,412B1, or surface modification as disclosed in West German Patent 2,306,447C2 or JP-A 60-221320.

Although a flat grain surface is common, intentionally forming projections and recesses on the surface is preferable in some cases. Examples are methods described in JP-A 58-106532 and 60-221320, in which a hole is formed in a portion of a crystal, e.g., the corner or the center of the face of a crystal, and a ruffle grain described in U.S. Pat. No. 4,643,966.

The grain size of an emulsion used in the present invention can be evaluated in terms of the equivalent-circle diameter of the projected area of a grain obtained by using an electron microscope, the equivalent-sphere diameter of the volume of a grain calculated from the projected area and the thickness of the grain, or the equivalent-sphere diameter of the volume of a grain obtained by a Coulter counter method. It is possible to selectively use various grains from a very fine grain having an equivalent-sphere diameter of 0.05 μm or less to a large grain having that of more than 10 μm. It is preferable to use a grain having an equivalent-sphere diameter of 0.1 to 3 μm as a photosensitive silver halide grain.

In the present invention, it is possible to use a so-called polydisperse emulsion having a wide grain size distribution or a monodisperse emulsion having a narrow grain size distribution in accordance with the intended use. As a measure representing the size distribution, a variation coefficient of either the equivalent-circle diameter of the projected area of a grain or the equivalent-sphere diameter of the volume of a grain is sometimes used. When a monodisperse emulsion is to be used, it is desirable to use an emulsion having a size distribution with a variation coefficient of preferably 25% or less, more preferably 5% to 20%, and most preferably 5% to 15%.

The monodisperse emulsion is sometimes defined as an emulsion having a grain size distribution in which 80% or more of all grains fall within a range of ±30% of an average grain size represented by the number or the weight of grains. In order for a sensitive material to satisfy its target gradation, two or more monodisperse silver halide emulsions having different grain sizes can be mixed in the same emulsion layer or coated as different layers in an emulsion layer having essentially the same color sensitivity. It is also possible to mix, or coat as different layers, two or more types of polydisperse silver halide emulsions or monodisperse emulsions together with polydisperse emulsions.

Photographic emulsions used in the present invention can be prepared by methods described in, e.g., P. Glafkides, Chimie et Physique Photographique, Paul Montel, 1967; G. F. Duffin, Photographic Emulsion Chemistry, Focal Press, 1966; and V. L. Zelikman et al., Making and Coating Photographic Emulsion, Focal Press, 1964. That is, any of an acid method, a neutral method, and an ammonia method can be used. In forming grains by the reaction of a soluble silver salt and a soluble halogen salt, any of a single-jet method, a double-jet method, and a combination of these methods can be used. It is also possible to use a method (so-called reverse double-jet method) of forming grains in the presence of excess silver ion. As one type of the double-jet method, a method in which the pAg of a liquid phase for producing a silver halide is maintained constant, i.e., a so-called controlled double-jet method can be used. This method makes it possible to obtain a silver halide emulsion in which the crystal shape is regular and the grain size is nearly uniform.

In some cases, it is preferable to make use of methods of adding silver halide grains already formed by precipitation to a reactor vessel for emulsion preparation. These methods are described in U.S. Pat. Nos. 4,334,012, 4,301,241, and 4,150,994. These silver halide grains can be used as seed crystal and are also effective when supplied as a silver halide for growth. In the latter case, addition of an emulsion with a small grain size is preferable. The total amount of an emulsion can be added at one time, or an emulsion can be separately added a plurality of times or added continuously. In addition, it is sometimes effective to add grains having several different halogen compositions in order to modify the surface.

A method of converting most or only a part of the halogen composition of a silver halide grain by a halogen conversion process is disclosed in, e.g., U.S. Pat. Nos. 3,477,852 and 4,142,900, EP 273,429 and EP 273,430, and West German Patent Publication 3,819,241. This method is an effective grain formation method. To convert into a silver salt that is more sparingly soluble, it is possible to add a solution or silver halide grains of a soluble halogen. The conversion can be performed at one time, separately a plurality of times, or continuously.

As a grain growth method other than the method of adding a soluble silver salt and a halogen salt at a constant concentration and a constant flow rate, it is preferable to use a grain formation method in which the concentration or the flow rate is changed, such as described in British Patent 1,469,480 and U.S. Pat. Nos. 3,650,757 and 4,242,445. Increasing the concentration or the flow rate can change the amount of a silver halide to be supplied by a linear function, a quadratic function, or a more complex function of the addition time. It is also preferable to decrease the silver halide amount to be supplied if necessary. Furthermore, when a plurality of soluble silver salts of different solution compositions are to be added or a plurality of soluble halogen salts of different solution compositions are to be added, a method of increasing one of the salts while decreasing the other is also effective.

A mixing vessel for reacting solutions of soluble silver salts and soluble halogen salts can be selected from those described in U.S. Pat. Nos. 2,996,287, 3,342,605, 3,415,650, and 3,785,777 and West German Laid Open Patents 2,556,885 and 2,555,364.

A silver halide solvent is useful for the purpose of accelerating ripening. As an example, it is known to make an excess of halogen ion exist in a reactor vessel in order to accelerate ripening. Another ripening agent can also be used. The total amount of these ripening agents can be mixed in a dispersing medium placed in a reactor vessel before addition of silver and a halide salt or can be introduced to the reactor vessel simultaneously with addition of a halide salt, a silver salt, and a deflocculant. Alternatively, ripening agents can be independently added in the step of adding a halide salt and a silver salt.

Examples of the ripening agent are ammonia, thiocyanate (e.g., potassium rhodanate and ammonium rhodanate), organic thioether compounds (e.g., compounds described in U.S. Pat. Nos. 3,574,628, 3,021,215, 3,057,724, 3,038,805, 4,276,374, 4,297,439, 3,704,130, and 4,782,013 and JP-A 57-104926), thione compounds (e.g., 4-substituted thiourea described in JP-A 53-82408 and 55-77737 and U.S. Pat. No. 4,221,863, and compounds described in JP-A 53-144319), mercapto compounds capable of accelerating growth of silver halide grains described in JP-A 57-202531, and amine compounds (e.g., JP-A 54-100717).

It is advantageous to use gelatin as a protective colloid for use in preparation of emulsions of the present invention or as a binder for other hydrophilic colloid layers. However, another hydrophilic colloid can also be used in place of gelatin.

Examples of the hydrophilic colloid are protein, such as a gelatin derivative, a graft polymer of gelatin and another high polymer, albumin, and casein; a sugar derivative, such as a cellulose derivative, e.g., hydroxyethylcellulose, carboxymethylcellulose, and cellulose sulfate, soda alginate, and a starch derivative; and a variety of synthetic hydrophilic high polymers, such as homopolymers or copolymers, e.g., polyvinyl alcohol, polyvinyl alcohol partial acetal, poly-N-vinylpyrrolidone, polyacrylic acid, polymethacrylic acid, polyacrylamide, polyvinylimidazole, and polyvinyl pyrazole.

Examples of gelatin are lime-processed gelatin, acid-processed gelatin, and enzyme-processed gelatin described in Bull. Soc. Sci. Photo. Japan. No. 16, page 30 (1966). In addition, a hydrolyzed product or an enzyme-decomposed product of gelatin can also be used. The use of a low-molecular-weight gelatin described in JP-A 1-158426 is preferable in the preparation of tabular grains.

It is preferable to wash emulsions of the present invention to form a newly prepared protective colloid dispersion for a desalting purpose. Although the temperature of washing can be selected in accordance with the intended use, it is preferably 5° C. to 20° C. Although the pH of washing can also be selected in accordance with the intended use, it is preferably 2 to 10, and more preferably 3 to 8. The pAg of washing is preferably 5 to 10, though it can also be selected in accordance with the intended use. The washing method can be selected from noodle washing, dialysis using a semipermeable membrane, centrifugal separation, coagulation precipitation, and ion exchange. The coagulation precipitation can be selected from a method using sulfate, a method using an organic solvent, a method using a water-soluble polymer, and a method using a gelatin derivative.

In the preparation of emulsions of the present invention, it is preferable to make salt of metal ion exist during grain formation, desalting, or chemical sensitization, or before coating, in accordance with the intended use. The metal ion salt is preferably added during grain formation when doped into grains, and after grain formation and before completion of chemical sensitization in decorating the grain surface or when used as a chemical sensitizer. The doping can be performed for any of an overall grain, only the core, the shell, or the epitaxial portion of a grain, and only a substrate grain. Examples of the metal are Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb, and Bi. These metals can be added as long as they are in the form of salt that can be dissolved during grain formation, such as ammonium salt, acetate, nitrate, sulfate, phosphate, hydroacid salt, 6-coordinated complex salt, or 4-coordinated complex salt. Examples are $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_3IrCl_6$, $(NH_4)_3RhCl_6$, and $K_4Ru(CN)_6$. The ligand of a coordination compound can be selected from halogen, $H_2O$, $NH_3$, a cyano group, a cyanate group, a thiocyanate group, a nitrosyl group, a thionitrosyl group, an oxo group, and a carbonyl group. Although these metal compounds can be used singly, two or more types of the compounds can also be used together.

It is sometimes useful to perform a method of adding a chalcogen compound during preparation of an emulsion, such as described in U.S. Pat. No. 3,772,031. In addition to S, Se, and Te, cyan salt, thiocyan salt, selenocyan salt, carbonate, phosphate, and acetate can be present.

In the formation of silver halide grains of the present invention, at least one of sulfur sensitization, selenium sensitization, tellurium sensitization (these three sensitization methods are known generically as chalcogen sensitization), noble metal sensitization, and reduction sensitization can be performed at any point during the process of manufacturing a silver halide emulsion. The use of two or more different sensitization methods is preferable. Several different types of emulsions can be prepared by changing the timing at which the chemical sensitization is performed. The emulsion types are classified into: a type in which a chemical sensitization speck is embedded inside a grain, a type in which chemical sensitization speck is embedded at a shallow position from the surface of a grain, and a type in which a chemical sensitization speck is formed on the surface of a grain. In emulsions of the present invention, the location of a chemical sensitization speck can be selected in accordance with the intended use. It is, however, generally preferable to form at least one type of a chemical sensitization speck near the surface.

One chemical sensitization which can be preferably performed in the present invention is chalcogen sensitization, noble metal sensitization, or a combination of these. The sensitization can be performed by using an active gelation as described in T. H. James, The Theory of the Photographic Process, 4th ed., Macmillan, 1977, pages 67 to 76. The sensitization can also be performed by using any of sulfur, selenium, tellurium, gold, platinum, palladium, and iridium, or by using a combination of a plurality of these sensitizers at a pAg of 5 to 10, a pH of 5 to 8, and a temperature of 30° to 80° C., as described in Research Disclosure Item 12008 (April 1974), Item 13452 (June 1975), and Item 307105 (November 1989), U.S. Pat. Nos. 2,642,361, 3,297,446, 3,772,031, 3,857,711, 3,901,714, 4,266,018, and 3,904,415, and British Patent 1,315,755.

In sulfur sensitization, labile sulfur compounds are used. More specifically, it is possible to use thiosulfate (e.g., hypo), thioureas (e.g., diphenylthiourea, triethylthiourea, and allylthiourea), rhodanines, mercaptos, thioamides, thiohydantoins, 4-oxo-oxazolidine-2-thiones, disulfides, polysulfides, polythionate, element-like sulfur, and known sulfur-containing compounds described in U.S. Pat. Nos. 3,857,711, 4,266,018, and 4,054,457. Sulfur sensitization is in many instances used in combination with noble metal sensitization.

The amount of sulfur sensitizers used in silver halide grains of the present invention is preferably $1\times10^{-7}$ to $10^{-3}$ mol, and more preferably $5\times10^{-7}$ to $1\times10^{-4}$ mol per mol of a silver halide.

In selenium sensitization, know labile selenium compounds are used. For example, selenium compounds described in U.S. Pat. Nos. 3,297,446 and 3,297,447 can be used. More specifically, it is possible to use selenium compounds such as colloidal metal selenium, selenoureas (e.g., N,N-dimethylselenourea and tetramethylselenourea), selenoketones (e.g., selenoacetone), selenoamides (e.g., selenoacetamide), selenocarboxylic acid and selenoesters, isoselenocyanates, selenides (e.g., diethylselenide and triphenylphosphineselenide), and selenophosphates (e.g., tri-p-tolylselenophosphate). It is in some cases preferable that selenium sensitization be used together with one or both of sulfur sensitization and noble metal sensitization.

The use amount of selenium sensitizers changes in accordance with selenium compounds and silver halide grains used and the conditions of chemical ripening. However, the amount is generally $10^{-8}$ to $10^{-4}$ mol, preferably $10^{-7}$ to $10^{-5}$ mol per mol of a silver halide.

As tellurium sensitizers used in the present invention, it is possible to use compounds described in Canadian Patent 800,958, British Patents 1,295,462 and 1,396,696, and JP-A 4-204640 and 4-333043. Practical examples of tellurium sensitizers are colloidal tellurium, telluroureas (e.g., tetramethyltellurourea, N-carboxyethyl-N',N'-dimethyltellurourea, and N,N'-dimethylethylenetellurourea), isotellurocyanates, telluroketones, telluroamides, tellurohydrazides, telluroesters, phosphinetellurides (e.g., tributylphosphinetelluride and butyl-diisopropylphosphinetelluride), and other tellurium compounds (e.g., potassiumtelluride, potassiumtellurocyanate, and telluropentathionatesodium salt). The use amount of tellurium sensitizers is preferably $10^{-7}$ to $5\times10^{-2}$ mol, and more preferably $5\times10^{-7}$ to $1\times10^{-3}$ mol per mol of a silver halide.

In noble metal sensitization, noble metal salts such as platinum, gold, palladium, and iridium can be used. It is particularly preferable to perform one or both of gold sensitization and palladium sensitization. In gold sensitization, it is possible to use known compounds such as chloroauric acid, potassiumchloroaurate, potassiumaurithiocyanate, gold sulfide, and gold selenide. A palladium compound means divalent or tetravalent salt of palladium. A preferable palladium compound is represented by $R_2PdX_6$ or $R_2PdX_4$ wherein R represents a hydrogen atom, an alkali metal atom, or an ammonium group, X represents a halogen atom, i.e., a chlorine, bromine, or iodine atom.

More specifically, a palladium compound is preferably $K_2PdCl_4$, $(NH_4)_2PdCl_6$, $Na_2PdCl_4$, $(NH_4)_2PdCl_4$, $Li_2PdCl_4$, $Na_2PdCl_6$, or $K_2PdBr_4$. It is preferable that a gold compound and a palladium compound be used together with thiocyanate or selenocyanate.

Gold sensitization cal also be preferably performed for the emulsions of the present invention. The amount of gold sensitizers is preferably $1\times10^{-7}$ to $1\times10^{-3}$ mol, and more preferably $5\times10^{-7}$ to $5\times10^{-4}$ mol per mol of a silver halide. The amount of a palladium compound is preferably $5\times10^{-7}$ to $1\times10^{-3}$ mol per mol of a silver halide. The amount of a thiocyan compound or a selenocyan compound is preferably $1\times10^{-6}$ to $5\times10^{-2}$ mol per mol of a silver halide.

Silver halide emulsions of the present invention are preferably subjected to reduction sensitization during grain formation, after grain formation and before or during chemical sensitization, or after chemical sensitization.

The reduction sensitization can be selected from a method of adding reduction sensitizers to a silver halide emulsion, a method called silver ripening in which grains are grown or ripened in a low-pAg ambient at pAg 1 to 7, and a method called high-pH ripening in which grains are grown or ripened in a high-pH ambient at pH 8 to 11. It is also possible to perform two or more of these methods together.

The method of adding reduction sensitizers is preferable in that the level of reduction sensitization can be finely adjusted.

Known examples of the reduction sensitizer are stannous chloride, ascorbic acid and its derivative, amines and polyamines, hydrazine and its derivative, formamidinesulfinic acid, a silane compound, and a borane compound. In the reduction sensitization of the present invention, it is possible to selectively use these known reduction sensitizers or to use two or more types of compounds together. Preferable compounds as the reduction sensitizer are stannous chloride, aminoiminomethanesulfinic acid (commonly called thiourea dioxide), dimethylamineborane, and ascorbic acid and its derivative. Although the addition amount of the reduction sensitizers must be so selected as to meet the emulsion manufacturing conditions, a preferable amount is $10^{-7}$ to $10^{-3}$ mol per mol of a silver halide.

Chemical sensitization can also be performed in the presence of a so-called chemical sensitization assistant. Examples of a useful chemical sensitization assistant are compounds, such as azaindene, azapyridazine, and azapyrimidine, which are known as compounds capable of suppressing fog and increasing sensitivity in the process of chemical sensitization. Examples of the chemical sensitization assistant and the modifier are described in U.S. Pat. Nos. 2,131,038, 3,411,914, and 3,554,757, JP-A 58-126526, and G. F. Duffin, "Photographic Emulsion Chemistry", pages 138 to 143.

It is preferable to use an oxidizer for silver during the process of manufacturing emulsions used in the present invention. The oxidizer for silver means a compound having an effect of converting metal silver into silver ion. A particularly effective compound is the one that converts very fine silver grains, formed as a by-product in the processes of formation and chemical sensitization of silver halide grains, into silver ion. The silver ion thus produced can form a silver salt sparingly soluble in water, such as a silver halide, silver sulfide, or silver selenide, or a silver salt easily soluble in water, such as silver nitrate. The oxidizer for silver can be either an inorganic or organic substance. Examples of the inorganic oxidizer are ozone, hydrogen peroxide and its adduct (e.g., $NaBO_2.H_2O_2.3H_2O$, $2NaCO_3.3H_2O_2$, $Na_4P_2O_7.2H_2O_2$, and $2Na_2SO_4.H_2O_2.2H_2O$), peroxy (e.g., $K_2S_2O_8$, $K_2C_2O_6$, and $K_2P_2O_8$), a peroxy complex compound (e.g., $K_2[Ti(O_2)C_2O_4].3H_2O$, $4K_2SO_4.Ti(O_2)OH.SO_4.2H_2O$, and $Na_3[VO(O_2)(C_2O_4)_2.6H_2O)$, permanganate (e.g., $KMnO_4$), an oxyacid salt such as chromate (e.g., $K_2Cr_2O_7$), a halogen element such as iodine and bromine, perhalogenate (e.g., potassium periodate), a salt of a high-valence metal (e.g., potassium hexacyanoferrate(II)), and thiosulfonate.

Examples of the organic oxidizer are quinones such as p-quinone, an organic peroxide such as peracetic acid and perbenzoic acid, and a compound of releasing active halogen (e.g., N-bromosuccinimide, chloramine T, and chloramine B).

Preferable oxidizers used in the present invention are ozone, hydrogen peroxide and its adduct, a halogen element, an inorganic oxidizer such as thiosulfonate, and an organic oxidizer such as quinones. A combination of the reduction sensitization described above and the oxidizer for silver is preferable. In this case, the reduction sensitization can be performed after the oxidizer is used or vice versa, or the reduction sensitization and the use of the oxidizer can be performed at the same time. These methods can be selectively performed during grain formation or chemical sensitization.

Photographic emulsions used in the present invention can contain various compounds in order to prevent fog during the manufacturing process, storage, or photographic processing of a sensitive material, or to stabilize the photographic properties. Usable compounds are those known as an antifoggant or a stabilizer, for example, thiazoles, such as benzothiazolium salt, nitroimidazoles, nitrobenzimidazoles, chlorobenzimidazoles, bromobenzimidazoles, mercaptothiazoles, mercaptobenzothiazoles, mecaptobenzimidazoles, mercaptothiadiazoles, aminotriazoles, benzotriazoles, nitrobenzotriazoles, and mercaptotetrazoles (particularly 1-phenyl-5-mercaptotetrazole); mercaptopyrimidines; mercaptotriazines; a thioketo compound such as oxazolinethione; azaindenes, such as triazaindenes, tetrazaindenes (particularly 4-hydroxy-6-methyl(1,3,3a,7)tetrazaindene), and pentazaindenes. For example, compounds described in U.S. Pat. Nos. 3,954,474 and 3,982,947 and JP-B 52-28660 can be used. One preferable compound is described in JP-A 63-212932. Antifoggants and stabilizers can be added at any of several different timings, such as before, during, and after grain formation, during washing, during dispersion after washing, before, during, and after chemical sensitization, and before coating, in accordance with the intended application. The antifoggants and the stabilizers can be added during preparation of an emulsion to achieve their original fog preventing effect and stabilizing effect. In addition, the antifoggants and the stabilizers can be used for various purposes of, e.g., controlling crystal habit of grains, decreasing the grain size, decreasing the solubility of grains, controlling the chemical sensitization, and controlling the arrangement of dyes.

Photographic emulsions used in the present invention are preferably subjected to spectral sensitization by using, e.g., methine dyes in order to achieve the effects of the present invention. Usable dyes involve a cyanine dye, a merocyanine dye, a composite cyanine dye, a composite merocyanine dye, a holopolar cyanine dye, a hemicyanine dye, a styryl dye, and a hemioxonole dye. Most useful dyes are those belonging to a cyanine dye, a merocyanine dye, and a composite merocyanine dye. Any nucleus commonly used as a basic heterocyclic nucleus in cyanine dyes can be applied to these dyes. Examples of an applicable nucleus are a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, and a pyridine nucleus; a nucleus in which an aliphatic hydrocarbon ring is fused to any of the above nuclei; and a nucleus in which an aromatic hydrocarbon ring is fused to any of the above nuclei, e.g., an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, and a quinoline nucleus. These nuclei can be substituted on a carbon atom.

It is possible to apply to a merocyanine dye or a composite merocyanine dye a 5- to 6-membered heterocyclic nucleus as a nucleus having a ketomethylene structure. Examples are a pyrazoline-5-one nucleus, a thiohydantoin nucleus, a 2-thiooxazolidine-2,4-dione nucleus, a thiazolidine-2,4-dione nucleus, a rhodanine nucleus, and a thiobarbituric acid nucleus.

Although these sensitizing dyes can be used singly, they can also be used together. The combination of sensitizing dyes is often used for a supersensitization purpose. Representative examples of the combination are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, and 4,026,707, British Patents 1,344,281 and 1,507,803, JP-B 43-4936 and 53-12375, and JP-A 52-110618 and 52-109925.

In addition to the sensitizing dyes, emulsions can contain dyes having no spectral sensitizing effect or substances which do not essentially absorb visible light and exhibit supersensitization.

The sensitizing dyes can be added to an emulsion at any point during preparation of the emulsion, which is conventionally known to be useful. Most ordinarily, the addition is performed after completion of chemical sensitization and before coating. However, it is possible to perform the addition at the same timing as addition of chemical sensitizing dyes to perform spectral sensitization and chemical sensitization simultaneously, as described in U.S. Pat. Nos. 3,628,969 and 4,225,666. It is also possible to perform the addition prior to chemical sensitization, as described in JP-A 58-113928, or before the completion of formation of a silver halide grain precipitation to start spectral sensitization. Alternatively, as disclosed in U.S. Pat. No. 4,225,666, these compounds can be added separately; i.e., a portion of the compounds can be added prior to chemical sensitization, while the remaining portion is added after that. That is, the compounds can be added at any timing during formation of silver halide grains, including a method disclosed in U.S. Pat. No. 4,183,756.

In sensitive materials relating to this technique, various additives are used in addition to the photographic stabilizers A to E as long as the effect of the invention is achieved. However, other various additives can also be used in accordance with the intended use.

These additives are described in detail in Research Disclosure Item 17643 (Dec. 1978), Item 18716 (Nov. 1979), and Item 307105 (Nov. 1989), and the corresponding portions are summarized in the following table 1.

TABLE 1

| Additives | RD17643 | RD18716 | RD307105 |
|---|---|---|---|
| 1. Chemical sensitizers | page 23 | page 648, right column | page 996 |
| 2. Sensitivity boosters | | page 648, right column | |
| 3. Spectral senstizers, Super sensitizers | page 23 to 24 | page 648, right column to page 649, right column | page 996, right column to page 998, right column |
| 4. whitening agents | page 24 | | page 998, right column |
| 5. Antifogging agents, stabilizers | page 24 to 25 | page 649, right column | page 998, right column to page 1000, right column |
| 6. Light absorber, | page 25 to 26 | page 649, right column to | page 1003, left column to |

TABLE 1-continued

| Additives | RD17643 | RD18716 | RD307105 |
|---|---|---|---|
| filter, dye, ultra violet absorber | | page 650, left column | page 1003, right column |
| 7. Stain inhibitors | page 25, right column | page 650, left column to right column | |
| 8. Dye image stabilizers | page 25 | | |
| 9. Hardeners | page 26 | page 651, left column | page 1004, right column to page 1005, left column |
| 10. Binders | page 26 | page 651, left column | page 1003, right column to page 1004, right column |
| 11. Plasticizers, lubricant | page 27 | page 650, right column | page 1006, left column to page 1006, right column |
| 12. Coating aids | page 26 to 27 | page 650, right column | page 1005, left column to page 1006 left column |
| 13. Antistatic agent | page 27 | page 650, right column | page 1006, right column to page 1007, left column |

As red-sensitive spectral sensitizing dyes for silver halide emulsion grains having a high silver chloride content, spectral sensitizing dyes described in JP-A 3-123340 are very preferable from the viewpoint of the stability, the strength of adsorption, and the temperature dependence of exposure.

To efficiently spectrally sensitize the infrared region in a sensitive material of the present invention, it is preferable to use sensitizing dyes described in JP-A 3-15049, page 12, upper left column to page 21, lower left column, JP-A 3-20730, page 4, lower left column to page 15, lower left column, EP-0,420,011, page 4, line 21 to page 6, line 54, EP-0,420,012, page 4, line 12 to page 10, line 33, EP-0, 443,466, and U.S. Pat. No. 4,975,362.

To add these spectral sensitizing dyes to a silver halide emulsion, they can be dispersed directly in the emulsion. Alternatively, these spectral sensitizing dyes can be dissolved in one or a mixture of solvents, such as water, methanol, ethanol, propanol, methylcellosolve, and 2,2,3,3-tetrafluoropropanol, and added in the form of a solution. It is also possible to prepare an aqueous solution of the dyes in the presence of an acid or a base and add the resultant solution to an emulsion, as described in JP-B 44-23389, 44-27555, and 57-22089, or to prepare an aqueous solution or a colloid dispersion of the dyes in the presence of a surfactant and add the solution or the dispersion to an emulsion, as described in U.S. Pat. Nos. 3,822,135 and 4,006,025. In addition, it is possible to dissolve the dyes in a solvent which is essentially immiscible with water, disperse the solution in water or a hydrophilic colloid, and add the dispersion to an emulsion. Furthermore, as described in JP-A 53-102733 and 58-105141, it is possible to disperse the dyes directly in a hydrophilic colloid and add the resultant dispersion to an emulsion. These dyes can be added to an emulsion at any timing during the preparation of an emulsion, which is conventionally known to be useful. That is, the dyes can be added to an emulsion before or during grain formation of a silver halide, immediately after grain formation and before washing, before or during chemical sensitization, immediately after chemical sensitization and before the emulsion is set by cooling, or during preparation of a coating solution. Most ordinarily, the addition is performed after the completion of chemical sensitization and before coating. As described in U.S. Pat. Nos. 3,628,969 and 4,225,666, the dyes can be added simultaneously with chemical sensitizers to perform spectral sensitization and chemical sensitization at the same time. Also, spectral sensitization can be performed prior to chemical sensitization as described in JP-A 58-113928, or started by adding the dyes before the completion of precipitation formation of silver halide grains. Furthermore, the spectral sensitizing dyes can be separately added as disclosed in U.S. Pat. No. 4,225,666. That is, it is possible to add a portion of the dyes prior to chemical sensitization and the rest of the dyes after the chemical sensitization. As discussed above, the dyes can be added at any point during grain formation of a silver halide, including a method disclosed in U.S. Pat. No. 4,183,756. Of these addition timings, the sensitizing dyes are preferably added before washing of an emulsion or before chemical sensitization.

The addition amount of these spectral sensitizing dyes widely varies in accordance with the intended use, and the amount is preferably $0.5\times10^{-6}$ mol to $1.0\times10^{-2}$ mol, and more preferably $1.0\times10^{-6}$ mol to $5.0\times10^{-3}$ mol per mol of a silver halide.

In the present invention, when sensitizing dyes having spectral sensitization sensitivity particularly from the red region to the infrared region is used, it is preferable to simultaneously use compounds described in JP-A 2-157749, page 13, lower right column to page 22, lower right column. By the use of these compounds, the storage stability of the sensitive material and the stability and the supersensitizing effect of the processing can be specifically increased. Of these compounds, it is particularly preferable to simultaneously use compounds represented by formulas (IV), (V), and (VI) in the patent cited above. The use amount of these compounds is $0.5\times10^{-5}$ mol to $5.0\times10^{-2}$ mol, preferably $5.0\times10^{-5}$ mol to $5.0\times10^{-3}$ mol per mol of a silver halide. An advantageous use amount is 0.1 to 10,000 times, preferably 0.5 to 5,000 times per mol of a sensitizing dye.

In addition to a print system using a common negative printer, the sensitive materials of the present invention are preferably used in digital scanning exposure using monochromatic high-density light, e.g., a gas laser, a light emitting diode, a semiconductor laser, or a second harmonic generating light source (SHG) which is a combination of a semiconductor laser, or a solid state laser using a semiconductor laser as an exciting light source, and a nonlinear optical crystal. To make the system compact and inexpensive, it is preferable to use a semiconductor laser or a second harmonic generating light source (SHG) which is a combination of a semiconductor laser or a solid state laser and a nonlinear optical crystal. In particularly, to design an apparatus which is compact and inexpensive and has a long lifetime and a high stability, the use of a semiconductor laser is preferable, and so it is desirable that a semiconductor laser be used as at least one of exposure light sources.

When such a scanning exposer source is used, the spectral sensitivity peak of the sensitive material of the present invention can be freely set in accordance with the wavelength of the scanning exposure light source used. Since the oscillation wavelength of a laser can be halved by a solid state layer using a semiconductor laser as an exciting light source or an SHG light source obtained by combining a semiconductor laser and a nonlinear optical crystal, blue light and green light can be obtained. Accordingly, the spectral sensitivity peak of the sensitive material can be imparted to usual three regions of blue, green, and red. To use a semiconductor laser in order to make an apparatus inexpensive, compact, and stable, at least two layers preferably have a spectral sensitivity peak of 670 nm or more. This is so because the emission wavelength region of group III–V semiconductor lasers which are available, inexpensive, and stable presently exists only from the red region to the infrared region. On a laboratory level, however, oscillations of group II–VI semiconductor lasers in the green and blue regions were observed. Therefore, it is well expected that these semiconductor lasers can be used inexpensively and stably when the semiconductor laser manufacturing techniques advance. If this is the case, it becomes less necessary that at least two layers have a spectral sensitivity peak of 670 nm or more.

In scanning exposure like this, a time during which a silver halide in a sensitive material is exposed is a time required to exposure a certain micro area. As this micro area, a minimum unit by which a light quantity is controlled by digital data is generally used, and this is called a pixel. Accordingly, an exposure time per pixel changes in accordance with the size of a pixel. The size of a pixel depends upon a pixel density and is practically 50 to 2,000 dpi. When an exposure time is defined as a time required to expose a pixel size when this pixel density is 400 dpi, the exposure time is preferably $10^{-4}$ sec or less, and more preferably $10^{-6}$ sec or less.

In the present invention, a colored layer which can be decolored by processing is used together with a water-soluble dye. A colored layer which can be decolored by processing used can be so arranged in contact with an emulsion layer directly or via an interlayer containing a processing color amalgamation inhibitor such as gelatin or hydroquinone. This colored layer is preferably arranged as an underlying layer (on the support side) of an emulsion layer which generates the same primary color as the color of the colored layer. It is possible to arrange colored layers of all primary colors and selectively arrange some of these colored layers. It is also possible to arrange a colored layer which is so colored to have a plurality of primary color regions. The optical reflection density of the colored layer at a wavelength at which the optical density is highest in a wavelength region (the visible light region of 400 to 700 nm in common printer exposure and the wavelength of a scanning exposure light source used when scanning exposure is performed) used in exposure is preferably 0.2 to 3.0, more preferably 0.5 to 2.5, and most preferably 0.8 to 2.0.

The colored layer can be formed by using conventionally known methods singly or together. Examples are a method in which a dye in the form of a solid state fine grain dispersant, such as a dye described in JP-A 2-282244, page 3, upper right column to page 8 or a dye described in JP-A 3-7931, page 3, upper right column to page 11, lower left column, is contained in a hydrophilic colloid layer, a method by which an anionic dye is mordanted into a cation polymer, a method in which a dye is adsorbed to fine grains of, e.g., a silver halide and fixed in a layer, and a method using colloid silver described in JP-A 1-239544. As a method of dispersing a fine powder of a dye in the form of a solid, a method in which a fine powder dye which is essentially insoluble in water at least at a pH of 6 or less and essentially soluble in water at least at a pH of 8 or more is contained in a layer is described in JP-A 2-308244, pages 4 to 13. Also, a method of mordanting an anionic dye into a cation polymer is described in, e.g., JP-A 2-84637, pages 18 to 26. Methods of preparing colloid silver as a light absorbing agent are described in U.S. Pat. Nos. 2,688,601 and 3,459,563. Of these methods, the method in which a fine powder dye is contained in a layer and the method using colloid silver are preferable.

Gelatin can be advantageously used as a binder or a protective colloid usable in the sensitive materials of the present invention. However, a hydrophilic colloid other than gelatin can be used singly or together with gelatin. Gelatin is preferably low-calcium gelatin whose calcium content is preferably 800 ppm or less, and more preferably 200 ppm or less. To prevent various fungi and bacteria which breed in a hydrophilic colloid layer and degrade images, it is preferable to add antifungal agents such as described in JP-A 63-271247.

When the sensitive material of the present invention is printer-exposed, the use of a band stop filter described in U.S. Pat. No. 4,880,726 is preferable. This removes optical color amalgamation and significantly improves the color reproducibility.

As a support used in the present invention, it is possible to use any transmitting or reflecting support, such as glass, paper, or a plastic film, which can be coated with a photographic emulsion. Examples of the plastic film used in the present invention are a polyethyleneterephthalate film, a polyethylenenaphthalate film, polyester films such as cellulose triacetate and cellulose nitrate films, a polyamide film, a polycarbonate film, and a polystyrene film.

A "reflecting support" usable in the present invention is a support which improves the reflecting properties to make dye images formed in silver halide emulsion layers clear. This reflecting support includes a material in which a support is coated with a hydrophobic resin which contains a dispersion of a light reflecting substance such as titanium oxide, zinc oxide, calcium oxide, or calcium sulfate, and a material in which a hydrophobic resin containing a dispersion of a light reflecting substance is directly used as a support. Examples are polyethylene coated paper, polyester coated paper, polypropylene-based synthetic paper, and a support having a reflecting layer or a reflective substance, e.g., a glass plate, a polyethyleneterephthalate film, polyester films such as cellulose triacetate and cellulose nitrate films, a polyamide film, a polycarbonate film, a polystyrene film, and a vinyl chloride resin. As the polyester coated paper, polyester coated paper containing polyethyleneterephthalate as its main constituent described in EP 0,507,489 is preferably used.

A reflecting support usable in the present invention is preferably a paper support whose both surfaces are coated with water-resistant resin layers, in which at least one of the water-resistant resin layers contains white pigment fine grains. The white pigment grains are contained at a density of preferably 12 wt % or more, and more preferably 14 wt % or more. As the light reflecting white pigment, it is preferable to well knead a white pigment in the presence of a surfactant and process the surfaces of the pigment grains with divalent to tetravalent alcohol.

In the present invention, a support having a surface with a diffuse reflectance of the second kind can be preferably used. The diffuse reflectance of the second kind is a diffuse reflectance obtained by dividing a surface having a mirror surface into mirror surfaces in different directions by forming fine projections and recesses on the surface, and dispersing the directions of the fine surfaces (mirror surfaces) thus divided. The three-dimensional average roughness of projections and recesses formed on a surface having the diffuse reflectance of the second kind with respect to a central surface is 0.1 to 2 μm, preferably 0.1 to 1.2 μm. Details of this support are described in JP-A 2-239244.

As a method of developing an exposed sensitive material incorporating the reducing agent for color formation of the present invention, it is possible to use an activator processing method by which development is performed by an alkaline processing solution containing no color developing agent, a method by which development is performed by a processing solution containing an auxiliary developing agent/a base, a method in which the alkaline processing solution is developed into a sensitive material by using a diffusion transfer method, and a heat development method.

The activator processing is a processing method in which the reducing agent for color formation is incorporated into a sensitive material and the material is developed with a processing solution containing no color developing agent. In the present invention, an "activator solution" is characterized in that the solution does not essentially contain a p-phenylenediamine-based color developing agent which is conventionally used. The activator solution can contain other components (e.g., alkali, halogen, and a chelating agent). To maintain the processing stability, it is in some cases preferable that no reducing agent be contained. If this is the case, it is preferable that the activator solution do not essentially contain an auxiliary developing agent, hydroxyamines, and sulfite.

"Do not essentially contain" means that the content is preferably 0.5 mmol/l or less, and more preferably 0.1 mmol/l or less. It is particularly preferable that these components be not contained at all. The pH of the alkaline processing solution is preferably 9 to 14, and most preferably 10 to 13.

Sensitive materials for the activator processing and the processing itself are described in, e.g., JP-A 7-63572, 7-334190, 7-334192, 7-334197, and 7-344396.

The development of an alkaline processing solution using a diffusion transfer method is known to those skilled in the art as an instant processing system. In this method, an alkaline processing solution is developed to have a thickness of 500 μm or less, preferably 50 to 200 μm in a sensitive material having, on the same support or different supports, a sensitive element consisting of at least one sensitive layer/dye forming layer (the sensitive layer and the dye forming layer are preferably the same layer) and an image receiving element having a mordant layer for capturing and mordanting a diffusive dye formed by the sensitive layer/dye forming layer.

When an auxiliary developing agent is incorporated, it is preferable that the alkaline processing solution do not contain an auxiliary developing agent in order to manufacture and store the processing solution.

In the diffusion transfer method, the pH of the alkaline processing solution is preferably 10 to 14, and most preferably 12 to 14.

Processes of instant sensitive materials are described in "The Theory of Photographic Process", the 4th ed. (1977, Macmillan), and practical arrangements of film units are described in JP-A 63-226649. Materials contained in these film units and layers containing the materials will be described below.

A dye image receiving layer and mordants contained in this layer are described in JP-A 61-252551 and U.S. Pat. Nos. 2,548,564, 3,756,814, 4,124,386, and 3,625,694. A neutralizing layer for decreasing the pH of a sensitive material after the alkaline processing solution is developed is described in JP-B 7-122753, U.S. Pat. No. 4,139,383, and RD No. 16102. A timing layer used in combination with the neutralizing layer is described in JP-A 54-136328 and U.S. Pat. Nos. 4,267,262, 4,009,030, and 4,268,604. Although any arbitrary emulsion can be used, examples of an autopositive emulsion suitable for photographic light-sensitive materials are described in JP-A 7-333770 and 7-333771.

In addition, it is possible, where necessary, to arrange a light shielding layer, reflecting layer, an interlayer, an isolating layer, an ultraviolet absorbing layer, a filter layer, an overcoat layer, and a contact improving layer.

A processing solution for processing the above sensitive material contains processing components necessary for development and is generally evenly developed on the sensitive material after being added with a thickening agent. Preferable examples of the thickening agent are thixotropic substances such as carboxymethylcellulose and hydroxyethylcellulose.

Details of the sensitive layer and the processing solution are described in JP-A 7-333771.

Heating processing in heat development of a sensitive material is known to those skilled in the art and applied to the sensitive materials of the present invention as well. Heat development sensitive materials and their processes are described in The Basis of Photographic Engineering, (CORONA PUBLISHING CO., LTD., 1979), pages 553 to 555, Picture Information, page 40, April 1978, Nebletts Handbook of Photography and Reprography 7th Ed. (Van Nostrand and Reinhold Company), pages 32 and 33, U.S. Pat. Nos. 3,152,904, 3,301,678, 3,392,020, and 3,457,075, British Patents 1,131,108 and 1,167,777, and Research Disclosure June 1978, pages 9 to 15 (RD-17029).

To accelerate silver development and a dye formation reaction, it is preferable to apply to the sensitive materials of the present invention base precursors described in U.S. Pat. Nos. 4,514,493 and 4,657,848 and Known Techniques Vol. 5 (Mar. 22, 1991, published by Aztec Limited Responsibility Company), pages 55 to 86, and base generation methods described in EP 210,660 and U.S. Pat. No. 4,740,445.

To accelerate heat development, thermal solvents described in U.S. Pat. Nos. 3,347,675 and 3,667,959 can also be added to the sensitive materials of the present invention.

When the sensitive material of the present invention is heated, it is also preferable to perform the heating processing by making the sensitive material or a processing sheet contain any of water, an aqueous solution containing an inorganic alkali metal salt or an organic base, a low-boiling-point solvent, and a solvent mixture of a low-boiling-point solvent and water or the basic aqueous solution, in order to accelerate development and/or diffuse and transfer the processing materials. Methods using water are described in JP-A 63-144354, 63-144355, 62-38460, 3-210555, 62-253159, and 63-85544, EP 210,660, and U.S. Pat. No. 4,740,445.

The present invention is also applicable to heat development sensitive materials and heat development image formation methods described in JP-A 7-261336, 7-268045, 8-30103, 8-46822, and 8-97344.

Although the heating temperature in the heat development step is approximately 50° C. to 200° C., a temperature of 60° C. to 150° C. is particularly useful. When a solvent is used, the heating temperature is preferably equal to or lower than the boiling point of the solvent.

The activator processing method used in the present invention will be described in more detail below. In the present invention, sensitive materials are subjected to development (silver development/cross oxidation of an incorporated reducing agent), desilvering, and washing or stabilization. After washing or stabilization, sensitive materials are sometimes subjected to processing, such as alkali impartment, for color enhancement.

When a sensitive material is developed in the present invention, a developer can contain a compound which functions as a developing agent for a silver halide and/or the oxidation product of which, generated by silver development, has a function of cross-oxidizing the reducing agent for color formation incorporated into the sensitive material. Pyrazolidones, dihydroxybenzenes, reductones, and aminophenols are preferably used, and pyrazolidones are most preferably used.

Pyrazolidones are preferably 1-phenyl-3-pyrazolidones. Examples are 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-phenyl-5-phenyl-3-pyrazolidone, 1-p-tolyl-4-methyl-4-hydroxymethyl-3-pyrazolidone, 1-p-chlorophenyl-4-methyl-4-hydroxymethyl-3-pyrazolidone, 1-phenyl-2-hydroxymethyl-4,4-dimethyl-3-pyrazolidone, 1-phenyl-2-acetyl-3-pyrazolidone, and 1-phenyl-2-hydroxymethyl-5-phenyl-3-pyrazolidone.

Examples of dihydroxybenzenes are hydroquinone, chlorohydroquinone, bromohydroquinone, isopropylhydroquinone, methylhydroquinone, 2,3-dichlorohydroquinone, 2,5-dichlorohydroquinone, 2,5-dimethylhydroquinone, and potassium hydroquinonemonosulfonate.

Reductones are preferably ascorbic acid and its derivative, and compounds described in JP-A 6-148822, pages 3 to 10 are used. Sodium L-ascorbate and sodium erysorbinate are particularly preferable.

Examples of p-aminophenols are N-methyl-p-aminophenol, N-(β-hydroxyethyl)-p-aminophenol, N-(4-hydroxyphenyl)glycine, and 2-methyl-p-aminophenyl.

Although these compounds are commonly used singly, it is also preferable to use two or more types together in order to increase the development activity and the cross oxidation activity.

The use amount of these compounds in a developer is $2.5\times10^{-4}$ mol/l to 0.2 mol/l, preferably 0.0025 mol/l to 0.1 mol/l, and more preferably 0.001 mol/l to 0.05 mol/l.

Examples of a preservative used in the developer of the present invention are sodium sulfite, potassium sulfite, lithium sulfite, ammonium sulfite, sodium bisulfite, potassium metabisulfite, sodium bisulfite formaldehyde, and hydroxyamineysulfate. The use amount is 0.1 mol/l or less, preferably 0.001 to 0.02 mol/l. When a high-silver chloride emulsion is used in a sensitive material, the amount of the compound is 0.001 mol/l or less, and the compound is preferably not at all contained.

In the present invention, it is preferable to use diethylhydroxylamine, dialkylhydroxylamines described in JP-A 4-97355, or an organic preservative, instead of hydroxylamine or sulfurous acid ion.

In the present invention, a developer contains halogen ion such as chlorine ion, bromine ion, or iodine ion.

The halide can be directly added to a developer or eluted from a sensitive material into a developer during development.

The pH of the developer used in the present invention is preferably 8 to 13, and more preferably 9 to 12.

To hold the above pH value, the use of various buffer solutions is preferable. Preferable examples are carbonate, phosphate, tetraborate, and hydroxy benzoate.

The addition amount of the buffering agent to a developer is preferably 0.05 mol/l or more, and most preferably 0.1 to 0.4 mol/l.

In addition, a developer can contain various chelating agents as an agent for preventing precipitation of calcium or magnesium or to improve the stability of the developer.

The addition amount of these chelating agents need only be an amount by which metal ion in a developer is hidden. For example, the addition amount is about 0.1 g to 10 g per liter.

In the present invention, an arbitrary antifoggant can be added where necessary. Examples of the antifoggant are alkali metal halides such as sodium chloride, potassium bromide, and potassium iodide, and a nitrogen-containing heterocyclic compound.

The addition amount of the nitrogen-containing heterocyclic compound is $1\times10^{-5}$ to $1\times10^{-2}$ mol/l, preferably $2.5\times10^{-5}$ to $1\times10^{-3}$ mol/l.

An arbitrary development accelerator can be added to a developer.

A developer preferably contains a brightening agent. The use of a 4,4-diamino-2,2'-disulfostilbene-based compound is particularly preferable.

The processing temperature of a developer applied to the present invention is 20° to 50° C., preferably 30° to 45° C. The processing time is 5 sec to 2 min, preferably 10 sec to 1 min. Although the replenishment amount is preferably as small as possible, it is 15 to 600 ml, preferably 25 to 200 ml, and more preferably 35 to 100 ml per $m^2$ of a sensitive material.

Desilvering is performed after development. In the desilvering processing, only fixing is performed or both bleaching and fixing are performed. When both bleaching and fixing are performed, the bleaching processing and the fixing processing can be performed separately or simultaneously (bleach-fix processing). It is also possible to perform processing in two continuous bleach-fix baths, perform the fixing processing before the bleach-fix processing, or perform bleach-fix after the bleach-fix processing in accordance with the intended use.

It is in some cases preferable to perform stabilization after development without performing desilvering, thereby stabilizing silver salt or dye images.

After development, it is possible to perform image reinforcing processing (intensification) using peroxides, halogenous acids, iodoso compounds, and cobalt(III) complex compounds described in West German Patents (OLS) 1,813,920, 2,044,993, and 2,735,262, and JP-A 48-9728, 49-84240, 40-102314, 51-53826, 52-13336, and 52-73731. To further enhance image reinforcement, it is also possible to add an oxidizer for image reinforcement to the developer and simultaneously perform development and image intensification in a single bath. Hydrogen peroxide is particularly preferably because of its high amplification factor. Since these image intensification methods can greatly reduce the silver amount of a sensitive material, no bleaching is necessary and silver (or silver salt) is not discharged in, e.g., stabilization. Accordingly, these methods are preferable to protect the environment.

Examples of the bleaching agent used in a bleaching solution or a bleach-fix bath are compounds of multivalent metals such as iron(III), cobalt(III), chromium(IV), and copper(II), peracids, quinones, and nitro compounds.

Of these compounds, aminopolycarboxylic acid iron(III) such as ethylenediaminetetraacetic acid iron(III) complex and 1,3-diaminopropanetetraacetic acid iron(III) complex, hydrogen peroxide, and persulfate are preferable to achieve rapid processing and prevent environmental contamination.

The pH of a bleaching solution or a bleach-fix bath using these aminopolycarboxylic acid iron(III) complexes is 3 to 8, and preferably 5 to 7. The pH of a bleaching solution using persulfate or hydrogen peroxide is 4 to 11, preferably 5 to 10.

A bleaching accelerator can be used as needed in a bleaching solution, a bleach-fix bath, and their pre-baths.

In a bleaching solution, a bleach-fix bath, and a fixing solution, conventionally known additives such as a rehalogenating agent, a pH buffering agent, and a metal corrosion inhibiting agent can be used. To prevent bleach stain, it is particularly preferable to add an organic acid having an acid dissociation constant (pKa) of 2 to 7.

Examples of the fixing agent used in a fixing solution or a bleach-fix bath are thiosulfate, thiocyanate, thioureas, a large amount of iodide salt, and a nitrogen-containing heterocyclic compound having a sulfide group, a mesoion-based compound, and a thioether-based compound described in JP-A 4-365037, pages 11 to 21, and JP-A 5-66540, pages 1088 to 1092.

As a preservative in a fixing solution or a bleach-fix bath, sulfite, bisulfite, a carbonyl bisulfite adduct, or a sulfinic acid compound described in EP 294,769A is preferable.

A fixing solution or a bleach-fix bath can further contain various brightening agents; anti-foaming agents; surfactants; polyvinylpyrrolidone; and methanol.

The processing temperature in the desilvering step is 20° to 50° C., preferably 30° to 45° C. The processing time is 5 sec to 2 min, preferably 10 sec to 1 min. Although the replenishment amount is preferably as small as possible, it is 15 to 600 ml, preferably 25 to 200 ml, and more preferably 35 to 100 ml per $m^2$ of a sensitive material. It is also preferable to perform processing with no replenishment except that an evaporation loss is replenished with water.

The sensitive materials of the present invention are generally washed after being desilvered. When stabilization is performed, washing can be omitted. In this stabilization, it is possible to use any of methods described in JP-A 57-8543, 58-14834, and 60-220345, and known methods described in JP-A 58-127926, 58-137837, and 58-140741. It is also possible to perform washing-stabilization, represented by processing of photographic color sensitive materials, in which a stabilizing bath containing dye stabilizers and surfactants is used as a final bath.

A washing solution and a stabilizing solution can contain sulfite; water softeners such as inorganic phosphoric acid, polyaminocarboxylic acid, and organic aminophosphonic acid; metal salts such as Ma salt, Al salt, and Bi salt; surfactants; film hardeners; pH buffering agents; brighteners; and silver salt forming agents such as nitrogen-containing heterocyclic compounds.

Examples of the dye stabilizer in the stabilizing solution are aldehydes such as formalin and glutaraldehyde, an N-methylol compound, hexamethylenetetramine, and an aldehyde sulfurous acid adduct.

The pH of the washing solution and the stabilizing solution is 4 to 9, preferably 5 to 8. The processing temperature is 15° to 45° C., preferably 25° to 40° C. The processing time is 5 sec to 2 min, preferably 10 to 40 sec.

Overflow solutions produced by replenishment of the washing solution and/or the stabilizing solution can be reused in other steps such as the desilvering step.

The amounts of the washing water and/or the stabilizing solution can be set over a broad range in accordance with various conditions. However, the replenishment amount is preferably 15 to 360 ml, and more preferably 25 to 120 ml per $m^2$ of a sensitive material. To reduce this replenishment amount, replenishment is preferably performed by a multi-stage counterflow method by using a plurality of tanks.

In the present invention, water obtained by processing an overflow solution or a tank solution through a reverse osmotic film can be used to save water. For example, the processing using reverse osmosis is preferably performed for water in the second and the subsequent tanks in multi-stage counterflow washing and/or stabilization.

In the present invention, stirring is preferably maximally strengthened. Examples of the method of strengthening the stirring are methods described in JP-A 62-183460 and 62-183461 in which a jet stream of the processing solution is collided against the emulsion surface of a sensitive material, a method described in JP-A 62-183461 in which the stirring effect is enhanced by using a rotating means, a method in which the stirring effect is enhanced by moving a sensitive material while the emulsion surface is brought into contact with a wiper blade provided in the solution, thereby forming a turbulence on the emulsion surface, and a method of increasing the circulating flow amount of a whole processing solution. These stirring improving means are useful in any of a developer, a bleaching solution, a fixing solution, a bleach-fix bath, a stabilizing solution, and a washing solution. These methods are effective to accelerate the supply of effective components from a solution to a sensitive material and the diffusion of unnecessary components in a sensitive material.

The present invention exhibits excellent performance regardless of the state of a solution aperture [air contact area ($cm^2$)/solution volume ($cm^3$)] of any bath. However, the solution aperture is preferably 0 to 0.1 $cm^{-1}$ for the stability of solution components. In continuous processing, the solution aperture is practically preferably 0.001 to 0.05 $cm^{-1}$, and more preferably 0.002 to 0.03 $cm^{-1}$.

An automatic developing machine used for the sensitive materials of the present invention preferably has a sensitive material conveying means described in any of JP-A 60-191257, 60-191258, and 60-191259. A conveying means of this sort can significantly reduce the amount of a processing solution carried over from a pre-bath to a post-bath and therefore has a remarkable effect of preventing deterioration of the performance of the processing solution. This effect is particularly effective to shorten the processing time of each step and reduce the replenishment amount of a processing solution. To shorten the processing time, it is preferable to shorten a crossover time (time in the air). Preferable examples are a method described in FIG. 4, 5, or 6 of JP-A 4-86659 and a method described in FIG. 4 or 5 of JP-A 5-66540, in which a sensitive material is conveyed from one processing to another via a blade having a shielding effect.

Also, when each processing solution is concentrated by evaporation in continuous processing, it is preferable to compensate for the concentration by adding water.

In the present invention, the processing time of a step means a time from the start of processing for a sensitive material in a certain step to the start of processing in the next step. An actual processing time in an automatic developing machine is usually determined by the linear velocity and the volume of a processing bath. In the present invention, an example of the linear velocity is 500 to 4,000 mm/min. Especially in the case of a small-sized developing machine, 500 to 2,500 mm/min is preferable.

The processing time of all processing steps, i.e., from the development step to the drying step is preferably 360 sec or less, more preferably 120 sec or less, and most preferably 90 to 30 sec. This processing time is a time from the timing at which a sensitive material is dipped into a developer to the timing at which the material comes out from a drying section of the processing machine.

Various additives are used in the processing agents related to this technique, and details of these additives are described in Research Disclosure Item 36544 (Sep. 1994). The corresponding portions are summarized below.

| Type of processing agent | Pages |
|---|---|
| Developing agents | 536 |
| Preservatives of developing agents | 537, left column |
| Antifoggants | 537 |
| Chelating agents | 537, right column |
| Buffering agents | 537, right column |
| Surfactants | 538, left column to 539, left column |
| Bleaching agents | 538 |
| Bleaching accelerators | 538, right column to 539, left column |
| Chelating agents for bleaching | 539, left column |
| Rehalogenating agents | 539, left column |
| Fixing agents | 539, right column |
| Preservatives of fixing agents | 539, right column |
| Chelating agents for fixing | 540, left column |
| Surfactants for stabilization | 540, left side |
| Anti-scum agents for stabilization | 540, right side |
| Chelating agents for stabilization | 540, right side |
| Antibacterial and antifungal agents | 540, right side |
| Dye stabilizers | 540, right side |

The water saving technique in this technique is described in detail in Research Disclosure Item 36544 (Sep. 1994), page 540, right column to page 541, left column.

The sensitive materials of the present invention can also be used as so-called B/W sensitive materials by which images are obtained by conventional developed silver.

Examples of black-and-white sensitive materials to which the present invention is applicable are printing sensitive materials, microfilm sensitive materials, medical X-ray sensitive materials, and industrial X-ray sensitive materials. Medical X-ray sensitive materials are preferable among other sensitive materials.

Other various additives used in the manufacture of the photographic light-sensitive materials of the present invention are not particularly limited, and those descried in the following corresponding portions can be used.

| Items | Corresponding portions |
|---|---|
| 1) Silver halide emulsions and manufacguring method | JP-A 2-68539, page 8, lower right column, line 6 from the bottom to page 10, upper right column, line 12, JP-A 3-24537, page 2, lower right column, line 10 to page 6, upper right column, line 1, and page 10, upper left column, line 16 to page 11, lower left column, line 19, and JP-A 4-107442. |
| 2) Chemical Sensitization methods | JP-A 2-68539, page 10, upper right column, line 13 to upper left column, line 16, and JP-A 5-313282. |
| 3) Antifoggants stabilizers | JP-A 2-68539, page 10, lower left column, line 17 to page 11, upper left column, line 7, and page 3, lower left column, line 2 to page 4, lower left column. |
| 4) Color tone improving agents | JP-A 62-276539, page 2, lower left column, line 7 to page 10, lower left column, line 20, and JP-A 3-94249, page 6, lower left column, line 15 to page 11, upper right column, line 19. |
| 5) Spectral sensitizing dyes | JP-A 2-68539, page 4, lower right column, line 4 to page 8, lower right column. |
| 6) Surfactants antistatic agents | JP-A 2-68539, page 11, upper left column, line 14 to page 12, upper left column, line 9. |
| 7) Slip agents plasticizers | JP-A 2-68539, page 12, upper left column line 10 to upper right column, line 10, and page 14, lower left column, line 10 to lower right column, line 1. |
| 8) Film hardeners | JP-A 2-68539, page 12, lower left column, line 17 to page 13, upper right column, line 6. |
| 9) Supports | JP-A 2-68539, page 13, upper right column, lines 7 to 20. |
| 10) Crossover cut methods | JP-A 2-264944, page 4, upper right column, line 20 to page 14, upper right column. |
| 11) Dyes, mordants | JP-A 2-68539, page 13, lower left column, line 1 to page 14, lower left column, line 9, and JP-A 3-24537, page 14, lower left column to page 16, lower right column. |
| 12) Polyhydroxy benzenes | JP-A 3-39948, page 11, upper left column to page 12, lower left column, and EP 452772A. |
| 13) Layer arrangements | JP-A 3-198041. |
| 14) Development methods | JP-A 2-103037, page 16, upper right column, line 7 to page 19, lower left column, line 15, and JP-A 2-115837, page 3, lower right column, line 5 to page 6, upper right column, line 10. |

EXAMPLES

The present invention will be described in more detail below by way of its examples. However, the present invention is not limited to these examples.

Example-1

(Comparative example)

Formation of light-sensitive material incorporating reducing agent for color formation and auxiliary developing agent (1) Preparation of emulsified products containing couplers and reducing agent for color formations 22.5 g of a cyan color-forming coupler (ExC-1) described below and 27.8 g of a reducing agent for color formation (I-16) were dissolved in 52 g of a high-boiling-point organic solvent (Solv-1) and 73 cc of ethyl acetate. The solution was emulsion-dispersed in 420 cc of an aqueous 12% gelatin solution containing sodium dodecylbenzenesulfonate and citric acid to prepare an emulsified product A.

Emulsified products B and C were prepared following the same procedure as above except that the coupler was changed to a magenta color-forming coupler (ExM-1) and a yellow color-forming coupler (ExY-1), respectively. The amount of the coupler used in each light-sensitive material was experimentally obtained so that the highest sensitivity was obtained, and was so properly changed.

ExC-1

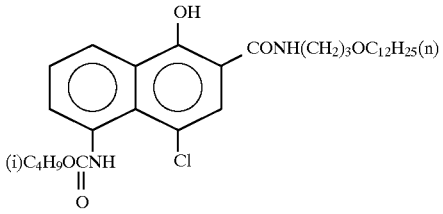

ExM-1

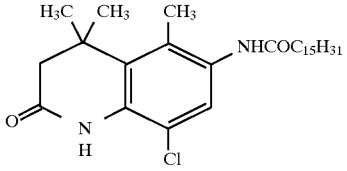

ExY-1

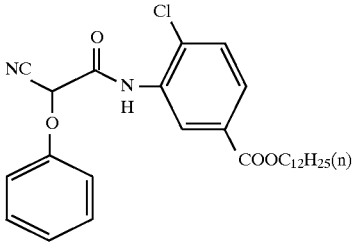

(2) Preparation of (100) silver chlorobromide tabular emulsions

Emulsions prepared by the following method were so color-sensitized as to have red, green, and blue sensitivities and prepared by a conventionally known method so that the respective optimum sensitivities were obtained. To use the resultant emulsions in high-, medium-, and low-speed layers, the sizes of silver halide grains were adjusted, and the emulsions were respectively optimally color-sensitized and chemically sensitized, thereby preparing emulsions.

The color sensitization was done by using sensitizing dyes ExS-1, ExS-2, and ExS-3 in the red-sensitive emulsions, sensitizing dyes ExS-4, ExS-5, and ExS-6 in the green-sensitive emulsions, and a sensitizing dye ExS-7 in the blue-sensitive emulsions.

1582 mg of an aqueous gelatin solution (containing 19.5 g of gelatin-1 (deionized alkali-processed bone gelatin whose methionine content was approximately 40 $\mu$mol/g) and 7.8 ml of a 1N $HNO_3$ solution, pH 4.3) and 13 ml of NaCl-1 solution (containing 10 g of NaCl in 100 ml) were placed in a reactor vessel. While the temperature was held at 40° C., 15.6 ml of Ag-1 solution (containing 20 g of $AgNO_3$ in 100 ml) and 15.6 ml of X-1 solution (containing 7.05 g of NaCl in 100 ml) were added at 62.4 ml/min by double jet. After the resultant solution was stirred for 3 min, 28.2 ml of X-2 solution (containing 1.1 g of KBr in 100 ml) was added at 80.6 ml/min by double jet. After the resultant solution was stirred for 3 min, 46.8 ml of the Ag-1 solution and 46.8 ml of the X-1 solution were added at 62.4 ml by double jet. After the resultant solution was stirred for 2 min, 203 ml of an aqueous gelatin solution (containing 13 g of gelatin-1, 1.3 g of NaCl, and a 1N NaOH solution for adjusting the pH to 6.5) was added, and the pCl was adjusted to 1.75. The temperature was raised to 65° C., the pCl was adjusted to 1.95, and the solution was ripened for 3 min. Thereafter, Ag-2 solution (containing 50 g of $AgNO_3$ in 100 ml) and X-4 solution (containing 16.4 g of NaCl and 2.5 g of KBr in 100 ml) were added by C. D. J. (Controlled Double Jet) for 20 min at a fixed flow rate until the addition amount of Ag-3 solution was 182 ml. Subsequently, fine AgBr grains having an average equivalent sphere diameter of 0.03 $\mu$m were added in an amount of 0.2 mol % per mol of a silver halide, and the resultant solution was ripened for 5 min to complete halogen conversion. A sedimenting agent was added and the temperature was lowered to 35° C. to perform sedimentation and washing. An aqueous gelatin solution was added, and the pH was adjusted to 6.0 at 60° C. TEM images of replicas of the grains were observed. The resultant emulsion consisted of silver chlorobromide (100) tabular grains based on silver and containing 6.95 mol % of AgBr. 85% of the projected area of all grains were occupied by tabular grains having an aspect ratio of 2 or more.

(3) Formation of multilayered coated sample

The emulsified products A to C and the emulsions described above were used to form a sensitive material by coating a triacetylcellulose transparent support with multiple layers having the following compositions by using a conventionally known method. This sample is called sample-101.

(Compositions of light-sensitive layers)

The main materials used in the individual layers are classified as follows.

ExC: Cyan coupler UV: Ultraviolet absorbent ExM: Magenta coupler HBS: High-boiling organic solvent ExY: Yellow coupler H: Gelatin hardener ExS: Sensitizing dye (In the following description, specific compounds are represented by symbols followed by numbers, and their formulas are presented later.)

The number corresponding to each component indicates the coating amount in units of g/m$^2$ (light-sensitive material). The coating amount of a silver halide is represented by the amount of silver. The coating amount of each sensitizing dye is represented in units of mols per mol of a silver halide in the same layer.

1st layer (Antihalation layer)

Black colloidal silver silver 0.09
Gelatin 1.60
ExF-1 $2.0\times10^{-3}$
Solid dispersion dye ExF-2 0.030
Solid dispersion dye ExF-3 0.040
HBS-1 0.15
HBS-2 0.02

2nd layer (Interlayer)

0.07 $\mu$m silver bromide silver 0.065 emulsion
Polyethylacrylate latex 0.20
Gelatin 1.04

3rd layer (Low-speed red-sensitive emulsion layer)

Silver chlorobromide silver 0.50 tabular emulsion
ExS-1 $6.0\times10^{-4}$
ExS-2 $3.2\times10^{-5}$
ExS-3 $9.0\times10^{-4}$
ExC-1 0.33
Reducing agent for color formation I-16 0.30
Cpd-2 0.025
HBS-1 0.10
Gelatin 0.87

4th layer (Medium-speed red-sensitive emulsion layer)

Silver chlorobromide silver 0.70 tabular emulsion

ExS-1 $4.5\times10^{-4}$
ExS-2 $2.0\times10^{-5}$
ExS-3 $6.5\times10^{-4}$
ExC-1 0.31
Reducing agent for color formation I-16 0.023
HBS-1 0.10
Gelatin 0.75

5th layer (High-speed red-sensitive emulsion layer)
Silver chlorobromide silver 1.40 tabular emulsion
ExS-1 $3.0\times10^{-4}$
ExS-2 $1.6\times10^{-5}$
ExS-3 $4.5\times10^{-4}$
ExC-1 0.175
Reducing agent for color formation I-16 0.15
Cpd-2 0.050
HBS-1 0.22
HBS-2 0.050
Gelatin 1.10

6th layer (Interlayer)
Auxiliary developing agent 0.07 precursor (ETA-15)
Cpd-1 0.090
Solid dispersion dye ExF-4 0.030
HBS-1 0.050
Polyethylacrylate latex 0.15
Gelatin 1.10

7th layer (Low-speed green-sensitive emulsion layer)
Silver chlorobromide silver 0.35 tabular emulsion
ExS-4 $3.8\times10^{-5}$
ExS-5 $2.9\times10^{-4}$
ExS-6 $9.8\times10^{-4}$
ExM-1 0.41
Reducing agent for color formation I-16 0.30
HBS-1 0.30
HBS-3 0.010
Gelatin 0.73

8th layer (Medium-speed green-sensitive emulsion layer)
Silver chlorobromide silver 0.80 tabular emulsion
ExS-4 $4.0\times10^{-5}$
ExS-5 $2.0\times10^{-4}$
ExS-6 $5.0\times10^{-4}$
ExM-1 0.18
Reducing agent for color formation I-16 0.15
HBS-1 0.13
HBS-3 $4.0\times10^{-3}$
Gelatin 0.80

9th layer (High-speed green-sensitive emulsion layer)
Silver chlorobromide silver 1.25 tabular emulsion
ExS-4 $7.9\times10^{-5}$
ExS-5 $1.4\times10^{-4}$
ExS-6 $0.4\times10^{-4}$
ExM-1 0.095
Reducing agent for color formation I-16 0.10
Cpd-3 0.040
HBS-1 0.25
Polyethylacrylate latex 0.15
Gelatin 1.33

10th layer (Yellow filter layer)
Yellow colloidal silver silver 0.015
Cpd-1 0.16
Solid dispersion dye ExF-5 0.060
Solid dispersion dye ExF-6 0.060
Oil-soluble dye ExF-7 0.010
Auxiliary developing agent 0.07 precursor (ETA-15)
HBS-1 0.60
Gelatin 0.60

11th layer (Low-speed blue-sensitive emulsion layer)
Silver chlorobromide silver 0.18 tabular emulsion
ExS-7 $4.0\times10^{-4}$
ExC-1 $7.0\times10^{-3}$
ExY-1 0.79
Reducing agent for color formation I-16 0.70
Cpd-2 0.10
Cpd-3 $4.0\times10^{-3}$
HBS-1 0.28
Gelatin 1.20

12th layer (High-speed blue-sensitive emulsion layer)
Silver chlorobromide silver 1.00 tabular emulsion
ExS-7 $2.0\times10^{-4}$
ExY-1 0.22
Reducing agent for color formation I-16 0.20
Cpd-2 0.10
Cpd-3 $1.0\times10^{-3}$
HBS-1 0.070
Gelatin 0.70

13th layer (1st protective layer)
UV-1 0.19
UV-2 0.075
UV-3 0.065
HBS-1 $5.0\times10^{-2}$
HBS-4 $5.0\times10^{-2}$
Gelatin 1.8

14th (2nd protective layer)
0.07 $\mu$m silver bromide silver 0.10 emulsion
H-1 0.40
B-1 (diameter 1.7 $\mu$m) $5.0\times10^{-2}$
B-2 (diameter 1.7 $\mu$m) 0.15
B-3 0.05
S-1 0.20
Gelatin 0.70

In addition to the above components, to improve the storage stability, processability, resistance to pressure, antifungal and antibacterial properties, antistatic properties, and coating properties, the individual layers contained W-1 to W-3, B-4 to B-6, iron salt, lead salt, gold salt, platinum salt, palladium salt, iridium salt, and rhodium salt.

The compounds used are presented below.

ExF-1
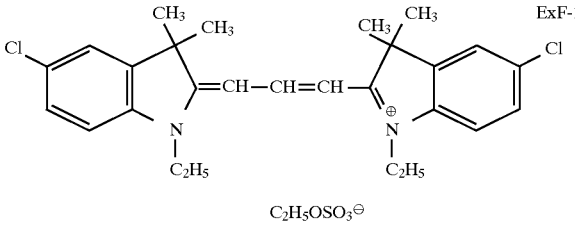
ExF-2
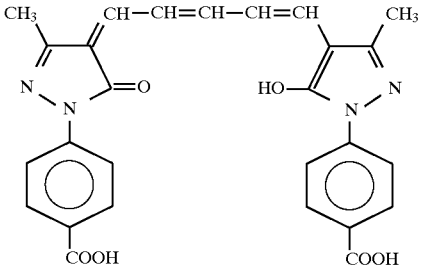
ExF-3
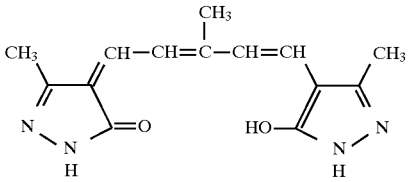
ExF-4
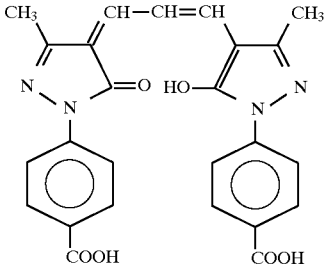
ExF-5
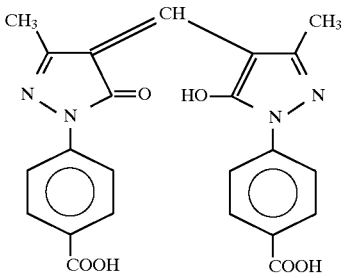
ExF-6
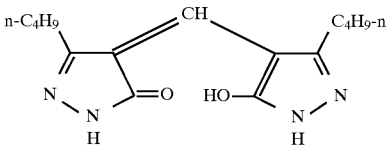
ExF-7
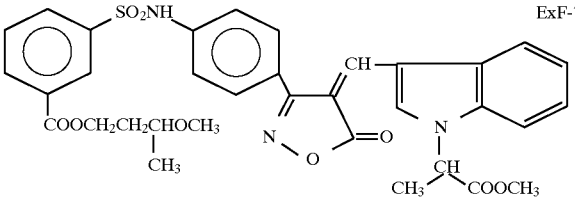
Cpd-1
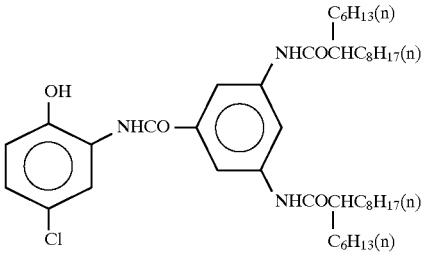
Cpd-2
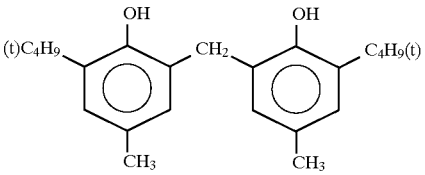
Cpd-3
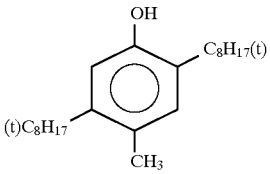
UV-1
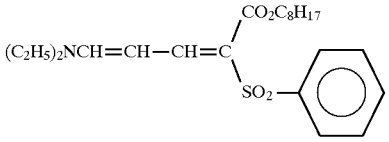
UV-2
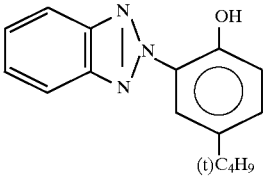
UV-3
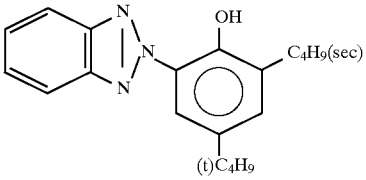
tricresyl phosphate
HBS-1

-continued
di-n-butyl phthalate
HBS-2
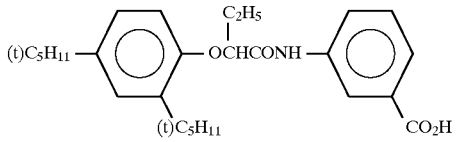
HBS-3
tri(2-ethylhexsyl)phosphate
HBS-4
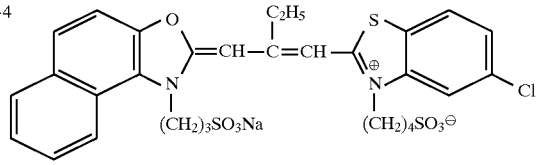
ExS-1
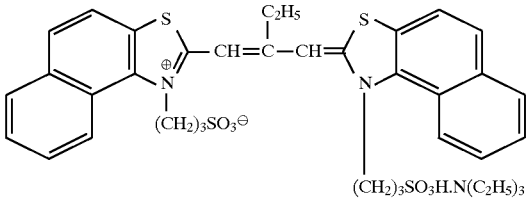
ExS-2
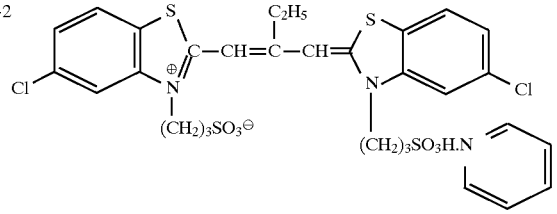
ExS-3
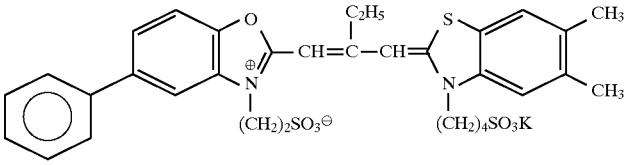
ExS-4
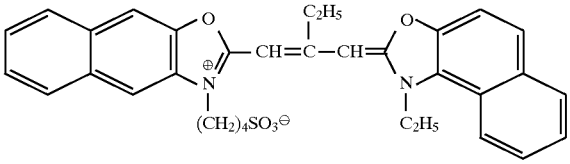
ExS-5
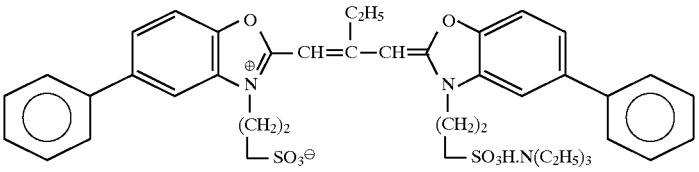
ExS-6
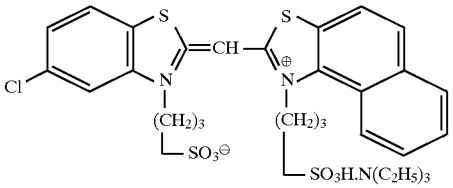
ExS-7
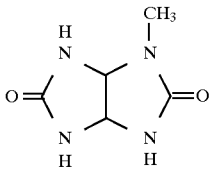
S-1
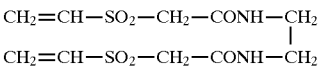
H-1
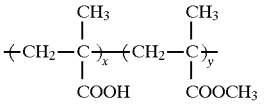
x/y = 10/90
(molar ratio)
(molecular weight about 35,000)
B-1
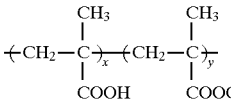
x/y = 40/60
(molar ratio)
(molecular weight about 20,000)
B-2
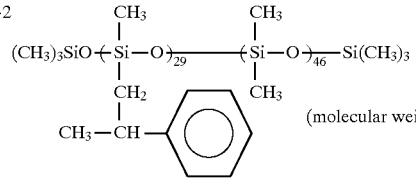
(molecular weight about 8,000)
B-3

-continued

B-4

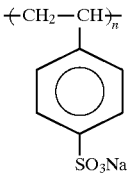

(molecular weight about 750,000)

Solv-1

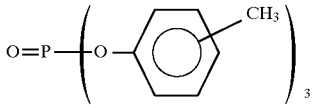

B-5

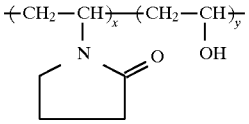

x/y = 70/30
(molar ratio)
(molecular weight about 17,000)

B-6

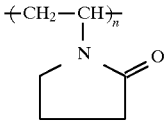

(molecular weight about 10,000)

W-1

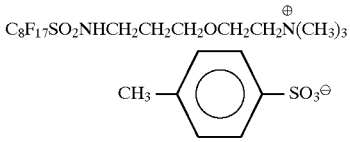

W-2

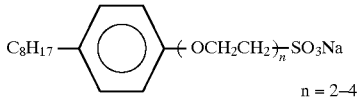

n = 2–4

W-3

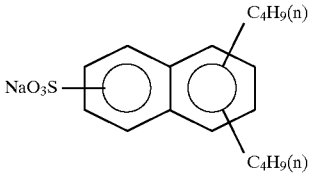

Example-2

(Present invention) Formation of light-sensitive materials containing photographic stabilizer compounds of group A.

Samples-201 to -205 were formed following the same procedures as for sample-101 in Example-1 except that the following photographic stabilizers were added to layers described below.

| Sample No. | Compound (stabilizer) | Addition amount (mmol/Ag mol) | Added layers |
|---|---|---|---|
| 201 | A-2 | 0.5 | layers 5, 9, and 12 |
| 202 | A-2 | 0.1 | layers 5, 9, and 12 |
| 203 | A-3 | 0.1 | layers 5, 9, and 12 |
| 204 | A-15 | 0.1 | layers 5, 9, and 12 |
| 205 | A-10 | 0.1 | layers 5, 9, and 12 |

Example-3

(Present invention) Formation of sensitive materials containing photographic stabilizer of group B.

Samples-301 to -305 were formed following the same procedures as for sample-101 in Example-1 except that the following photographic stabilizers were added to layers described below.

| Sample No. | Compound (stabilizer) | Addition amount (mmol/Ag mol) | Added layers |
|---|---|---|---|
| 301 | B-1 | 0.8 | layers 5, 9, and 12 |
| 302 | B-1 | 0.35 | layers 5, 9, and 12 |
| 303 | B-2 | 0.35 | layers 5, 9, and 12 |
| 304 | B-3 | 0.35 | layers 5, 9, and 12 |
| 305 | B-4 | 0.35 | layers 5, 9, and 12 |

Example-4

(Present invention) Formation of sensitive materials containing photographic stabilizer of group C.

Samples-401 to -405 were formed following the same procedures as for sample-101 in Example-1 except that the following photographic stabilizers were added to layers described below.

| Sample No. | Compound (stabilizer) | Addition amount (mmol/Ag mol) | Added layers |
|---|---|---|---|
| 401 | C-1 | 10.0 | layers 5, 9, and 12 |
| 402 | C-1 | 1.0 | layers 5, 9, and 12 |
| 403 | C-5 | 10.0 | layers 5, 9, and 12 |
| 404 | C-6 | 10.0 | layers 5, 9, and 12 |
| 405 | C-10 | 50.0 | layers 5, 9, and 12 |

Example-5

(Present invention) Formation of sensitive materials containing photographic stabilizer of group D.

Samples-501 to -505 were formed following the same procedures as for sample-101 in Example-1 except that the following photographic stabilizers were added to layers described below.

| Sample No. | Compound (stabilizer) | Addition amount (mmol/Ag mol) | Added layers |
|---|---|---|---|
| 501 | D-1 | 0.5 | layers 5, 9, and 12 |
| 502 | D-1 | 0.1 | layers 5, 9, and 12 |
| 503 | D-2 | 0.5 | layers 5, 9, and 12 |
| 504 | D-7 | 0.5 | layers 5, 9, and 12 |
| 505 | D-8 | 0.5 | layers 5, 9, and 12 |

Example-6

(Present invention) Formation of sensitive materials containing photographic stabilizer of group E.

Samples-601 to -604 were formed following the same procedures as for sample-101 in Example-1 except that the following photographic stabilizers were added to layers described below.

| Sample No. | Compound (stabilizer) | Addition amount (mmol/Ag mol) | Added layers |
|---|---|---|---|
| 601 | E-1 | 0.5 | layers 5, 9, and 12 |
| 602 | E-1 | 0.1 | layers 5, 9, and 12 |
| 603 | E-2 | 0.1 | layers 5, 9, and 12 |
| 604 | E-5 | 0.1 | layers 5, 9, and 12 |

Example-7

Exposure and processing of samples formed in Examples-1 to -6

Each sample was stored at 40° C. and a relative humidity of 70% for 16 hours and given wedge exposure through R, G, and B filters by using a sensitometer (manufactured by Fuji Photo Film Co. Ltd., FW type, color temperature of light source=4800° K.). The exposed samples were subjected to continuous processing by using the following processing steps and processing solution compositions until the tank volume of a developer was replenished. Each sample stored at 40° C. and a relative humidity of 70% was left to stand at 50° C. and a relative humidity of 70% for one week and similarly exposed and developed. The sensitivity and the minimum density of each resultant sample were measured.

The exposed samples were subjected to continuous processing by using the following processing steps and processing solution compositions until the tank volume of a developer was replenished.

| Processing step | Temperature | Replenishment rate* | Time | Tank volume (l) |
|---|---|---|---|---|
| Development | 40° C. | 30 ml | 20 sec | 1.0 |
| Bleach-fix | 40° C. | 30 ml | 15 sec | 1.0 |
| Rinse (1) | 30° C. | — | 3 sec | 0.3 |
| Rinse (2) | 30° C. | — | 3 sec | 0.3 |
| Rinse (3) | 30° C. | — | 3 sec | 0.3 |
| Rinse (4) | 30° C. | — | 3 sec | 0.3 |
| Rinse (5) | 30° C. | 60 ml | 3 sec | 0.3 |
| Alkali processing | 30° C. | 30 ml | 5 sec | 0.3 |
| Drying | 80° C. | | 10 sec | |

*Replenishment rate per $m^2$ of a light-sensitive material) (5-tank counterflow piping from rinse (5) to rinse (1))

In the above processing, water in rinse (4) was supplied by pressure to a reverse osmotic film. The transmitted water was supplied to rinse (5), and the concentrated water not transmitted through the reverse osmotic film was returned to rinse (4). To shorten the crossover time, blades were arranged between the rinse tanks and the samples were passed through these blades.

| | Tank solution | Replenisher |
|---|---|---|
| Developer-1 | | |
| Water | 800 ml | 800 ml |
| Tripotassium phosphate | 30 g | 39 g |
| 5-nitrobenzotriazole | 0.1 g | 0.25 g |
| Disodium-N,N-bis(sulfonate ethyl)hydroxylamine | 3.3 g | 6.6 g |
| Potassium chloride | 10 g | — |
| Hydroxyethylidene-1,1-diphosphonic acid (30% solution) | 4 ml | 4 ml |
| Water to make 1 l | pM 12.0 | |
| Bleach-fix solution | | |
| Water | 600 ml | 150 ml |
| Ammonium thiosulfate (700 g/l) | 100 ml | 250 ml |
| Ammonium sulfite.monohydrate | 40 g | 40 g |
| Ethylenediaminetetraacetic acid iron(III) ammonium | 77 g | 154 g |
| Ethylenediaminetetraacetic acid | 5 g | 10 g |
| Ammonium bromide | 10 g | 20 g |
| Acetic acid (50%) | 70 ml | 140 ml |
| Water to make | 1000 ml | 1000 ml |
| Rinse solution | | |
| Tap water | | |
| Alkali solution | | |
| Potassium carbonate | 30.0 g | |
| Water to make 1 l | pH 10.0 | |

After the samples were continuously processed under the respective conditions, the image densities of yellow, magenta, and cyan of each sample were measured through B, G, and R filters corresponding to these dyes, and the minimum density (Dmin) and the sensitivity of the sample were measured. Assuming the value of the comparative sample 101 when the sample was stored at 40° C. and a relative humidity of 70% for 16 hours was 100, relative values with respect to this value were calculated.

Table 2 shows the values of the cyan image density.

TABLE 2

| | Storing conditions | | | |
|---|---|---|---|---|
| | 40° C., 70%, 16 hours | | 50° C., 70%, 1 week | |
| Sample No. | Sensitivity (cyan) | Dmin (Cyan) | Sensitivity | Dmin |
| 101 (Comparison) | 100 | 100 | 25 | 350 |
| 201 (This invention) | 110 | 30 | 80 | 100 |
| 202 (This invention) | 130 | 60 | 70 | 180 |
| 203 (This invention) | 130 | 60 | 65 | 170 |
| 204 (This invention) | 150 | 50 | 70 | 150 |
| 205 (This invention) | 150 | 60 | 80 | 160 |
| 301 (This invention) | 120 | 40 | 75 | 150 |
| 302 (This invention) | 140 | 50 | 95 | 200 |
| 303 (This invention) | 110 | 80 | 50 | 250 |
| 304 (This invention) | 110 | 30 | 90 | 120 |
| 305 (This invention) | 170 | 50 | 80 | 200 |
| 401 (This invention) | 140 | 20 | 100 | 110 |
| 402 (This invention) | 105 | 90 | 30 | 300 |
| 403 (This invention) | 150 | 40 | 90 | 110 |
| 404 (This invention) | 140 | 50 | 80 | 120 |
| 405 (This invention) | 140 | 40 | 90 | 100 |
| 501 (This invention) | 120 | 20 | 95 | 110 |
| 502 (This invention) | 100 | 80 | 40 | 300 |
| 503 (This invention) | 130 | 30 | 100 | 100 |
| 504 (This invention) | 150 | 50 | 90 | 130 |
| 505 (This invention) | 160 | 60 | 100 | 100 |
| 601 (This invention) | 100 | 20 | 90 | 90 |
| 602 (This invention) | 130 | 50 | 100 | 120 |
| 603 (This invention) | 110 | 70 | 90 | 100 |
| 604 (This invention) | 120 | 80 | 80 | 100 |

The same effects were obtained for magenta and yellow.

Example-8

Formation of mordant-containing sensitive material (comparative example)

A light-sensitive material 801 containing a mordant P-37 was formed by changing the couplers used in the emulsion layers in Example-1.

Only the changed layers are shown below. Layers not described below were the same as those in Example-1.

Couplers ExC-2, ExM-2, and ExY-2 used are presented below.

5th layer (High-speed red-sensitive emulsion layer)

Silver chlorobromide silver 1.40 tabular emulsion
ExS-1 $3.0\times10^{-4}$
ExS-2 $1.6\times10^{-5}$
ExS-3 $4.5\times10^{-4}$
ExC-2 0.25
Reducing agent for color formation I-16 0.15
Cpd-2 0.050

ExC-2

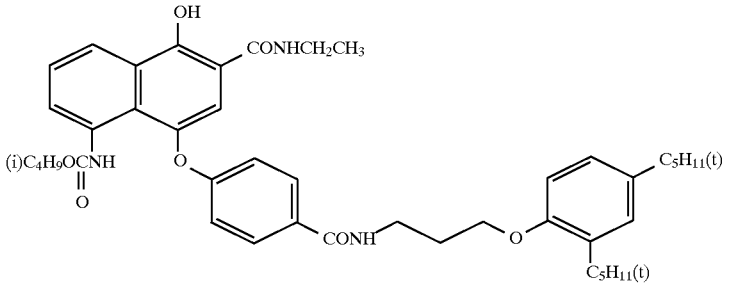

ExM-2

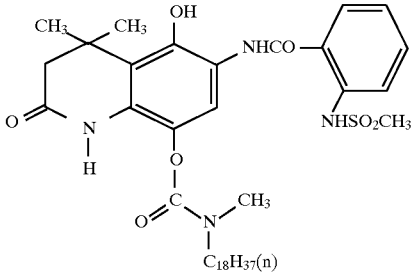

ExY-2

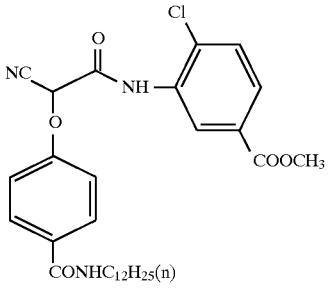

3rd layer (Low-speed red-sensitive emulsion layer)

Mordant P-37 3.21 g
Silver chlorobromide silver 0.50 tabular emulsion
ExS-1 $6.0\times10^{-4}$
ExS-2 $3.2\times10^{-5}$
ExS-3 $9.0\times10^{-4}$
ExC-2 0.85
Reducing agent for color formation I-16 0.30
Cpd-2 0.025
HBS-1 0.10
Gelatin 0.87

4th layer (Medium-speed red-sensitive emulsion layer)

Silver chlorobromide silver 0.70 tabular emulsion
ExS-1 $4.5\times10^{-4}$
ExS-2 $2.0\times10^{-5}$
ExS-3 $6.5\times10^{-4}$
ExC-2 0.80
Reducing agent for color formation I-16 0.023
HBS-1 0.10
Gelatin 0.75

HBS-1 0.22
HBS-2 0.050
Gelatin 1.10

7th layer (Low-speed green-sensitive emulsion layer)

Mordant P-27 3.21 g
Silver chlorobromide silver 0.35 tabular emulsion
ExS-4 $3.8\times10^{-5}$
ExS-5 $2.9\times10^{-4}$
ExS-6 $9.8\times10^{-4}$
ExM-2 0.82
Reducing agent for color formation I-16 0.30
HBS-1 0.30
HBS-3 0.010
Gelatin 0.73

8th layer (Medium-speed green-sensitive emulsion layer)

Silver chlorobromide silver 0.80 tabular emulsion
ExS-4 $4.0\times10^{-5}$
ExS-5 $2.0\times10^{-4}$
ExS-6 $5.0\times10^{-4}$ ExM-2 0.36
Reducing agent for color formation I-16 0.15
HBS-1 0.13
HBS-3 $4.0\times10^{-3}$
Gelatin 0.80

9th layer (High-speed green-sensitive emulsion layer)

Silver chlorobromide silver 1.25 tabular emulsion
ExS-4 $7.9\times10^{-5}$
ExS-5 $1.4\times10^{-4}$
ExS-6 $0.4\times10^{-4}$
ExM-2 0.21
Reducing agent for color formation I-16 0.10
Cpd-3 0.040
HBS-1 0.25
Polyethylacrylate latex 0.15
Gelatin 1.33

11th layer (Low-speed blue-sensitive emulsion layer)

Mordant P-27 3.2 g
Silver chlorobromide silver 0.18 tabular emulsion
ExS-7 $4.0\times10^{-4}$
ExC-1 $7.0\times10^{-3}$
ExY-2 0.79
Reducing agent for color formation I-16 0.70
Cpd-2 0.10
Cpd-3 $4.0\times10^{-3}$
HBS-1 0.28
Gelatin 1.20

12th layer (High-speed blue-sensitive emulsion layer)

Silver chlorobromide silver 1.00 tabular emulsion
ExS-7 $2.0\times10^{-4}$
ExY-2 0.22
Reducing agent for color formation I-16 0.20
Cpd-2 0.10
Cpd-3 $1.0\times10^{-3}$
HBS-1 0.070
Gelatin 0.70

Samples were formed by adding the same amounts of the same photographic stabilizers shown in Examples-2 to -6 to the same layers in the light-sensitive material 801 and exposed and processed following the same procedures as in Example-7 except that no alkali processing was performed before drying. When these samples were evaluated, similar effects of the photographic stabilizers were confirmed.

Example-9

Sensitive materials analogous to that of Example-8 were formed by replacing I-16 in the red-sensitive layers of Example-8 with I-1, I-6, and I-18.

When these samples were evaluated following the same procedures as in Example-8, similar effects of the photographic stabilizers were confirmed.

Example-10

I-16 in the red-sensitive layers of the sensitive material 101 in Example-1 was replaced with the following compound.

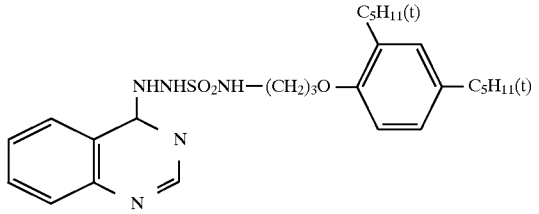

In addition, ExC-1 was replaced with the following compound to manufacture a sensitive material 1001.

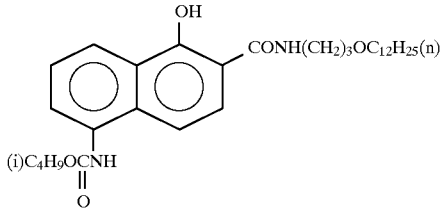

Samples were formed by adding the same photographic stabilizers as shown in Examples-2 to -6 to the fifth red-sensitive layer of the sensitive material 1001 and evaluated following the same procedures as in Example-7 except that only samples stored at 40° C. and a relative humidity of 70% for 16 hours were evaluated.

The evaluation results are shown in Table 3.

TABLE 3

| Sample No. | Stabilizer Speice Amount | 40° C., 70% Sensitivity (Cyan) | 16 hours Dmin (Cyan) |
|---|---|---|---|
| 101 | — | 100 | 100 |
| 1001 | — | 50 | 90 |
| 1201 | Same as Sample No. 201 | 10 | 30 |
| 1202 | Same as Sample No. 202 | 30 | 80 |
| 1203 | Same as Sample No. 203 | 35 | 80 |
| 1204 | Same as Sample No. 204 | 40 | 50 |
| 1205 | Same as Sample No. 205 | 40 | 90 |
| 1301 | Same as Sample No. 301 | 10 | 20 |
| 1302 | Same as Sample No. 302 | 15 | 30 |
| 1303 | Same as Sample No. 303 | 30 | 40 |
| 1304 | Same as Sample No. 304 | 20 | 40 |
| 1305 | Same as Sample No. 305 | 20 | 30 |
| 1401 | Same as Sample No. 401 | 40 | 70 |
| 1402 | Same as Sample No. 402 | 45 | 80 |
| 1403 | Same as Sample No. 403 | 40 | 75 |
| 1404 | Same as Sample No. 404 | 40 | 80 |
| 1405 | Same as Sample No. 405 | 35 | 85 |
| 1501 | Same as Sample No. 501 | 20 | 40 |
| 1502 | Same as Sample No. 502 | 30 | 60 |
| 1503 | Same as Sample | 20 | 50 |

TABLE 3-continued

| Sample No. | Stabilizer Speice Amount | 40° C., 70% Sensitivity (Cyan) | 16 hours Dmin (Cyan) |
|---|---|---|---|
| | No. 503 | | |
| 1504 | Same as Sample No. 504 | 30 | 60 |
| 1601 | Same as Sample No. 601 | 30 | 30 |
| 1602 | Same as Sample No. 602 | 20 | 50 |
| 1603 | Same as Sample No. 603 | 20 | 65 |
| 1604 | Same as Sample No. 604 | 40 | 80 |

It was found that when reducing agents other than those used in the present invention and the photographic stabilizers used in the present invention were combined, the sensitivity was significantly decreased to make the light-sensitive materials impractical.

Example-11

Formation of roentgen sample (comparative example)

(Preparation of auxiliary developing agent layer coating solution)

Auxiliary developing agent ETA-1 (methanol solution)

Auxiliary developing agent ETA-6 (solid fine grain dispersion)

were so coated that each developing agent was coated in an amount of $1\times10^{-2}$ mol per mol of a silver halide and that the gelatin coating amount was 0.5 g/m$^2$.

(Preparation of emulsion layer coating solution)

An emulsion layer coating solution was prepared by adding the following chemicals and the emulsified products shown in TABLE 3 per mol of a silver halide to a chemically sensitized emulsion.

Gelatin (including gelatin in 111 g emulsion)

Dextran 21.5 g (average molecular weight 39,000)

Sodium polyacrylate 5.1 g (average molecular weight 400,000)

Sodium polystyrenesulfonate 1.2 g (average molecular weight 600,000)

Film hardener 1,2-bis(vinylsulfonylacetamido)entha the addition amount was so adjusted that the swelling ratio was 230%

Compound-II 10.3 g

Compound-III 0.11 g

Compound-V 0.43 g pH was adjusted to 6.1 by NaOH

Compound II

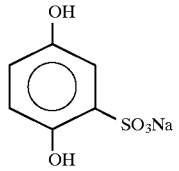

Compound III

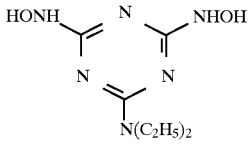

Compound V

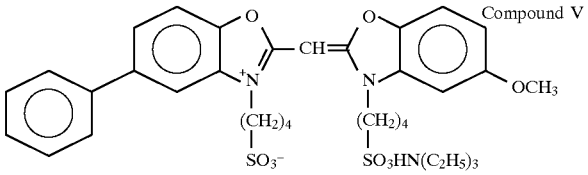

A sample was formed by adding a dye emulsified product S to an emulsion undercoat layer such that the amount of each of ultraviolet absorbing dyes-I to -III was 5 mg/m$^2$ on each surface with respect to the above coating solution.

Ultraviolet absorbing dye-I

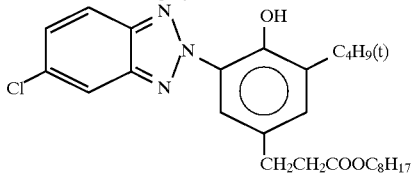

Ultraviolet absorbing dye-II

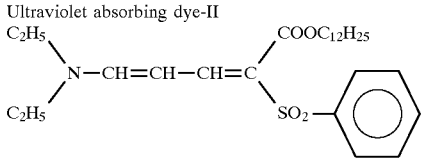

Ultraviolet absorbing dye-III

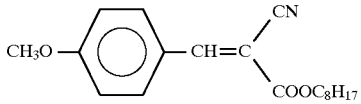

(Preparation of dye emulsified product S)

20 g of each of the ultraviolet absorbing dyes-I to -III, 62.8 g of each of high-boiling organic solvents-I and -II presented below, and 333 g of ethyl acetate were dissolved at 60° C. 65 cc of an aqueous 5% solution of sodium dodecylsulfonate, 94 g of gelatin, and 581 cc of water were added to the resultant solution, and the solution was emulsion-dispersed at 60° C. for 30 min by a dissolver. Subsequently, 2 g of compound-IX presented below and 6 l of water were added, and the temperature was decreased to 40° C. The resultant material was concentrated until the total amount was 2 kg by using an ultrafiltration labomodule ACP1050 manufactured by ASAHI CHEMICAL INDUSTRY CO., LTD. 1 g of the compound-IX was added to obtain the dye emulsified product S.

High boiling organic solvent-I

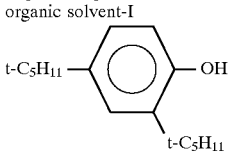

High boiling organic solvent-II

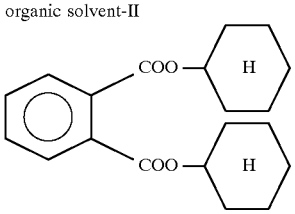

Compound-IX

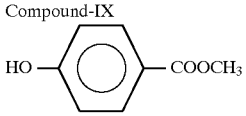

Color-forming couplers and reducing agent for color formations were dissolved in 73 cc of ethyl acetate and 52 g of a solvent Solv-1 as shown in Table 4. The resultant solution was emulsion-dispersed in 420 cc of an aqueous 12% gelatin solution containing 10% sodium dodecylbenzenesulfonate and citric acid, thereby forming emulsified products as shown in Table 4.

TABLE 4

| Emulsion | Color-forming couplers and coating amount per mole of Ag | Reducing agent for color formation and coating amount per mole of Ag |
|---|---|---|
| A-1 | C-77<br>$1.8 \times 10^{-1}$ mol<br>C-28<br>$1.8 \times 10^{-1}$ mol<br>C-42<br>$1.8 \times 10^{-1}$ mol | I-1<br>$5 \times 10^{-1}$ mol |

(Preparation of surface protective layer coating solution)

A surface protective layer coating solution was prepared such that the coating amounts of the individual components were as follows.

g/m$^2$

Gelatin 0.780

Sodium polyacrylate 0.035 (average molecular weight 400,000)

Sodium polystyrenesulfonate 0.0012 (average molecular weight 600,000)

Polymethylmethacrylate 0.072 (average grain size 3.7 $\mu$m)

Coating aid-I 0.020

Coating aid-II 0.037

Coating aid-III 0.0080

Coating aid-IV 0.0032

Coating aid-V 0.0025

Benzisothiazolone 0.0010

(pH was adjusted to 6.8 by NaOH)

Coating aid-I

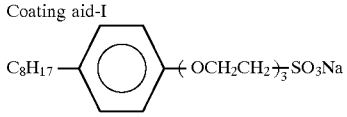

Coating aid-II

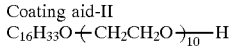

Coating aid-III

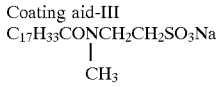

Coating aid-IV

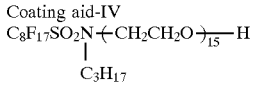

Coating aid-V

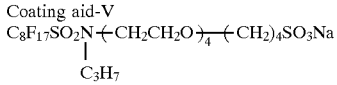

(Preparation of support)

(1) Preparation of undercoat layer dye dispersion B

Dye-II presented below was processed by using a ball mill in accordance with a method described in JP-A 63-197943.

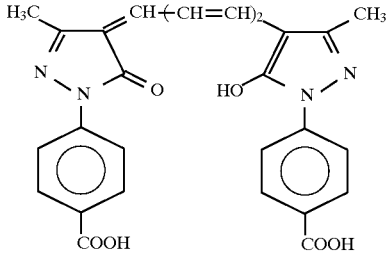

Dye-II 434 cc of water and 791 cc of an aqueous 6.7% solution of Triton X200 (tradename) and a surfactant TX-200 (tradename) were placed in a 2-l ball mill. 20 g of the dye were added to the solution. 400 ml of zirconium oxide (ZrO2) beads (diameter 2 mm) were added to mill the contents for four days. Thereafter, 160 g of 12.5% gelatin were added. After defoaming, the $ZrO_2$ beads were removed by filtration. When the resultant dye dispersion was observed, it was found that the particle sizes of the milled dye had a broad range of 0.05 to 1.15 $\mu$m and the average particle size was 0.37 $\mu$m.

Furthermore, dye particles whose particle size was 0.9 $\mu$m or larger were removed by centrifugal separation.

A dye dispersion B was thus obtained.

(2) Preparation of support

Corona discharge was performed on a biaxially oriented 175-fm thick polyethyleneterephthalate film, and the film was coated with a first undercoat solution having the following composition by using a wire bar coater so that the coating amount was 4.9 cc/m$^2$. The resultant film was dried at 185° C. for one min.

The first undercoat layer was similarly formed on the other surface. The polyethyleneterephthalate used contained 0.06 wt % of the dye-IV and 0.06 wt % of the dye-V.

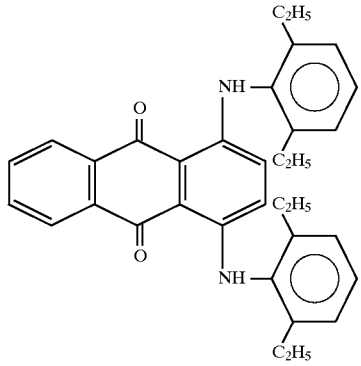

Dye-IV

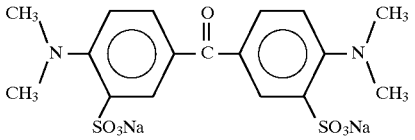

Dye-V

| | |
|---|---|
| Butadiene-styrene copolymer latex solution (solid content 40%, butadiene/styrene weight ratio = 31/69) | 158 cc |
| 2,4-dichloro-6-hydroxy-s-triazine sodium salt 4% solution | 41 cc |
| Distilled water | 801 cc |

*The latex solution contained 0.4 wt % of the following compound as an emulsion dispersant with respect to the latex solid content.

(Dispersing agent for emulsification) contains

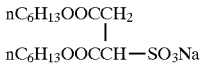

in an amount of 0.4 wt % based on solid latex (3) Coating of undercoat layers

The first undercoat layers on the two surfaces were coated with second undercoat layers having the following composition by using a wire bar coater such that the coating amounts were as described below. The resultant material was dried at 155° C.

| | |
|---|---|
| Gelatin | 80 mg/m$^2$ |
| Dye dispersion B (as dye solid content) | 8 mg/m$^2$ |
| Coating aid-VI | 1.8 |
| Compound-VIII | 0.27 |
| Matting agent polymethylmethacrylate having average grain size of 2.5 $\mu$m | 2.5 |

Coating aid-VI $C_{12}H_{25}O(CH_2CH_2O)_{10}H$

Compound-VIII

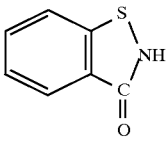

0.27 mg/m$^2$ (Preparation of photographic material)

The two surfaces of the support prepared as described above were coated with the auxiliary developing agent layer coating solution, the emulsion layer coating solution, and the surface protective layer coating solution by using a co-extrusion method. The coating silver amount per surface was 0.80 g/m$^2$. In this manner a comparative sample 901 was formed.

Example-12

Formation of photographic stabilizer-containing samples (present invention) and evaluation of photographic properties Samples 1101 to 1105 were formed by adding photographic stabilizers shown in Table 5 to the coated sample 901 formed in Example-11.

TABLE 5

| Sample No. | Stabilizer | (Amount in mmol/Ag mol) | Layers added |
|---|---|---|---|
| 1101 | A-3 | 0.3 | Emulsion layer |
| 1102 | B-1 | 0.3 | Emulsion layer |
| 1103 | A-3 | 0.2 | Emulsion layer |
| | B-1 | 0.15 | Emulsion layer |
| | C-3 | 0.1 | Emulsion layer |
| 1104 | A-3 | 0.2 | Emulsion layer |
| | B-1 | 0.15 | Emulsion layer |
| | C-3 | 0.1 | Emulsion layer |
| 1105 | A-3 | 0.2 | Emulsion layer |
| | B-1 | 0.15 | Emulsion layer |
| | C-4 | 0.2 | Emulsion layer |
| | A-2 | 0.3 | Surface protecting layer |

(Evaluation of photographic properties)

An HR-4 screen and an HGM screen available from Fuji Photo Film Col., Ltd. and a UV rapid screen available from Du Pont de Nemours, E.I., Co. were brought into contact with the two sides and exposure was performed for 0.05 sec from the two sides, thereby performing X-ray sensitometry.

The exposure amount was adjusted by changing the distance between an X-ray bulb and a cassette. After the exposure, automatic developing machine processing was performed by using the developer and the fixing solution described below.

(Processing)

Automatic developing machine . . . CEPROS-30 manufactured by Fuji Photo Film Co., Ltd. was modified to form a rinse tank between a fixing tank and a washing tank.

| Developer-1 (alkali active solution) | Tank solution | Replenisher |
|---|---|---|
| Water | 800 ml | 800 ml |
| Tripotassium phosphate | 30 g | 39 g |
| 5-nitrobenzotriazole | 0.1 g | 0.25 g |
| Disodium-N,N-bis(sulfonate ethyl) hydroxylamine | 3.3 g | 6.6 g |
| Potassium chloride | 10 g | — |
| Hydroxyethylidene-1,1-diphosphonic acid (30% solution) | 4 ml | 4 ml |
| Water to make 1 l | pH 12.0 | pH 12.0 |

<Fixing solution> (tank solution and replenisher are the same)

| | |
|---|---|
| Ammonium thiosuifate (70 weight/volume %) | 3000 ml |
| Ethylenediaminetetraacetic acid ~ disodium ~ dihydrate | 0.45 g |

-continued

| | |
|---|---|
| Sodium sulfite | 225 g |
| Boric acid | 60 g |
| 1-(N,N-diethylamine)-ethyl-5-mercaptotetrazole | 15 g |
| Tartaric acid | 48 g |
| Glacial acetic acid | 675 g |
| Sodium hydroxide | 225 g |
| Sulfuric acid (36 N) | 58.5 g |
| Aluminum sulfate | 150 g |
| Water to make | 6000 ml |
| pH | 4.68 |

(Rinse solution)

| | |
|---|---|
| $K_3CO_3$ | 30 g |
| Tetrabutylammonium.bromide | 8 g |
| Acetic acid | 6.8 g |
| Water to make | 1 l |
| pH | 10.00 |

Tap water was filled in the washing tank.

In addition, as a fur inhibitor, ray fungus was carried by a pearlite having an average grain size of 100 μm and an average pore size of 3 μm, and 0.4 g of this pearlite was filled in a polyethylene bottle (the opening of the bottle was covered with 300-mesh nylon cloth through which water and fungus could flow).

Three such bottles were prepared. Two bottles were placed on the bottom of the washing tank, and one bottle was placed on the bottom of the stock tank (0.2 l) of washing water.

Processing speed and processing temperature

| | | |
|---|---|---|
| Development | 40° C. | 10 sec |
| Fixing | 30° C. | 7.7 |
| Rinse | 17° C. | 5.0 |
| Washing | 17° C. | 5.0 |
| Squeegee | | 3.3 |
| Drying | 58° C. | 9.0 |
| Total | | 40 |
| Replenishment rate | developer | 12 ml/10 × 12 in. |
| | fixer | 12 ml/10 × 12 in. |

Table 6 shows the sensitometry data of the samples 901 and 1101 to 1105. The values of sensitivity and Dmin were normalized with respect to the comparative sample 901.

TABLE 6

| Sample No. | Sensitivity* | Dmin* |
|---|---|---|
| 901 (Comparison) | 100 | 100 |
| 1101 (This invention) | 120 | 30 |
| 1102 (This invention) | 110 | 20 |
| 1103 (This invention) | 105 | 50 |
| 1104 (This invention) | 150 | 10 |
| 1105 (This invention) | 150 | 10 |

*Sensitivity and Dmin were expressed in relative values assuming each of the values of comparative Sample No. 801 as 100.

What is claimed is:

1. A silver halide photographic light-sensitive material having a photographic constituting element layer structure on a support, said layer structure comprising at least two red-sensitive silver halide emulsion layers of differing sensitivities, at least two green-sensitive silver halide emulsion layers of differing sensitivities, and at least two blue-sensitive silver halide emulsion layers of differing sensitivities; wherein said layer structure further comprises in said at least one red, green or blue-sensitive silver halide emulsion layers, a dye-forming coupler, a reducing agent for color formation represented by general formula (I) or (II) below, and at least one photographic stabilizer selected from groups A to E below:

General formula (I)

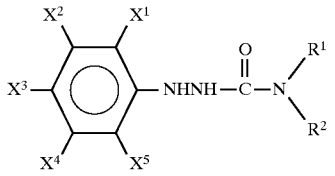

General formula (II)

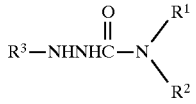

wherein each of $R^1$ and $R^2$ independently represents a hydrogen atom or a substituent group, each of $X^1$, $X^2$, $X^3$, $X^4$, and $X^5$ independently represents a hydrogen atom or a substituent group, a sum of Hammett substituent constants $\sigma_p$ of $X^1$, $X^3$, and $X^5$ and Hammett substituent constants $\sigma_m$ of $X^2$ and $X^4$ being 0.80 to 3.80, and $R^3$ represents a heterocyclic group; photographic stabilizers Group A: mercapto heterocylic nitrogen compounds each having a mercapto group bonded to a carbon atom which is bonded to an adjacent nitrogen atom in a heterocyclic system, Group B: quaternary aromatic chalcogen azolium salts wherein said chalcogen is sulfur, selenium, or tellurium, Group C: triazoles or tetrazoles each having ionic hydrogen bonded to a nitrogen atom in a heterocyclic system, Group D: dichalcogenide compounds each having an —X—X-bond (wherein each X represents divalent sulfur, selenium, or tellurium) between carbon atoms, and Group E: organic compounds each having thiosulfonic acids or salts thereof having a structure —$SO_2SM$ (wherein M represents a proton or a cation); wherein said reducing agent and said stabilizer are present in the same at least one silver halide emulsion layer.

2. The material according to claim 1, wherein said reducing agent for color formation represented by general formula (I) or (II) is represented by general formula (III) or (IV), respectively:

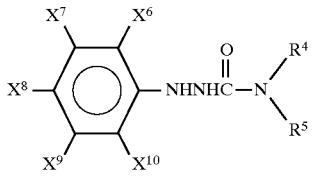

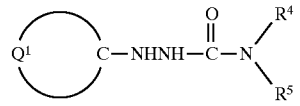

wherein each of $R^4$ and $R^6$ independently represents a hydrogen atom or a substituent group, each of $X^6$, $X^7$, $X^8$, $X^9$, and $X^{10}$ independently represents a hydrogen atom, a cyano group, a sulfonyl group, a sulfinyl group, a sulfamoyl group, a carbamoyl group, an alkoxycarbonyl group, an aryloxycarbonyl group, an acyl group, a trifluoromethyl group, a halogen atom, an acyloxy group, an acylthio group, or a heterocyclic group, a sum of Hammett substituent constants $\sigma_p$ of $X^6$, $X^8$, and $X^{10}$ and Hammett substituent constants $\sigma_m$ of $X^7$ and $X^9$ being 1.20 to 3.80, and $Q^1$ represents non-metallic atoms required to form a nitrogen-containing 5- to 8-membered heterocyclic ring together with C.

3. The material according to claim 1, further comprising a mordant.

4. The material according to claim 1, further comprising an auxiliary developing agent and/or a precursor thereof.

5. The material according to claim 1, wherein said photographic stabilizer is selected from Group A.

6. The material according to claim 1, wherein said photographic stabilizer is selected from Group B.

7. The material according to claim 1, wherein said photographic stabilizer is selected from Group D.

8. The material according to claim 1, wherein said photographic stabilizer is selected from Group E.

9. The material according to claim 1, wherein said silver halide emulsion is occupied by tabular grains having an aspect ratio of not less than 2 in an amount of not less than 50% of the total projected area of all grains in said silver halide emulsion, and a silver chloride content of said silver halide in said silver halide emulsion is not less than 50 mol %.

10. The material according to claim 2, further comprising a mordant.

11. The material according to claim 2, further comprising an auxiliary developing agent and/or a precursor thereof.

12. The material according to claim 2, wherein said photographic stabilizer is selected from Group A.

13. The material according to claim 2, wherein said photographic stabilizer is selected from Group B.

14. The material according to claim 2, wherein said photographic stabilizer is selected from Group D.

15. The material according to claim 2, wherein said photographic stabilizer is selected from Group E.

16. The material according to claim 2, wherein said silver halide emulsion is occupied by tabular grains having an aspect ratio of not less than 2 in an amount of not less than 50% of the total projected area of all grains in said silver halide emulsion, and a silver chloride content of said silver halide in said silver halide emulsion is not less than 50 mol %.

17. The material according to claim 3, further comprising an auxiliary developing agent and/or a precursor thereof.

18. The material according to claim 3, wherein said photographic stabilizer is selected from Group A.

19. The material according to claim 3, wherein said photographic stabilizer is selected from Group B.

20. The material according to claim 3, wherein said photographic stabilizer is selected from Group D.

21. The material according to claim 3, wherein said photographic stabilizer is selected from Group E.

22. The material according to claim 3, wherein said silver halide emulsion is occupied by tabular grains having an aspect ratio of not less than 2 in an amount of not less than 50% of the total projected area of all grains in said silver halide emulsion, and a silver chloride content of said silver halide in said silver halide emulsion is not less than 50 mol %.

23. The material of claim 1 wherein $X^1$, $X^2$, $X^3$, $X^4$ and $X^5$ are selected from the group consisting of a 1–50 carbon straight-chain, branched or cyclic alkyl group; a 2–50 carbon straight-chain, branched or cyclic alkenyl group; a 2–50 carbon alkinyl group; a 1–50 carbon acyloxy group; a 1–50 carbon carbamoyloxy group; a 1–50 carbon carbonamide group; a 1–50 carbon sulfonamide group; a 1–50 carbon carbamoyl group; a 0–50 carbon sulfamoyl group; a 1–50 carbon alkoxy group; a 6–50 carbon aryloxy group; a 7–50 carbon aryloxycarbonyl group; a 2–50 carbon alkoxycarbonyl group; a 1–50 carbon N-acylsulfamoyl group; a 1–50 carbon alkylsulfonyl group; a 6–50 carbon arylsulfonyl group; a 7–50 carbon aryloxycarbonylamino group; a 0–50 carbon amino group, a cyano group, a nitro group, a carboxyl group; a hydroxy group; a sulfo group; a mercupto group; a 1–50 carbon alkylsulfinyl group; a 6–50 carbon arylsulfinyl group; a 1- to 50-carbon alkylthio group; a 6- to 50-carbon arylthio group; a 1- to 50-carbon ureido group; a 2- to 50-carbon heterocyclic group; a 1- to 50-carbon acyl group; a 0- to 50-carbon sulfamoylamino group; and a halogen atom.

* * * * *